US012331459B2

(12) United States Patent
Demler et al.

(10) Patent No.: US 12,331,459 B2
(45) Date of Patent: Jun. 17, 2025

(54) RAGGER SYSTEMS AND METHODS FOR REMOVING SOLID DEBRIS FROM PULPING PROCESSES

(71) Applicant: Kadant Black Clawson LLC, Lebanon, OH (US)

(72) Inventors: Christopher Demler, Lebanon, OH (US); Daniel Parenteau, Montreal (CA); Patrick McEnroe, Cincinnati, OH (US); Michael Lopane, West Chester, OH (US); Gary Scott Williamson, Middletown, OH (US)

(73) Assignee: KADANT BLACK CLAWSON, LLC, Lebanon, OH (US)

( * ) Notice: Subject to any disclaimer, the term of this patent is extended or adjusted under 35 U.S.C. 154(b) by 472 days.

(21) Appl. No.: 17/669,882

(22) Filed: Feb. 11, 2022

(65) Prior Publication Data

US 2022/0259802 A1 Aug. 18, 2022

Related U.S. Application Data

(60) Provisional application No. 63/148,666, filed on Feb. 12, 2021.

(51) Int. Cl.

| | |
|---|---|
| ***D21B 1/32*** | (2006.01) |
| ***D21B 1/34*** | (2006.01) |
| ***D21C 7/12*** | (2006.01) |

(52) U.S. Cl.

CPC ..... *D21B 1/32* (2013.01); *D21B 1/34* (2013.01); *D21C 7/12* (2013.01)

(58) Field of Classification Search

CPC ..... D21C 7/12; D21B 1/34; D21B 1/32

See application file for complete search history.

(56) References Cited

U.S. PATENT DOCUMENTS 2,340,511 A 2/1944 Edwin
3,844,488 A * 10/1974 Neitzel ..... D21B 1/345 241/73

(Continued)

FOREIGN PATENT DOCUMENTS

CN 107724148 A * 2/2018 ..... D21B 1/345
KR 20080067998 A 1/2011

(Continued)

OTHER PUBLICATIONS

King, Brett, Utilization of an OCC's Plant's Control System, 1998, TAPPI Recycling Symposium, p. 117-121 (Year: 1998).*

(Continued)

*Primary Examiner* — Anthony Calandra
(74) *Attorney, Agent, or Firm* — Dinsmore & Shohl LLP

(57) ABSTRACT

A ragger system for removing solid debris from a pulper vessel of a pulping system is disclosed. The ragger system includes a ragger operable to pull a tail of solid debris from the pulper vessel. The ragger includes a puller mechanism, a puller drive, a rider roll, and a pressure device to adjust a pressure of the rider roll on the tail between the puller mechanism and the rider roll. The ragger system includes a measurement device for determining attributes of the tail, operating conditions of the pulping system or ragger, or combinations of these. The ragger system includes a control system that measures input variables with the measurement devices, determines the attributes of the tail or operating conditions from the input variables, and adjusts a withdrawal rate, pull direction, pressure, rider roll torque or speed, or combinations thereof to maintain continuity of operation of the ragger.

22 Claims, 13 Drawing Sheets

(56) References Cited

U.S. PATENT DOCUMENTS

| | | | | |
|---|---|---|---|---|
| 4,017,033 | A * | 4/1977 | Tra | D21B 1/32 241/28 |
| 4,030,671 | A * | 6/1977 | Couture | D21B 1/345 241/15 |
| 2019/0040576 | A1* | 2/2019 | Menke | B02C 18/142 |
| 2022/0154398 | A1* | 5/2022 | Hautaniemi | D21C 7/12 |

FOREIGN PATENT DOCUMENTS

| | | | |
|---|---|---|---|
| WO | 2010026295 | A1 | 3/2010 |
| WO | 2012062563 | A1 | 5/2012 |

OTHER PUBLICATIONS

English machine translation of CN107724148A, 2013. (Year: 2013).*
Andritz, Pulp & Paper; RagPull RP, Continuous Ragging; Brochure; 2 pgs. Not Dated.
International Search Report and Written Opinion dated May 17, 2022, pertaining to Int'l Patent Application No. PCT/US2022/016140, 14 pgs.

* cited by examiner

RAGGER SYSTEMS AND METHODS FOR REMOVING SOLID DEBRIS FROM PULPING PROCESSES

CROSS-REFERENCE TO RELATED APPLICATIONS

The present application claims the benefit of priority to U.S. Provisional Patent Application No. 63/148,666, filed on Feb. 12, 2021, and entitled "Ragger Systems and Methods for Removing Solid Debris from Pulping Processes," the entire contents of which are incorporated by reference herein.

FIELD

The present specification generally relates to systems and methods for producing pulp for papermaking, in particular, systems and methods for removing solid debris from a pulp slurry during a pulping process.

TECHNICAL BACKGROUND

In the paper industry, processes for making paper includes production of a pulp slurry, which is a slurry of solid fibers, such as cellulose fibers or other plant-based fibers, in water. Recycled paper may be used as a source of solid fibers. Recycled paper is typically added to the pulping process by adding bales of recycled paper into the pulper. Paper recycling processes may rely primarily on recycled paper products as furnish for the paper-making process. The bales of recycled paper can include metal or plastic banding and other solid debris, which may foul the pulping and recycling equipment.

SUMMARY

These metal wires and bands, plastic, and other miscellaneous debris can be removed using a ragger. The ragger initially uses a rope immersed in the pulp slurry to entangle the metal wires and bands, plastic, and other debris, which attach to the rope and are slowly drawn out of the pulper as a tail. By the time the end of the rope reaches the ragger, the tail becomes self-forming, and the ragger continues to pull the tail from the pulping vessel. Although the ragger is a very mature product technology, the ragger is still very simplistic and has not been designed to accommodate for normal variations in operating conditions of today's paper recycling plants. Because of this inability to adjust to changing operating conditions of the pulper, the ragger machines often fail to operate properly and require significant manpower to clear, clean, and put back in service. When the ragger is down, the pulping process is often interrupted and shutdown.

Accordingly, ongoing needs exist for ragger systems and methods of operating raggers that enable the ragger to adjust to changing operational conditions of the pulping operation. The ragger systems and methods of operating ragger systems of the present disclosure enable operating parameters of the ragger, such as rate of withdrawal of the tail, a direction of the puller drive, rider roll pressure, torque or speed of the rider roll etc., to be adjusted in response to changing attributes of the tail or changing operating conditions of the pulping operation to prevent breaking of the tail and to maintain continuous operation of the ragger. The ragger systems of the present disclosure include a ragger having a puller mechanism that is driven and a rider roll coupled to a pressure device operable to cause the rider roll to exert a pressure in a direction towards the puller mechanism and against the tail disposed between the rider roll and the puller mechanism. The systems of the present disclosure can include a drive motor operatively coupled to the rider roll to drive the rider roll and a puller drive that is a variable speed drive (VSD) operatively coupled to the puller mechanism. The drive motor on the rider roll and the VSD operatively coupled to the puller mechanism can be used reduce slippage of the tail pulled from the pulper vessel by the ragger and control operation of the ragger in response to the attributes of the tail or operating conditions of the pulping system.

Additionally, the ragger systems of the present disclosure include one or a plurality of measurement devices and a control system comprising at least one processor, at least one memory module, and computer readable and executable instructions. The measurements devices may include one or more torque sensors, vibration sensors, optical sensors, cameras, weight load sensors, position sensors, pressure sensors, capacitance sensors, ammeters, motor speed sensors, level sensors, flow meters, conveyor speed sensors, temperature sensors, other measuring devices, or combinations of these, as further described herein. The measuring devices may provide electronic signals to the control system that can be indicative of a size, thickness, length, or density of the tail, slippage of the tail relative to the puller mechanism or rider roll, broken tail, metal content of the tail, production rate of the pulper, ratio of recycled furnish to virgin fibers introduced to the pulper, fluid level in the pulper, consistency and/or temperature of the pulp slurry, other operating condition of the pulper or ragger, or combinations of these. The control system may be operable to receive one or more input variables from the measuring devices and adjust a pulling rate at which the ragger withdraws the tail from the pulper, a direction of the puller drive, a pressure of the rider roll on the tail, a torque on the rider roll, a speed of the rider roll, a rotational position of the ragger relative to the pulper vessel, other operating parameter of the ragger, or combinations of these. These adjustments by the control system to the operating parameters of the ragger may allow the ragger system to account for changes in attributes of the tail and/or changes in the operating conditions of the pulping process (e.g., increases or decreases in amount of banding and debris or production rate) to reduce or prevent the occurrences of the tail growing too large and clogging up the ragger or the tail becoming too thin, which can lead to the tail breaking and falling back into the pulper vessel. Reducing ragger clogging and/or tail breakage can improve ragger system uptime and efficiency of the pulping process compared to existing ragger machines.

According to one or more aspects of the present disclosure, a ragger system for removing solid debris from a pulper vessel of a pulping system may include a ragger operable to pull a tail of debris from the pulper vessel. The ragger comprises a puller mechanism comprising a puller drive operatively coupled to the puller mechanism and a rider roll spaced apart from the puller mechanism. The ragger further includes a pressure device configured to adjust a pressure of the rider roll on the tail disposed between the primary roll and the rider roll. The ragger system includes at least one measurement device operable to measure one or more input variables indicative of one or more attributes of the tail, one or more operating conditions of the pulping system, or combinations of these. The ragger system can further include a control system comprising a processor, a memory module communicatively coupled to the processor, and machine readable and executable instructions stored on the memory module. The control system can be communicatively coupled to the at least one measurement device. The control system can also be communicatively coupled to the puller drive, the pressure device, a rider roll drive operatively coupled to the rider roll, or combinations thereof. The machine readable and executable instructions, when executed by the processor, can cause the ragger system to automatically measure the one or more input variables with the at least one measurement device, wherein the one or more input variables is indicative of one or more attributes of the tail, one or more operating conditions of the ragger, one or more operating conditions of the pulping system, or combinations thereof; and adjust a rate of withdrawal of the tail, a direction of the puller drive, a pressure of the pressure device, a torque on the rider roll, a speed of the rider roll, or combinations of these based on the measured input variables.

It is to be understood that both the foregoing general description and the following detailed description describe various embodiments and are intended to provide an overview or framework for understanding the nature and character of the claimed subject matter.

BRIEF DESCRIPTION OF THE DRAWINGS

The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 7:
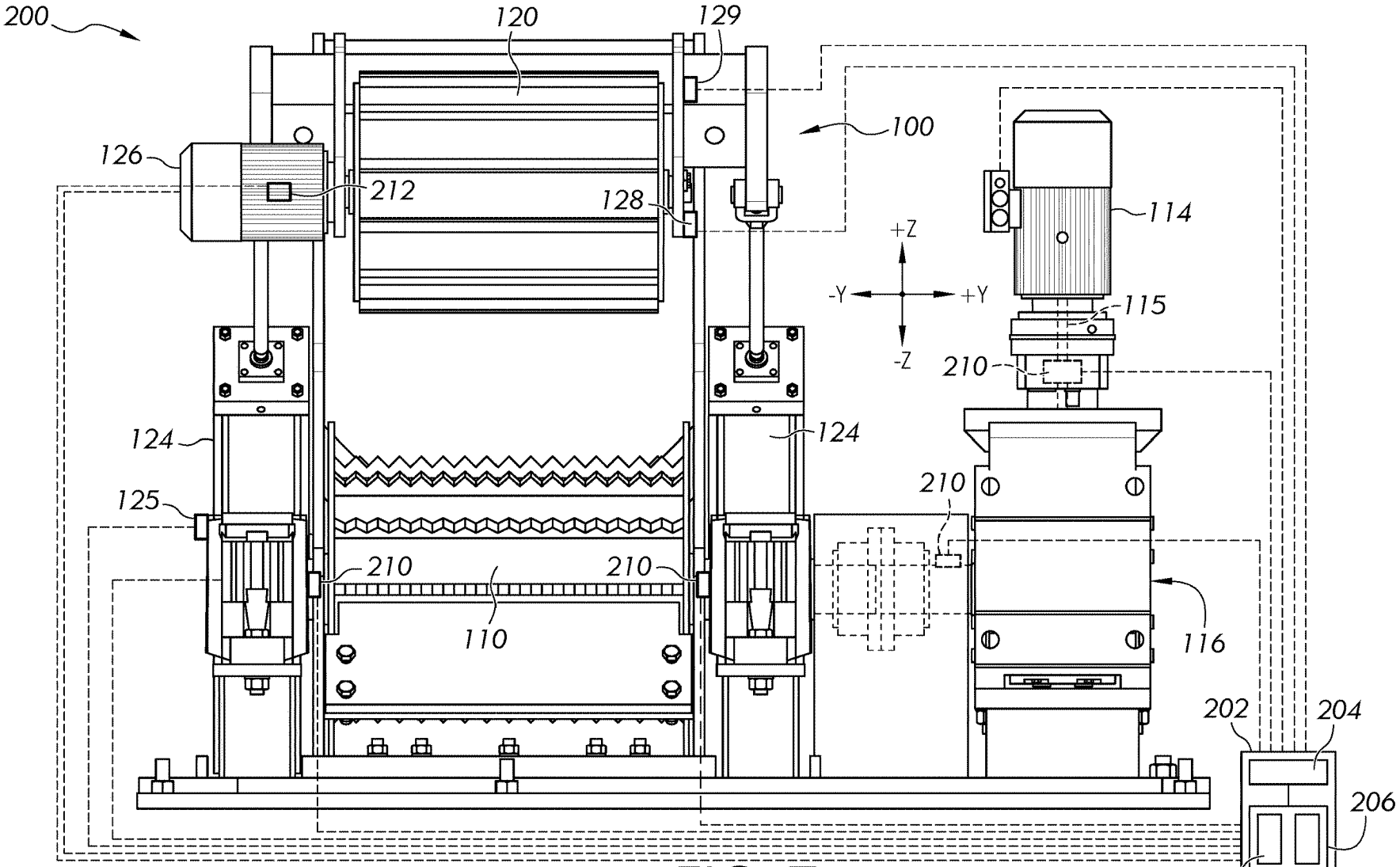
FIG. 7 schematically depicts a side view of an embodiment of a ragger system, according to one or more embodiments shown and described herein.
Figure 13:
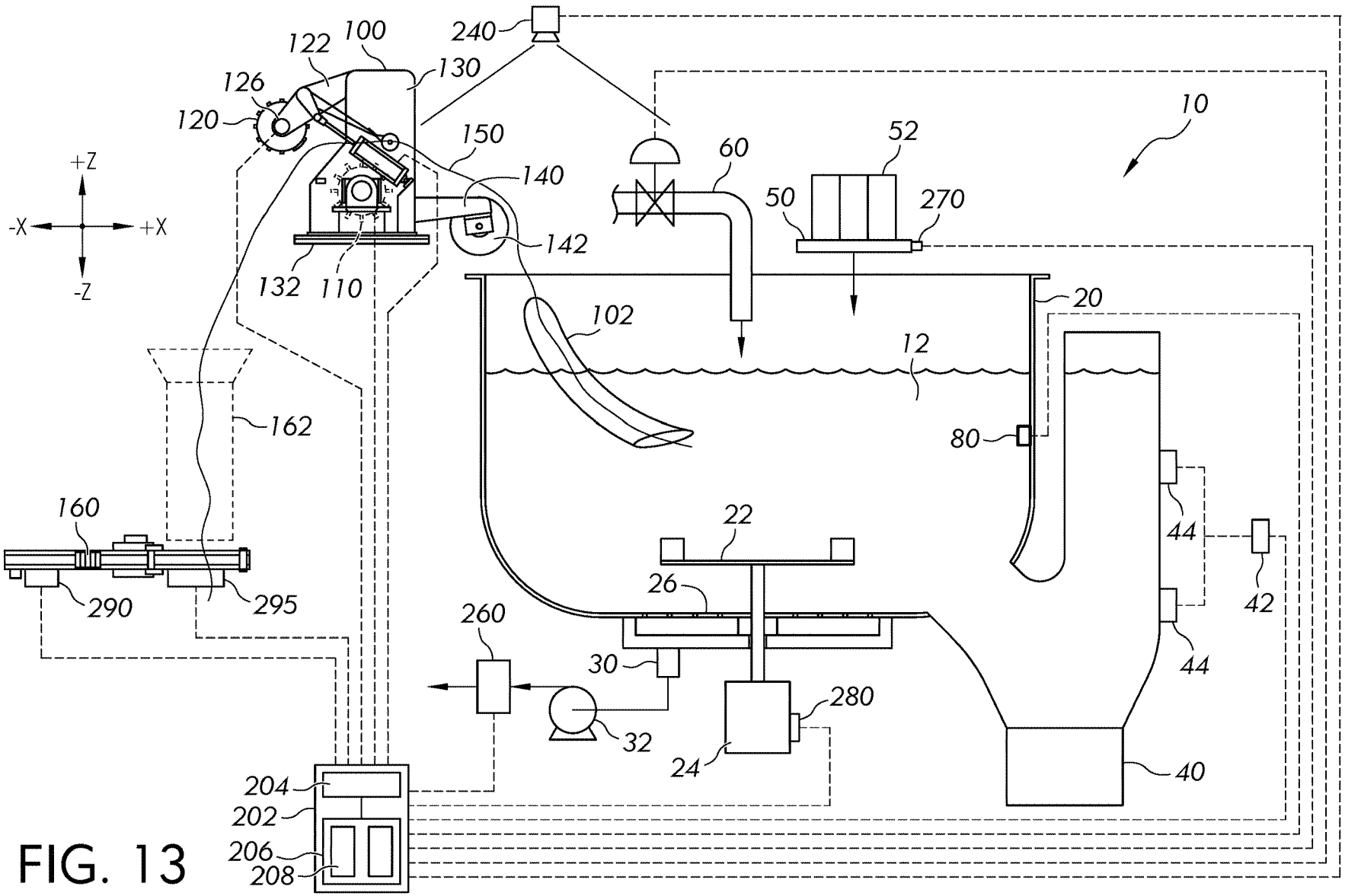
FIG. 13 schematically depicts a front view in partial cross-section of another embodiment of a ragger system, according to one or more embodiments shown and described herein.

Reference will now be made in detail to embodiments of the systems and methods for removing solid debris from a paper pulping process according to the present disclosure. Whenever possible, the same reference numerals will be used throughout the drawings and the detailed description to refer to the same or like parts. Referring to FIGS. 7 and 13, a ragger system 200 for removing solid debris from a pulper vessel 20 of a pulping system 10 may include a ragger 100 operable to pull a tail 102 of solid debris from the pulper vessel 20. Referring to FIG. 7, the ragger 100 may include a puller mechanism (e.g., primary roll 110) comprising a puller drive 114, a rider roll 120 comprising a pressure device 124 operable to adjust a pressure of the rider roll 120 on the tail 102 disposed between the puller mechanism and the rider roll 120. The ragger system 200 may further include at least one measurement device operable to measure one or more input variables indicative of an operating condition of the pulper system 10, operating condition of the ragger 100, and/or a size, weight, thickness, length, density, metal content, position in the pulper vessel 20, or combinations thereof of the tail 102 being pulled from the pulper vessel 20 by the ragger 100. The ragger system 200 can further include a rider roll drive 126 operatively coupled to the rider roll 120.

The ragger system 200 may further include a control system 202 communicatively coupled to the at least one measurement device and the puller drive 114, the rider roll drive 126, the pressure device 124, a ragger rotation device 180 (FIG. 12), or combinations of these. Referring to FIGS. 7 and 13, the control system 202 may include at least one processor 204, at least one memory module 206 communicatively coupled to the at least one processor 204, and machine readable and executable instructions 208 stored on the at least one memory module 206, wherein the machine readable and executable instructions 208, when executed by the processor 204, cause the system to automatically measure the one or more input variables with the measurement device and adjust a withdrawal rate of the tail 102, a direction of the primary roll 110, a pressure of the pressure device 124, a speed of the rider roll 120, a torque of the rider roll 120, a rotational position of the ragger 100 relative to the pulper vessel 20, or combinations of these based on the measured input variables. Methods of removing solid debris from the pulping system 10 using the ragger systems 200 of the present disclosure are also disclosed herein.

Unless otherwise expressly stated, it is in no way intended that any method set forth herein be construed as requiring that its steps be performed in a specific order, nor that specific orientations be required with any apparatus. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred, in any respect. This holds for any possible non-express basis for interpretation, including: matters of logic with respect to arrangement of steps, operational flow, order of components, or orientation of components; plain meaning derived from grammatical organization or punctuation, and; the number or type of embodiments described in the specification.

Directional terms as used herein—for example up, down, right, left, front, back, top, bottom—are made only with reference to the figures as drawn and the coordinate axis provided therewith and are not intended to imply absolute orientation.

As used herein, the singular forms "a," "an" and "the" include plural referents unless the context clearly dictates otherwise. Thus, for example, reference to "a" component includes aspects having two or more such components, unless the context clearly indicates otherwise.

As used herein, the terms "longitudinal" and "axial" may refer to an orientation or direction generally parallel with a center axis A of a cylindrical device such as a pulper vessel, which may be parallel with a +/−Z direction of the coordinate axis in the Figures.

As used herein, the term "radial" may refer to a direction along any radius, which extends outward from the center axis A of a cylindrical device.

As used herein, the term "angular" may generally refer to a direction of increasing or decreasing angle about the center axis A of a cylindrical device.

As used herein, the term "solid contaminant" or "solid debris" may refer to solid objects, such as metal bands, plastic bands, plastic, wood fragments, metal pieces, dried adhesives, or other contaminants, that are not intended to be and not desired in pulp slurry produced by the pulper and may be distinguished from the solid constituents that are intended to be in the solid suspension, such as fibers for example.

As used herein, the term "consistency" refers to the concentration of solid fibers in a pulp slurry and is equal to the weight of pulp fibers in a sample volume divided by the total weight of the pulp slurry in the sample volume.

As used herein, the terms "upstream" and "downstream" refer to the positioning of components or units of the systems relative to a direction of flow of materials through the systems. For example, a first component may be considered "upstream" of a second component if materials passing through the system encounter the first component before encountering the second component. The first component may be considered "downstream" of the second component if the materials encounter the second component before encountering the first component. For the ragger, "upstream" and "downstream" are relative to the direction of travel of the rope, tail, or both from the pulper vessel, through the ragger, and to the cutting station.

Pulping System

Figure 1:
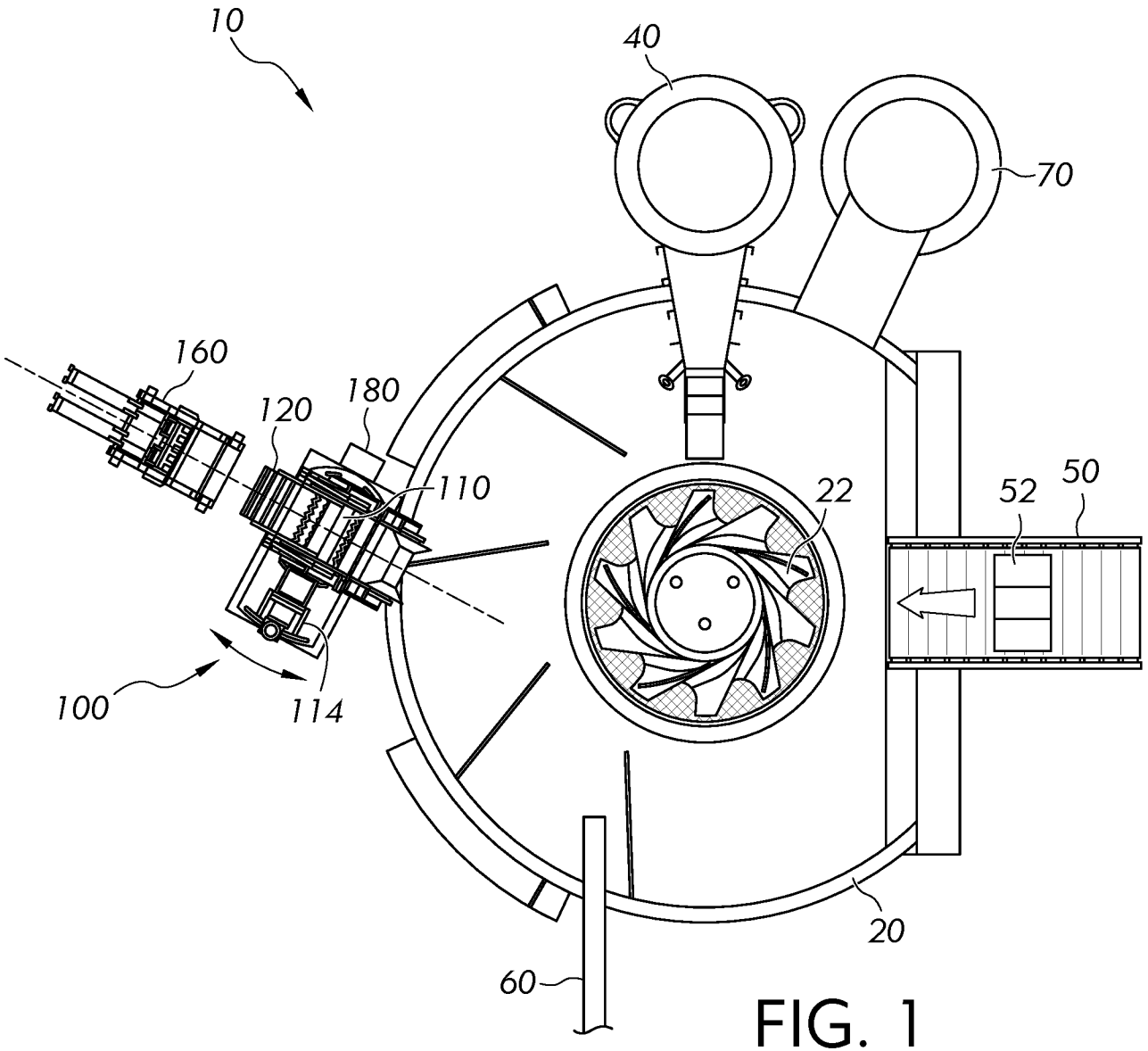
FIG. 1 schematically depicts a top view of a pulping system, according to one or more embodiments shown and described herein.
Figure 2:
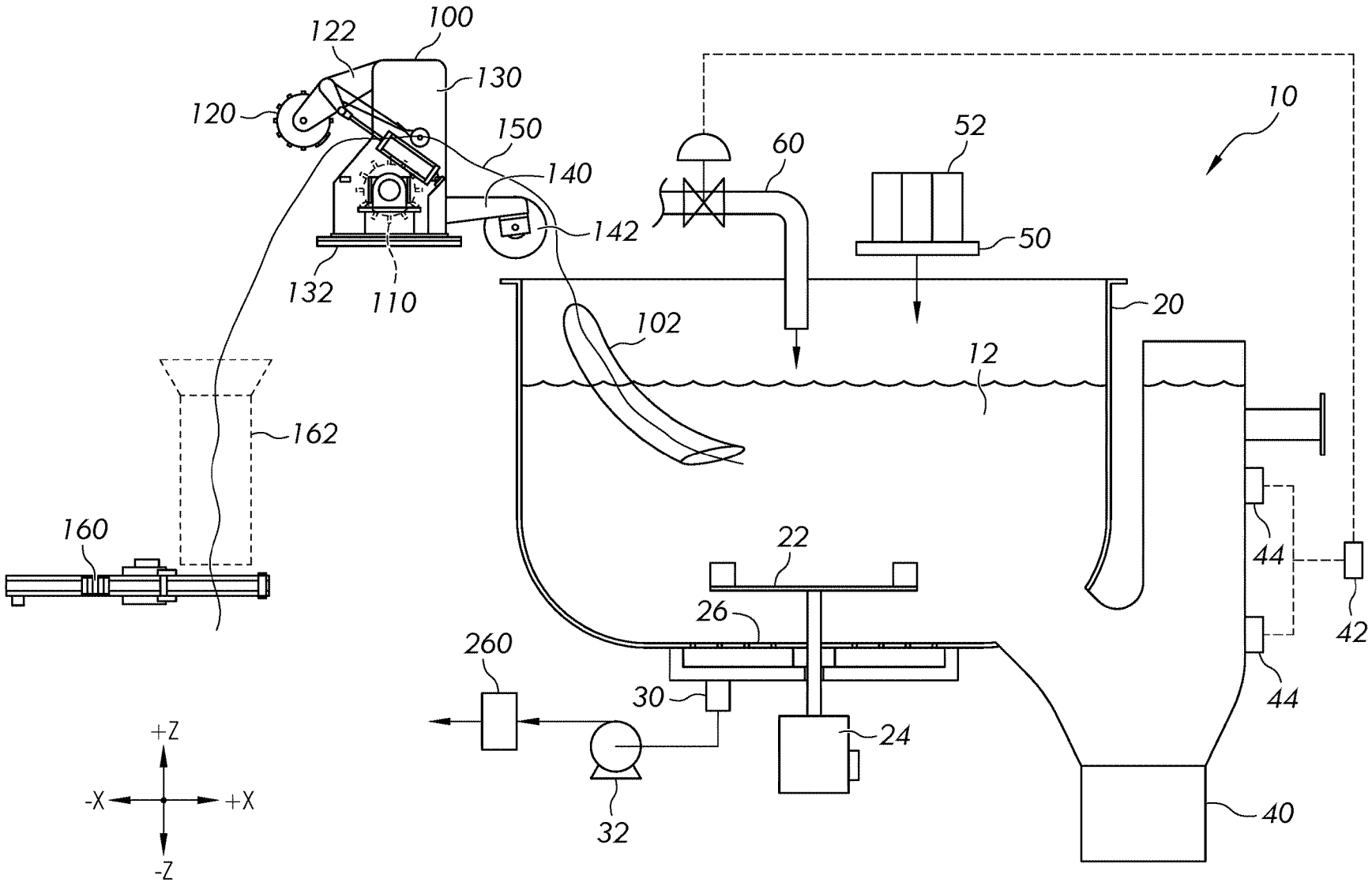
FIG. 2 schematically depicts a side view in partial cross-section of the pulping system of FIG. 1, according to one or more embodiments shown and described herein.

Referring now to FIGS. 1 and 2, a pulping system 10 for producing a pulp slurry 12 for making paper is schematically depicted. The pulping system 10 generally includes a pulper vessel 20 having a rotor 22 and a rotor motor 24. The rotor 22 may be rotated by the rotor motor 24 and may be operable to agitate and mix the pulp slurry 12 in the pulper vessel 20. The pulping system 10 may include a wash tank 70 and a trash well 40 fluidly coupled to the pulper vessel 20. The trash well 40 may be operable to remove from the pulp slurry 12 any non-stringing materials not previously removed by the ragger 100. The pulping system 10 may further include a feed conveyor 50 operable to feed bales 52 of recycled paper furnish, virgin furnish, or both to the pulper vessel 20. The pulping system 10 may further include a water inlet pipe 60 positioned and operable to introduce dilution water to the pulping vessel 20. The pulper vessel 20 may further include a level controller 42 comprising one or a plurality of level sensors 44 operatively coupled to the pulper vessel 20. The level sensors 44 may be any type of commercially available level sensor operable to determine the level of the pulp slurry 12 in the pulper vessel 20. In embodiments, the level sensor 44 may be a radar sensor. The level controller 42 may be communicatively coupled to a control valve in the water inlet pipe 60 to control the addition of dilution water to the pulper vessel 20 to maintain a constant fluid level in the pulper vessel 20.

The pulper vessel 20 may further include a perforated extraction plate 26 disposed vertically below (e.g., in the −Z direction of the coordinate axis of FIG. 2) the rotor 22. The perforated extraction plate 26 may selectively allow passage of good fiber while maintaining other solid trash or debris in the pulper vessel 20. The perforated extraction plate 26 may be in fluid communication with the outlet 30 of the pulping system 10. The outlet 30 may be downstream of the perforated extraction plate 26 and may be operable to pass the acceptable pulp slurry out of the pulping system 10. The pulping system 10 may include a pump 32 downstream of the outlet 30. The pulping system 10 may include one or more consistency measurement devices 260 that may be operable to measure a consistency (i.e., fiber concentration) of the pulp slurry 12 discharged from the pulper vessel 20. The pulping system 10 further includes the ragger 100 operable to remove metal wires or banding, plastic banding or sheeting, textiles, and other solid debris from the pulp slurry 12 during the pulping process.

In the operation of the pulping system 10, the pulper vessel 20 is continuously supplied with recycled paper, such as but not limited to used paper, cardboard, corrugated containers, or other types of recycled paper products, and/or virgin fiber, which together may be referred to as the furnish. The pulp slurry 12 passes through the perforated extraction plate 26 and is removed from the outlet 30 of the pulping system 10 continuously by the pump 32 at a sufficiently rapid rate to limit the retention time of the furnish in the pulper vessel 20 to a short interval sufficient to effect the desired initial breakdown of the furnish to produce the pulp slurry 12.

As previously discussed, the recycled paper furnish to the pulping system 10 can contain solid debris, such as but not limited to metal and plastic banding, metal wires, plastic sheeting, textiles, paper products unable to be broken down into fibers in the pulping system 10, sand, grit, wood pieces, and other solid debris. This solid debris must be removed from the pulp slurry 12 during the pulping process.

Ragger

Referring to FIG. 2, the pulping system 10 comprises the ragger 100 that is operable to remove or pull a tail 102 of the solid debris from the pulper vessel 20. The ragger 100 can be configured to gradually pull the tail 102 from the pulper vessel 20 at a withdrawal rate that allows the tail to continue to form in the pulper vessel 20 without becoming too large. The ragger 100 may include a puller mechanism. The puller mechanism can include one or a plurality of driven rolls, a driven belt, or other mechanism operable to pull the tail 102 from the pulper vessel 20. The puller mechanism is depicted in FIGS. 1-13 and described throughout the written description in the text of a primary roll 110. However, it is understood that the puller mechanism can include a plurality of rolls, belts, or other devices capable of pulling the tail 102 out of the pulper vessel 20. The ragger 100 further includes a rider roll 120 attached to a rider roll arm 122. The rider roll arm 122 may be operable to pivot the rider roll 120 relative to the primary roll 110 or other puller mechanism to change the position of the rider roll 120 relative to the primary roll 110, such as by moving the rider roll 120 closer to or farther away from the primary roll 110. The primary roll 110 and rider roll arm 122 may be coupled to a ragger frame 130. The ragger 100 may further include a guide arm 140 having a guide roll 142 disposed at the end of the guide arm 140. The ragger 100 may include a rope 150 for starting up the ragger 100. The ragger 100 may further include a cutting station 160 positioned downstream of the primary roll 110 and rider roll 120.

Figure 3:
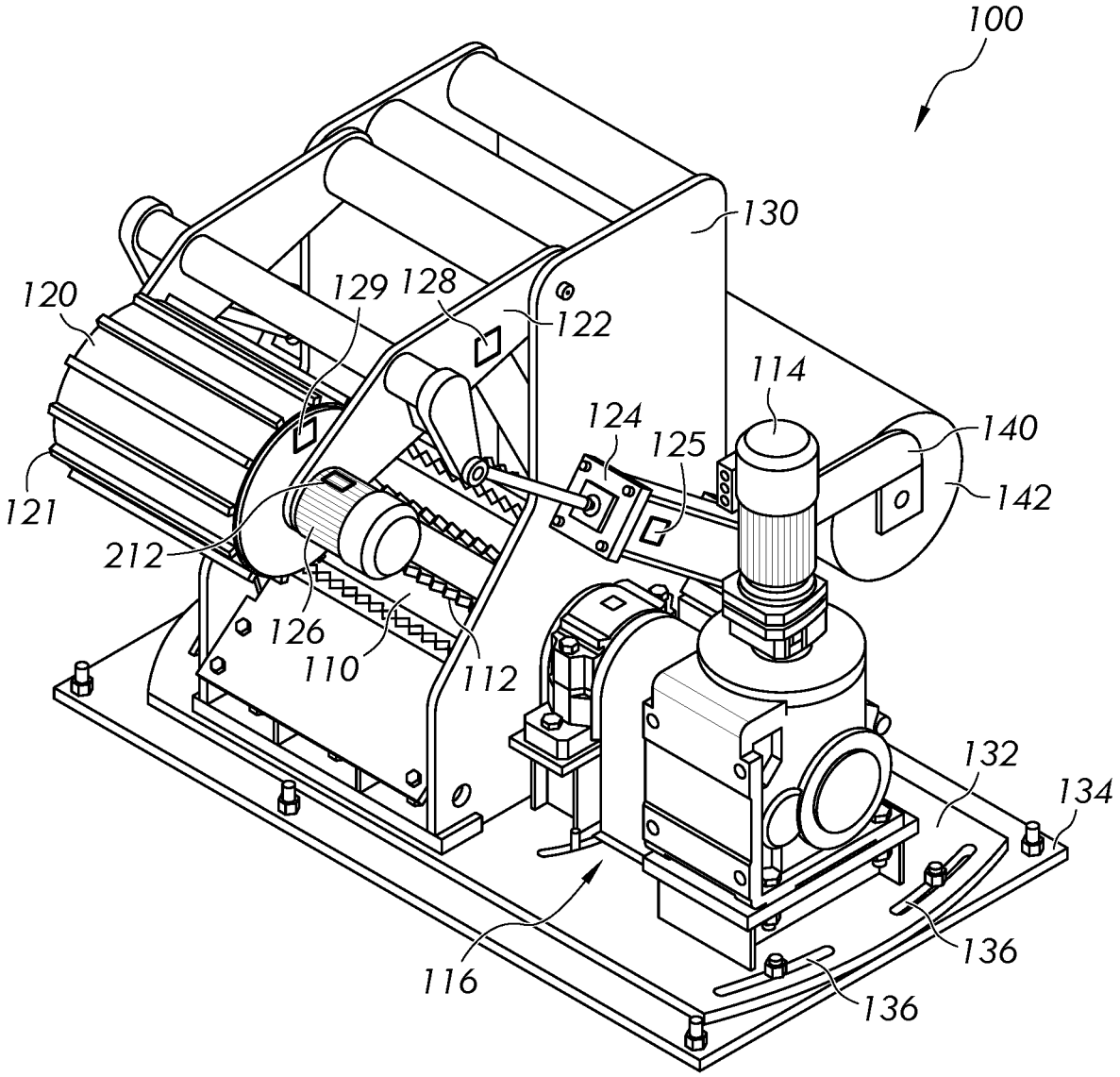
FIG. 3 schematically depicts a perspective view of a ragger of the pulping system of FIG. 1, according to one or more embodiments shown and described herein.
Figure 3:
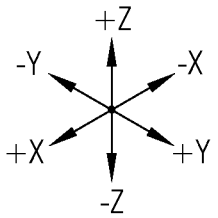
Figure 4:
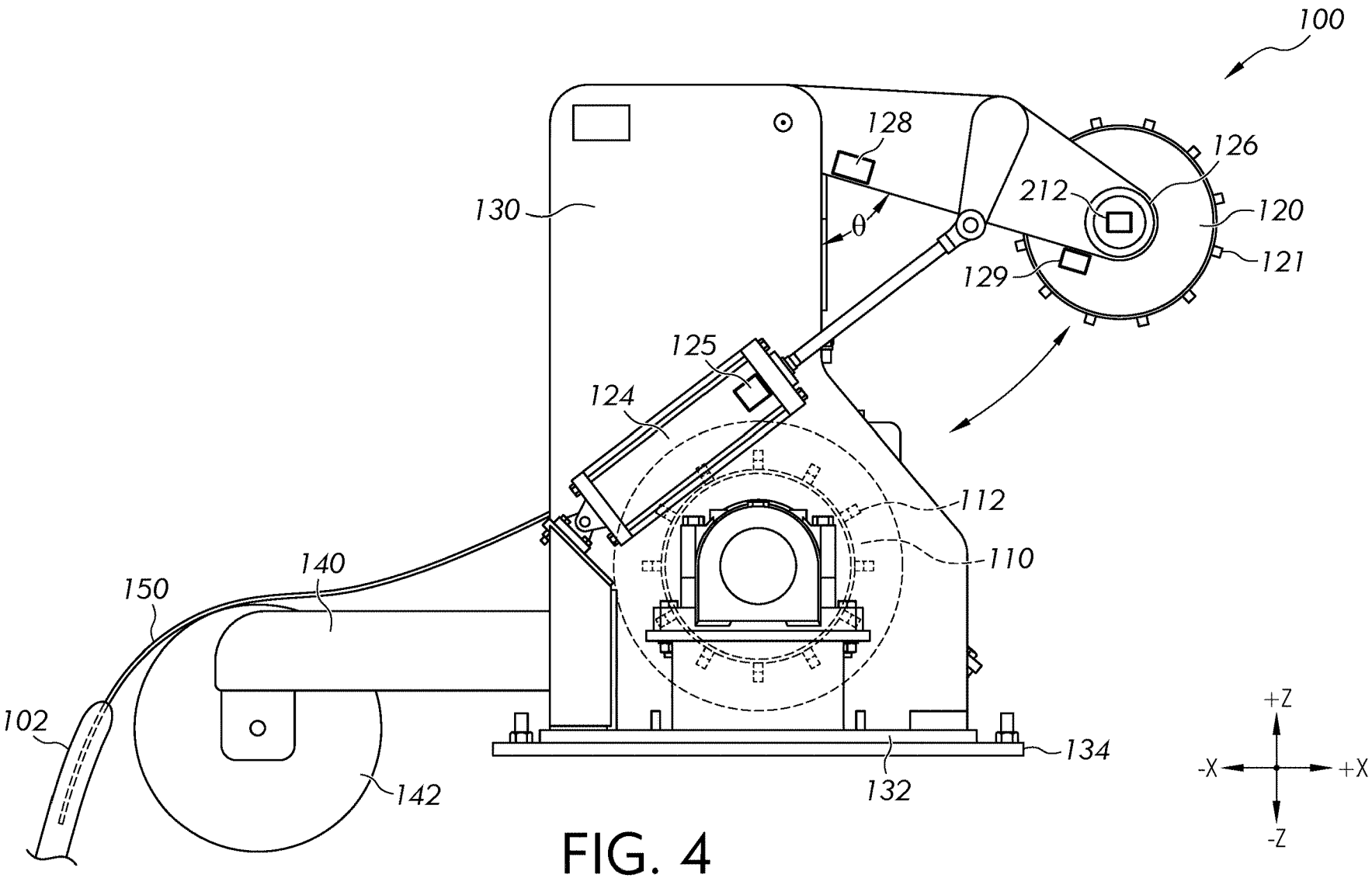
FIG. 4 schematically depicts a side view of the ragger of FIG. 3, according to one or more embodiments shown and described herein.
Figure 5:
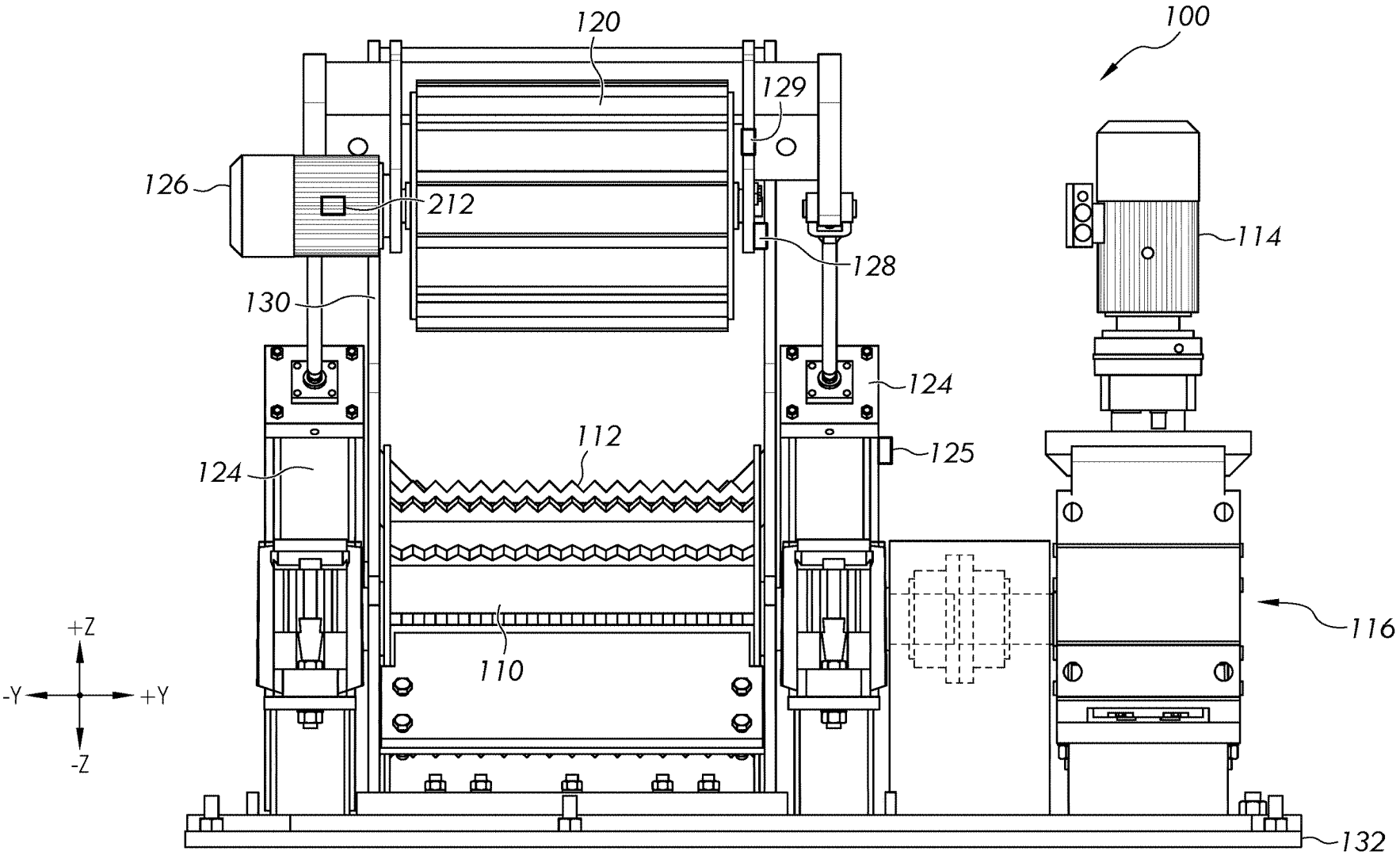
FIG. 5 schematically depicts a front view of the ragger of FIG. 3, according to one or more embodiments shown and described herein.
Figure 6:
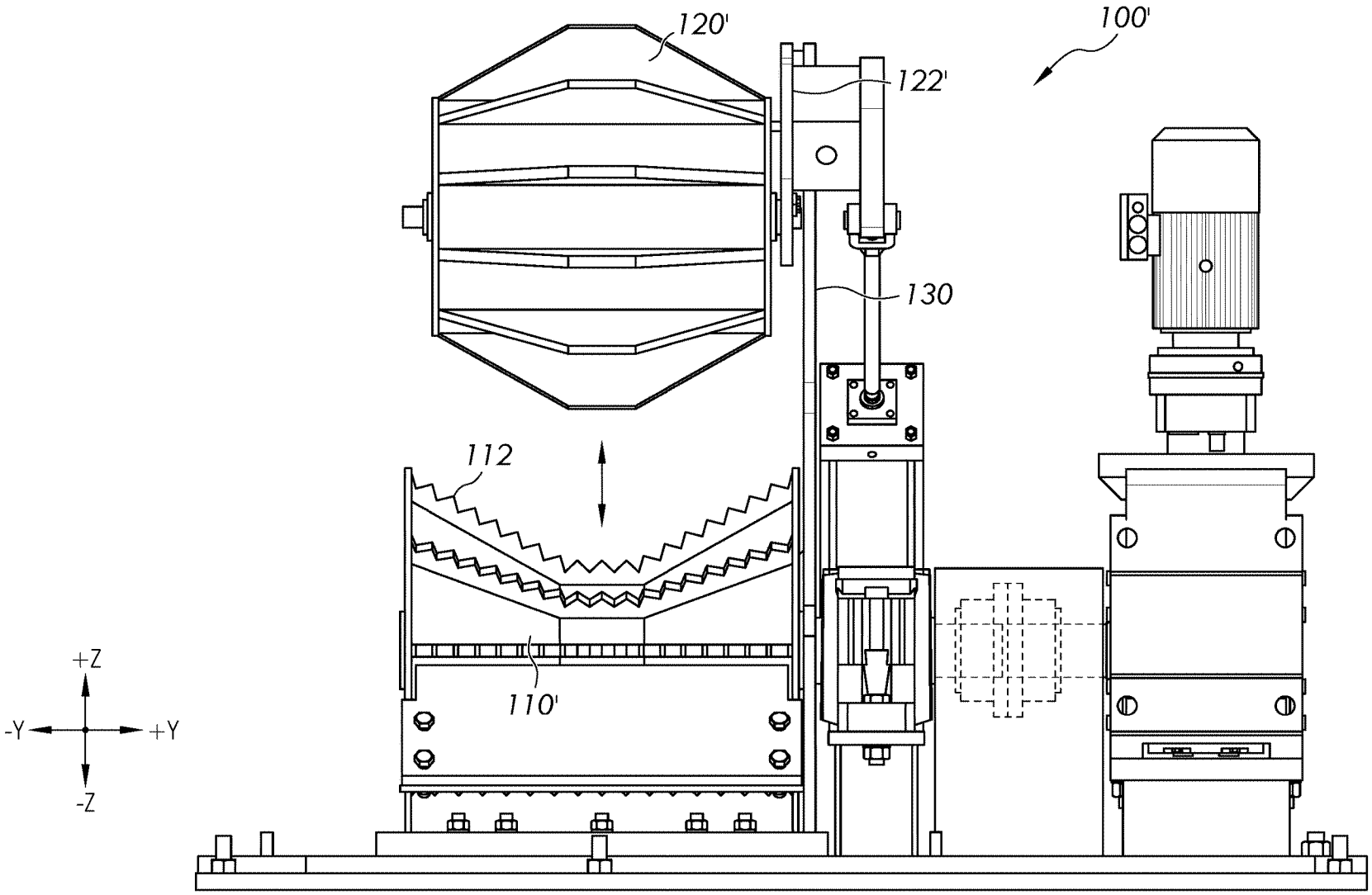
FIG. 6 schematically depicts a front view of another embodiment of a ragger, according to one or more embodiments shown and described herein.

Referring now to FIGS. 3, 4, and 5, an embodiment of a ragger 100 of the present disclosure is schematically depicted. The primary roll 110 may have a plurality of teeth 112 that may be operable to grip the tail 102 to pull the tail 102 through the ragger 100 when the primary roll 110 is rotated during operation of the ragger 100. The teeth 112 may protrude outward from the outer surface of the primary roll 100. In embodiments, the primary roll 110 may be cylindrical such that the outer surface of the primary roll 110 may be straight. Referring now to FIG. 6, in embodiments, the primary roll 110 may have an outer surface that is contoured, such as tapering towards the center axis of the primary roll 110 to form a V-shape when the primary roll 110 is viewed along a longitudinal cross-section (e.g., a cross-section taken along a vertical plane extending in the +/−Z direction from the center axis of the primary roll 110). In other words, the primary roll 110 may appear to be V-shaped when viewed from the front or rear of the ragger 100, as shown in FIG. 6. Other shapes of the primary roll 110 are contemplated. The V-shape of the primary roll 110 may improve traction between the tail 102 and the primary roll 110 during operation of the ragger 100, which may reduce the occurrence of slippage between the tail 102 and the primary roll 110.

Referring again to FIGS. 3, 4, and 5, the primary roll 110 or other puller mechanism (e.g., belt, multiple pulling rolls, etc.) may be driven by a puller drive 114. The puller drive 114 may be operatively coupled to the puller mechanism, such as the primary roll 110, through a drive train 116 that may include one or more of a gear box, torque arm, drive shaft, couplings, journals, bearings, etc. As used in the present disclosure, the term "drive train" may refer to the collection of structures and parts that operatively couple a drive to a mechanism, such as the coupling the puller drive 114 to the primary roll 110, to enable the drive to rotate the roll. The puller drive 114 may be an electric motor, hydraulic drive, or other type of drive capable of rotating the primary roll 110. For conventional raggers, the puller drive 114 may be operable to rotate the primary roll 110 at a fixed speed at specified time intervals. The frequency and duration of the time intervals of operation of the puller drive 114 may be adjusted to increase or decrease the rate at which the tail 102 is pulled from the pulper vessel 20.

Referring again to FIGS. 3-5, the rider roll 120 may be disposed vertically above (e.g., in the +Z direction of the coordinate axis in FIG. 4) the primary roll 110 and may be coupled to the rider roll arm 122. The rider roll 120 is spaced apart from the primary roll 110. The rider roll 120 may be generally parallel to the primary roll 110, such as having an axis of rotation that is parallel to an axis of rotation of the primary roll 110. The rider roll 120 may have a plurality of rider roll teeth 121, which may operate to provide traction with the tail 102 when the rider roll 122 is engaged with the tail 102. The rider roll 120 can be driven, such as being operatively coupled to a rider roll drive 126. In some embodiments, the rider roll 120 may be an idler roll that can rotate freely through contact with the tail 102 or through contact with a drive roll. As shown in FIGS. 3 and 5, in embodiments, the rider roll 120 may be cylindrical such that the outer surface of the rider roll 120 is straight in the axial direction (+/−Y direction of the coordinate axis in FIG. 5). In other words, in these embodiments, the outer surface of the rider roll 120 may be parallel to an axis of rotation of the rider roll 120. Referring now to FIG. 6, in embodiments, the rider roll 120 may have an outer surface that is contoured so that the outer surface is not parallel to the axis of rotation of the rider roll 120 along the entire length of the rider roll 120. In embodiments, the outer surface of the rider roll 120 may have a contour that is complementary to the primary roll 110. In embodiments, the rider roll 120 may be conical where the outer surface has a greatest diameter at the axial center of the rider roll 120 and the diameter of the outer surface decreases moving towards each end of the rider roll 120. Other shapes of the rider roll 120 are contemplated.

Referring again to FIGS. 3,4, and 5, the rider roll arm 122 may be coupled to the frame 130 at a pivot point that enables the rider roll arm 122 to pivot relative to the frame 130 and the primary roll 110. Pivoting of the rider roll arm 122 may operate to move the rider roll 120 closer to or farther away from the primary roll 110. The rider roll 120 and the primary roll 110 form a nip therebetween. The nip between the rider roll 120 and the primary roll 110 pulls the tail 102, and the rope 150 during start-up, out of the pulper vessel 20 during operation of the ragger 100.

The rider roll arm 122 may include a position sensor 128 positioned to measure the position of the rider roll arm 122 relative to the primary roll 110. In embodiments, the position sensor 128 may be positioned to measure a rider roll arm angle θ (FIG. 4) relative to the frame 130. The rider roll arm angle θ may be indicative of a distance between the outer surface of the rider roll 120 and the outer surface of the primary roll 110 (i.e., size of the nip between the rider roll 120 and the primary roll 110). The position sensor 128 may be operable to output an electric signal indicative of the position of the rider roll arm 120, which can be related to the distance between the rider roll 120 and the primary roll 110 (i.e., size of the nip). The position sensor 128 may be physically coupled to the rider roll arm 122, the frame 130, or both. The position sensor 128 may be any commercially available position sensor capable of determining the rider roll angle θ of the rider roll arm 122. In embodiments, the position sensor 128 may be operable to measure a linear distance between a point on the frame 130 and a point on the rider roll arm 122 and generate an electronic signal indicative of the distance or the rider roll angle θ calculated from the distance. Additionally or alternatively, the position sensor 128 may be rotary encoder coupled to the joint or shaft where the rider roll arm 122 is pivotably coupled to the frame 130. Other types of sensors operable to measure a position of the rider roll arm 122 relative to the frame 130 may be included.

The rider roll 120 may include the pressure device 124 that may be operable to pivot the rider roll arm 122 towards the primary roll 110 to exert a pressure on the tail 120 disposed between the rider roll 120 and the primary roll 110. The pressure of the rider roll 120 against the tail 102 may improve engagement of the tail 102 with the teeth 112 of the primary roll 110 or other puller mechanism to aid in pulling the tail 102 out of the pulper vessel 20. In embodiments, the pressure device 124 may be a hydraulic pressure system comprising one or more hydraulic cylinders. In embodiments, the pressure device 124 may be a pneumatic pressure system. Other types of devices for the pressure device 124 are contemplated. The pressure device 124 may include a pressure sensor 125 operable to measure a pressure of the rider roll 120 against the tail 102 and output an electronic signal indicative of the pressure of the rider roll 120 against the tail 102. The pressure sensor 125 may be any commercially-available pressure sensor capable of measuring the output pressure of the pressure device 124 or the pressure of the rider roll 120 against the primary roll 110.

Referring now to FIG. 4, the rider roll 120, the rider roll arm 122, or both may include a rotation sensor 129 operable to ascertain whether or not the rider roll 120 is rotating relative to the rider roll arm 122. The rotation sensor 129 may be coupled to the rider roll arm 122, the rider roll 120, or both. The rotation sensor 129 may be operable to produce an output signal indicative of whether the rider roll 120 is rotating or not. In embodiments, the rotation sensor 129 may be a rotary encoder. The output from the rotation sensor 129 can be combined with the operational state of the primary roll 110 to determine whether the tail 102 is slipping in the ragger 100. In particular, tail slippage may be indicated by the primary roll 110 being driven to rotate while the rotation sensor 129 indicates that the rider roll 120 is stationary and not rotating.

Referring again to FIGS. 3-5, the primary roll 110 and the rider roll arm 122 may be coupled to the frame 130 in a manner that enables the primary roll 110 to rotate relative to the frame 130 and allows the rider roll arm 122 to pivot relative to the frame 130. In embodiments, the frame 130 may be include two vertical walls, each of which is disposed on one side of the primary roll 110 and rider roll arm 122. Referring now to FIG. 6, in embodiments, the frame 130 may include a single vertical wall disposed on one side of the primary roll 110 and rider roll arm 122 and the primary roll 110 and the rider roll arm 122 may be coupled to the single vertical wall in a cantilevered configuration.

Referring again to FIG. 3, the vertical walls of the frame 130 may be coupled to a base comprising an upper base plate 132 and a lower base plate 134, both of which may be generally horizontal (e.g., parallel to the X-Y plane of the coordinate axis in FIG. 3). The lower base plate 134 may be mounted to the floor or support structure adjacent to the pulper vessel 20. The upper base plate 132 may include a plurality of curved slots 136, which may enable the upper base plate 132 to be coupled to the lower base plate 134 while being rotatable relative to the bottom base plate 134. Referring to FIG. 1, in embodiments, the ragger 100 may include a base plate actuator 180 operatively coupled to the upper base plate 132, the lower base plate 134, or both. The base plate actuator 180 may be operable to pivot the upper base plate 132 relative to the lower base plate 134 to rotate the orientation of the primary roll 110 of the ragger 100 relative to the pulper vessel 20.

Referring to FIG. 4, the ragger 100 may further include the guide arm 140 comprising the guide roll 142. The guide arm 140 may be rigidly coupled to the frame 130. Referring again to FIG. 2, the guide arm 140 may extend horizontally (e.g., in the +X direction of the coordinate axis in FIG. 2) outward from the frame 130 in the direction of the pulper vessel 20 so that at least a portion of the guide roll 142 is disposed directly over a portion of the pulper vessel 20 (i.e., a vertical line extending downward from a point on the guide roll 142 passes into the pulp slurry disposed within the pulper vessel 20). The guide roll 142 may be an idler roll that rotates freely relative to the guide arm 140. The guide roll 142 may rotate through contact with the tail 102 as the tail 102 is pulled by the primary roll 110.

The ragger 100 may include a rope 50 used for initially forming the tail 102 during start-up of the ragger 100. The rope 50 may include natural or synthetic rope. Although described herein as having the rope 50, it is understood that other types of elongated strands, such as barbed wire for example, having a surface conducive to snaring and entangling metal and plastic debris in the pulp slurry 12 to initially create the tail 102 may be employed. The rope 50 may be passed between the primary roll 110 and rider roll 120 and may extend down over the guide roll 142 and into the pulper vessel 20 during start-up.

Referring again to FIG. 2, the ragger 100 may further include a cutting station 160 disposed downstream relative to the primary roll 110 and rider roll 120. The cutting station 160 may be disposed vertically below the ragger 100 and on the side of the ragger 100 away from the pulping vessel 20. A chute 162 may be positioned between the ragger 100 and the cutting station 160 to provide a pathway for the tail 102 exiting the ragger 100 to travel from the ragger 100 downward to the cutting station 160. The cutting station 160 may be operable to periodically cut the tail 102 into a plurality of pieces.

Operation of Ragger

Referring again to FIG. 2, general operation of the ragger 100 will now be described. The pulping system 10 is operated by adding water and furnish to the pulper vessel 20. Bales 52 of recycled material, such as but not limited to paper, cardboard, or corrugated boxes, may be added to the pulper vessel 20 as part of the furnish by feed conveyor 50. The recycled material can include solid debris, such as but not limited to metal and plastic bands or wires, plastic sheet material, textiles, and/or other solid debris. While the pulper vessel 20 is operating, the rope 150 of the ragger 100 is immersed in the pulp slurry 12 in the pulper vessel 20. The rope 150 snares and collects the solid debris, such as metal and plastic bands and wires, sheet plastic, textiles, and other solid debris, which forms the tail 102 attached to the rope 150. The rope 150 extends over the guide roll 142 and through the nip between the primary roll 110 and rider roll 120 of the ragger 100. The primary roll 110 is rotated by the puller drive 114 in the forward direction to slowly pull the rope 150 out of the pulper vessel 20. As the rope 150 is pulled out of the pulper vessel 20, the rope 150 pulls the debris tail 102 out of the pulper vessel 20 as well. The tail 102 may be self-forming after the end of the tail 102, meaning that the tail 102 itself acts as the rope that collects other pieces of solid debris and continues to grow in length. At the end of the rope 150, the primary roll 110 and rider roll 120 engage directly with the tail 102 and continue to pull the tail 102 slowly out of the pulper vessel 20. The rider roll 120, as actuated by the pressure device 124, exerts a downward pressure on the tail 102 to provide additional traction between the primary roll 110 and the rope 150, tail 102, or both.

The puller drive 114 may be operated on a timed basis as previously discussed or may be a variable speed drive capable of continuously rotating the primary roll 110 to gradually withdraw the tail 102 from the pulper vessel 20 at a rate that allows the tail 102 to continue to form in the pulper vessel 20 as it is withdrawn. Thus, the tail 102 continuously grows in length by picking up more solid debris from the pulp slurry 12 as the tail 102 is slowly withdrawn from the pulper vessel 20. The thickness, density, and length of the tail 102 may depend on the speed at which the tail 102 is withdrawn from the pulper vessel 20, the production rate of the pulping system 10, the ratio of the recycled furnish to total furnish introduced to the pulper vessel 20, the level of solid debris and contaminants in the recycled furnish, or combinations of these. The amount and type of solid debris in the recycled furnish may also change with time, which can influence the thickness, density, and length of the tail 102. In particular, the source of the recycled furnish may change, resulting in changes to types of banding used to secure the bales 52 and different other types and quantities of solid debris in the bales 52.

The tail 102 leaves the nip between the primary roll 110 and rider roll 120 and passes downward through the chute 162 to the cutting station 160, where the tail 102 is then cut periodically into pieces for disposal.

Operation of conventional ragger machines can involve a high degree of operator involvement to maintain operation continuity. Operability of ragger machines is very dependent on the nature of the furnish introduced to the pulper vessel 20, which can change over time. In particular, the bales 52 of furnish dumped into the pulper vessel 20 can have different amounts of debris. Additionally, the ragger machines can be sensitive to the production rate of the pulping system 10. The production rate can influence the rate at which the tail 102 grows. Ragger machines can also be sensitive to fluid level in the pulper vessel 20 and/or the consistency of the pulp slurry 12 in the pulper vessel 20. The fluid level and consistency of the pulp slurry 12 can change the flow conditions in the pulper vessel 20, such as by changing the turbulence of the fluid agitation in the pulper vessel 20, which can change the forces acting on the portion of the tail 102 submerged in the pulp slurry 12. Additionally, the fluid level and consistency may also influence how much support the pulp slurry 12 provides to the tail 102. Reductions in the fluid level and/or consistency may reduce the amount of support for the tail 102, which may increase the risk of breakage of the tail and increases in the fluid level and/or the consistency may increase the amount of support for the tail 102. Operation of the ragger machines under fixed speed and according to a timed periodic pull provides for inconsistent operation when challenged with constantly changing furnish and operating conditions of the pulping system 10.

As a result of these changing conditions, operation of the conventional ragger machines needs to be constantly checked by the operators every 10-15 minutes to ensure proper operation. Skilled operators change pull and wait timers on the ragger machine frequently to maintain ragger tail size and keep the machine running. Despite constant checking, ragger machines can still require greater than 3-4 manual interventions by operators each day, each requiring 1 to 2 hours or more of pulping system downtime each to remediate and restore the ragger machine to operation. These operational problems requiring manual interventions can introduce significant amounts or pulping system downtime. Control systems have still not been developed to provide adequate control for these conventional ragger machines and operation of ragger machines remains highly manual in nature.

Referring to FIG. 2, one disadvantage of operation of a conventional ragger machine is that the rope 150 and/or tail 102 often may not have enough traction with the primary roll 110 and can slip in engagement with the primary roll 110. Slippage of the rope 150 and/or tail 102 may cause the rope 150 and/or tail 102 to not be pulled when the primary roll 110 is rotated. This may in turn cause the tail 102 to remain for a longer period of time in the pulp slurry 12 which causes the tail 102 to increase in length and/or thickness. To counter slippage, the rider roll 120 may often be operated at very high pressure to increase the traction between the tail 102 and the primary roll 110. However, the increased pressure of the rider roll 120 can deform or collapse the tail 102, which can greatly increase the friction between the tail 102 and the ragger 100. This can result in interference with the passage of the tail 102 through the ragger 100. Under certain circumstances, the increased pressure of the rider roll 120 can even cause breakage of the tail 102, resulting in pulper downtime and reduced efficiency of the pulping process.

Another disadvantage with conventional ragger machines is that the fixed pull rate of the primary roll 110 may not be in tune with the quantity and nature of solid debris and contaminants in the pulper vessel 20 or with operating conditions of the pulping process, such as overall pulp production rate. The conventional ragger installations generally are not able to respond to constant changes in operating conditions of the pulping process, such as but not limited to pulp production rate, proportion of recycled furnish added to the pulp slurry 12, and/or the amount or nature of the solid debris and/or contaminants in the pulper vessel 20. The result is that the tail 102 can become too large or too small. The tail 102 can get too large (e.g., thickness or weight is too great) when the tail 102 is not being pulled fast enough to account for increases in level of solid debris and/or contaminants, or production rate of the pulp slurry 12. When the tail 102 gets to large, the size of the tail 102 may cause problems getting through the ragger 100, such as clogging, which can disrupt operation of the ragger 100 and pulping process. If the tail 102 gets too large and clogs the ragger 100, an operator must somehow get a strap around the tail 102 (between the ragger 100 and the pulper stock level) and use a crane to drag the tail 102 over the lip of the pulper vessel 20 and to the operating floor. Once on the floor, the tail 102 must be cut into manageable pieces and those pieces moved to the reject bin.

Additionally, increasing size of the tail 102 can increase the drag exerted on the tail 102 by the pulp slurry 12 in the pulper vessel 20. In particular, as the diameter of the tail 102 increases, regardless of the density, the fluid drag on the tail 102 in the pulper vessel 20 also increases. The same is true with the length of the tail 102. As the length of the tail 102 increases, the drag on the tail 102 caused by the pulp slurry 12 in the pulper vessel 20 also increases. Drag on the tail 102 can exert forces on the tail 102 that can increase the risk of breaking the tail 102.

The tail 102 can become too thin when the level of debris/contaminants or pulp production rate drops and the tail 102 is withdrawn at a rate too fast to allow the thickness of the tail 102 to build. When the tail 102 gets too thin, the tail 102 can break and fall back down into the pulper vessel 20.

Referring again to FIG. 2, breakage of the tail 102 is a serious problem with operation of conventional ragger installations and can result in adverse impacts on continuity of operation of the pulping system 10. When the tail 102 breaks, the pulping system 10 must be shut down and the rotor 22 in the pulper vessel 20 is stopped to remove the energy from the system. The pulper vessel 120 remains full of pulp slurry 12 to save time. While the ragger 100 and pulping system 10 are shut down, the downstream paper recycling plant may also be shut down. Therefore, breakage of the tail 102 can result in complete shutdown of the entire paper recycling plant.

Before the pulping process can be resumed, the broken tail 102 must be removed from the ragger 100 and/or the pulper vessel 20. If the tail 102 has broken and fallen back into the pulper vessel 20, then the operator must attach a grapple to an overhead crane and 'fish' for the tail 102 in the pulp slurry 12 contained in the pulper vessel 20. Once caught, the tail 102 must be lifted and dragged over the lip of the pulper vessel 20 to the operating floor. Once on the floor, the tail 102 must be cut into manageable pieces and those pieces moved to the reject bin. Frequently, whatever is left of the tail 102 in the ragger 100 may be too short to be used to start again, so the operator must install a new starter rope 150 through the ragger 100 and into the pulper vessel 20. The ropes 150 are heavy and awkward to handle. The initial formation of the tail 102 is the most difficult and labor intensive part of operation of the ragger 100. Thus, reducing the number of times the ragger 100 must be started up can greatly improve uptime and labor utilization of the pulping system 10.

Manual interaction and handling of the tail 102 is a practice to be avoided. The tail 102 may generally be composed of metal wires mixed with plastics, textiles, sand, grit, etc. and is non-uniform and awkward to handle. The fewer demands on the operators to be servicing the ragger 100 equipment the better from an efficiency standpoint.

Ragger System

The ragger 100 and ragger systems of the present disclosure solve these problems associated with operation of conventional ragger machines. In particular, the raggers 100 of the present disclosure can reduce slippage of the tail 102 relative to the primary roll 110 by modifying the ragger 100 to include a rider roll drive 126 operatively coupled to the rider roll 120, increasing the size of the rider roll teeth 121 on the rider roll 120, and installing a VSD for the puller drive 114. Additionally, the present disclosure includes ragger systems comprising the ragger 100, one or a plurality of measurement devices/sensors, and a control system, where the ragger systems may be operable to adjust the operating parameters of the ragger 100 in response to one or more characteristics of the tail 102 or operating conditions of the pulping system 10. In particular, the ragger systems of the present disclosure may be operable to measure one or more input variables indicative of a weight, size, thickness, length, density, position, and/or metal content of the tail 102 and adjust operation of the ragger 100 based on the measured input variables. The ragger systems disclosed herein may also be operable to adjust operation of the ragger 100 in response to one or more operating conditions of the pulping system 10, such as but not limited to throughput rate of the pulp slurry 12, proportion of recycled furnish added to the pulper vessel 20, level of solid debris or contaminants in the recycled furnish, fluid level and/or consistency of the pulp slurry 12 in the pulper vessel 20, temperature of the pulp slurry 12, or other operating parameter of the pulping system 10. Adjusting operation of the ragger 100, such as but not limited to adjusting the rate of withdrawal (e.g., pulling rate) of the tail 102, the direction of rotation of the primary roll 110, rotational position of the ragger 100 relative to the pulper vessel 20, the pressure of the rider roll 120, the torque of the rider roll 120, or combinations thereof in response to characteristics of the tail 102 and/or operating parameters of the pulping system 10 may reduce or prevent breakage of the tail 102 during start-up and operation of the ragger 100. Reducing or preventing breakage of the tail 102 may improve uptime and efficiency of the pulping process.

Referring again to FIGS. 3-5, as previously discussed, the raggers 100 of the present disclosure may include a rider roll drive 126 operatively coupled to the rider roll 120, larger rider roll teeth 121 on the rider roll 120, and/or a VSD for the puller drive 114. These modifications to the ragger 100 of the present disclosure may reduce slippage of the tail 102 in the ragger 100 without increasing the pressure of the pressure device 124 to a pressure that substantially deforms or crushes the tail 102. The ragger 100 can, therefore, be operated at a reduced pressure compared to conventional ragger machines. The reduced pressure may reduce friction between the tail 102 and the primary roll 110 and rider roll 120 to enable the tail 102 to pass more readily through the nip between the primary roll 110 and the rider roll 120.

The rider roll 120 can include the rider roll drive 126 operatively coupled to the rider roll 120. The rider roll drive 126 may be a fixed speed drive or a variable speed drive. The rider roll drive 126 may be an electric drive, a hydraulic drive, or other type of drive operable to rotate the rider roll 120. The rider roll drive 126 may be operable to rotate the rider roll 120 in a direction of rotation opposite the direction of rotation of the primary roll 110 in order to work in concert with the primary roll 110 to pull the tail 102 through the nip therebetween. The rider roll drive 126 is separate and distinct from the puller drive 114 and can be configured to drive the rider roll 120 independent of the primary roll 110. In embodiments, the rider roll drive 126 may be synchronized with the puller drive 114 so that the speed of the rider roll 120 mirrors the speed of the primary roll 110. Driving the rider roll 120 with the rider roll drive 126 may increase the pulling force exerted on the tail 102 by the ragger 100. In embodiments, driving the rider roll 120 with the rider roll drive 126 may double the pulling forces exerted on the tail 102 by the ragger 100. Operation of the rider roll drive 126 to rotate the rider roll 120 may work to reduce or prevent slippage of the tail 102 in the nip during operation of the ragger 100.

When the rider roll drive 126 is independent of the puller drive 114, the rider roll drive 126 can be used as a controlled variable to control operation of the ragger in response to changing attributes of the tail 102 or changing operating conditions of the pulping system 10. In embodiments, the rider roll drive 126 can be operated to increase or decrease the torque on the rider roll 120, the rotational speed of the rider roll 120, or both in response to changing attributes of the tail, changing operating conditions of the ragger 100, changing operating conditions of the pulping system 10, or combinations of these.

The puller drive 114 may be a variable speed drive (VSD) in the raggers 100 of the present disclosure. When the puller drive 114 is a VSD, the puller drive 114 may be operable to continuously rotate the primary roll 110, which may be rotated at slower speeds. The VSD may be continuously adjusted to adjust the rotational speed of the primary roll 110 during operation of the ragger 100. When the puller drive 114 is a VSD, the rate at which the tail 102 is pulled from the pulper vessel 20 may be determined by the speed of the VSD. The puller drive 114 that is a VSD may reduce slippage of the tail 102 relative to the primary roll 110 during operation of the ragger 100 by reducing or eliminating the starts and stops of rotation of the primary roll 110 associated with periodic timed operation of the ragger 100. The starts and stops resulting from step drive operation of the primary roll 110 may cause slippage of the tail 102 when transitioning the primary roll 110 from the stopped state to the rotating state using a fixed speed motor for the puller drive 110. The starts and stops resulting from operation of a fixed speed drive can also cause tension on the tail 102 that may result in breakage of the tail 102. Thus, installing a VSD as the puller drive 114 may also help to reduce the occurrence of tail breakage by reducing or eliminating starts and stops to pulling the tail 102 from the pulper vessel 20.

Ragger Control System

In addition to adding the rider roll drive 126, increasing the size of the rider roll teeth 121, and installing a VSD as the puller drive 114, the present disclosure is further directed to a ragger system comprising the ragger 100 and a control system operable to adjust the operating parameters of the ragger 100 in response to changes in operating conditions in the pulping system 10 and/or measured attributes of tail 102, which may reduce or prevent downtime of the ragger 100 and pulping system 10 caused by excessive tail size or a broken tail. Referring now to FIG. 7, one embodiment of the ragger system 200 of the present disclosure is schematically depicted. The ragger system 200 may include the ragger 100, one or a plurality of measurement devices (e.g., torque measurement devices 210, rider roll torque measurement device 212, position sensor 128, rotation sensor 129, vibration sensors, load cells, optical measurement devices, cameras, capacitance sensors, level sensors, motor speed sensors, ammeters, pressure sensors, consistency sensors, temperature sensors, conveyor speed sensors, etc.), and a control system 202 communicatively coupled to the ragger 100 and the measurement devices. The ragger 100 may have any of the features previously discussed for ragger 100. The measurement devices may include one or more sensors, such as but not limited to the position sensor 128 on the rider roll arm 122, the rotation sensor 129 on the rider roll arm 122, the pressure sensor 125 on the pressure device 124, pressure sensor on the cutter 160, a torque measurement device 210 for the puller mechanism, a rider roll torque measurement device 212, ammeter for measuring electric current on various drives and motors, motor speed sensors (e.g., rider roll drive 126, puller drive 114, pulper drive motor, etc.), load cells, capacitance sensors, vibration sensors, optical sensors or cameras, level sensors on the pulper vessel 20, consistency sensors, a speed sensor on the feed conveyor, flow meters, temperature sensors, other sensors associated with the pulping system 10 or ragger 100, or combinations of sensors. The control system 202 may be communicatively coupled to any combination of one or more of the measurement devices.

The control system 202 may include at least one processor 204, at least one memory module 206 communicatively coupled to the processor 204, and machine readable and executable instructions 208 stored on the memory module(s) 206. The machine readable and executable instructions 208, when executed by the processor 204, may cause the ragger system 100 to automatically execute any of the method steps described herein. The control system 202 may be communicatively coupled to the ragger 100 by being communicatively coupled to one or more of the puller drive 114, the rider roll drive 126, the pressure device 124, the base plate actuator 180 (FIG. 12), or combinations of these.

Referring again to FIG. 7, the ragger system 200 may be operable to adjust one or more operating parameters of the ragger 100, such as but not limited to the rate of withdrawal of the tail 102 from the pulper vessel 20, the direction of the puller drive 114, the pressure of the pressure device 124 biasing the rider roll 120 against the tail 102, the torque on the rider roll 120, the speed of the rider roll 120, the rotational position of the ragger 100 relative to the pulper vessel 20, or combinations thereof in response to changing conditions in the pulping system 10 and/or changing attributes of the tail 102. For raggers 110 having a variable speed drive for the puller drive 114, the withdrawal rate of the tail 102 from the pulper vessel 20 may be controlled by adjusting the rotational speed of the puller drive 114. For raggers 110 having a fixed speed puller drive 114, the withdrawal rate of the tail 102 can be adjusted by adjusting the on-off timing of the puller drive 114. In particular, the ragger system 200 may be operable to receive one or more input signals from the one or more measurement devices indicative of a condition of the pulping system 10, condition or attribute of the tail 102, or both and adjust a speed of the puller drive 114, an on-off timing of the puller drive 114, a speed of the rider roll drive 126, a pressure of the pressure device 124, a direction of rotation of the primary roll 110 and/or rider roll 120, a rotational position of the ragger 100 relative to the pulper vessel 20, or combinations of these based on the input signals received. The pressure of the rider roll 120 against the tail 102 can be adjusted by increasing or decreasing the pressure of the pressure device 124 operatively coupled to the rider roll arm. The torque on the rider roll 120 and/or the speed of the rider roll 120 can be adjusted by changing the operating parameters of the rider roll drive 126, such as by changing the speed of the rider roll drive 126.

The input signals received may be indicative of a size of the tail 102, a density of the tail 102, a weight of the tail 102, a length of the tail 102, a metal content of the tail 102, a position of the tail 102, drag on the tail 102, a production rate of the pulping system 10, a proportion of recycled furnish introduced to the pulping system 10, a level of solid debris in the recycled furnish, a consistency of the pulp slurry 12, a fluid level of the pulp slurry 12 in the pulper vessel 20, a temperature of the pulp slurry 12, other parameter, or combinations of these. The attributes of the tail 102, such as density, thickness, weight, length, and metal content, may be relative attributes that are relative to a reference tail and may not be true values of these attributes. The reference tail may be an average tail (e.g., a tail 102 having average thickness, weight, density, length, and metal content) or an ideal tail, which is a tail having a thickness, length, weight, density, and metal content that causes the ragger 100 to run steadily at its optimal efficiency without clogging or tail breakage. In some embodiments, the attributes of the tail 102 may be true values of the attributes, such as a true measured value of the thickness or thickness profile or a true measured value of the length.

The ragger systems 200 of the present disclosure may be capable of monitoring the changing conditions in the pulping system 10, the changing properties of the tail 102, or both and adjusting one or more operating parameters of the ragger 100 in response to changing conditions in the pulping system 10 and/or tail 102. This automatic control of the ragger 100 may reduce or prevent downtime caused by the tail 102 growing too large and clogging the ragger or growing too small and breaking. Thus, automatic control of the ragger 100 by the ragger system 200, may reduce the amount of attention operators must spend on checking, operating, and restarting the ragger 100.

The measurement devices may include but are not limited to one or more torque measuring devices 210 operable to measure the torque exerted by the tail 102 on the puller mechanism (e.g., primary roll 110); one or more rider roll torque measurement devices 212 on the rider roll 120 or rider roll drive 126, one or more vibration sensors operable to measure a frequency of the back and forth sway of the tail 102 relative to the ragger 100; one or more load cells operable to measure a relative weight of the tail 102; one or more motor speed sensors; one or more ammeters; the position sensor 128; the rotation sensor 129; the pressure sensor 125; one or more optical sensors or cameras operable to measure a size, thickness, length, and/or position of the tail 102; a capacitance sensor operable to measure the electrical capacitance of the tail 102; a cutter pressure sensor on the hydraulic system for the cutter 160; a blade position sensor for the cutter 160; a flow meter operable to measure a production rate of the pulp slurry from the pulping system 10; one or more consistency sensors; one or more level sensors coupled to the pulper vessel 20; one or more temperature sensors in the pulper vessel 20; a conveyor speed sensor operable to measure a rate at which recycled furnish is supplied to the pulper vessel 20; a rotor torque sensor operable to measure torque on the rotor of the pulper vessel 20; other measuring device; or combinations of these. Each of the measurement devices and control strategies will be described in further detail herein. Each type of measurement device and control strategy is discussed individually for purposes of clarity. However, it is understood that any of the measurement devices and control strategies may be combined with any of the other measurement devices and control strategies to control the ragger system 200 in response to changes in operation of the pulping system 10. Additionally, any of the control strategies disclosed herein can be implemented through the control system using machine readable and executable instructions stored on a memory module of the control system and executed by the processor of the control system.

Drive Torque

Referring again to FIG. 7, the ragger system 200 may be operable to measure the torque on the puller drive 114, which may be indicative of the relative size of the tail 102 being pulled from the pulper vessel 20 by the ragger 100. The torque on the puller drive 114 may also include a contribution from drag exerted by the pulp slurry 12 on the portion of the tail 102 submerged in the pulp slurry 12. Greater torque on the primary roll 110 and/or puller drive 114 may indicate a larger tail 102, which may have a greater relative weight per unit length, greater overall length, greater amount of drag with the pulp slurry, or combinations of these. Lesser torque may indicate a tail 102 that has a lighter relative weight per unit length, a shorter overall length, less drag with the pulp slurry, or combinations of these. The pull rate of the ragger 100 may be increased with increasing size of the tail 102 and decreased for decreasing size of the tail 102.

The ragger system 200 may include one or a plurality of torque measurement devices 210 operable to measure the torque on the puller mechanism (e.g., primary roll 110, belt, pulling rolls, or other puller mechanism), the puller drive 114, the drive train 116 for the puller mechanism, or combinations of these. The torque measurement devices 210 may include strain gauges coupled to the drive train 116 of the primary roll 110, the output from the puller drive 114, an ammeter coupled to the puller drive 114 to measure the electric current drawn by the puller drive 114, or combinations of these. Other types of torque measurement devices 210 are contemplated. When the torque measurement devices 210 include strain gauges, the strain gauges may be coupled anywhere along the drive train 116, such as coupled to the journals of the primary roll 110, the drive shaft for the primary roll 110, the torque arm 115 of the puller drive 114, and/or other point on the drive train 116. In embodiments, the torque measurement device 210 can be coupled to the primary roll 110 or the drive shaft of the primary roll 110 to directly measure the torque. Coupling the torque measurement device 210 to the primary roll 110 or the drive shaft of the primary roll 110 may produce greater accuracy in the torque measurement compared to measuring torque at the puller drive 114, in particular with systems having a high gear ratio. Without intending to be bound by any particular theory, it is believed that the measurement of the torque at the puller drive 114 introduces error in torque measurement due to the complex system of forces translated through the drive train 116 and gear box to the motor of the puller drive 114.

If the puller drive 114 is an electric drive, the torque measurement device 210 may also include an ammeter operable to measure the electrical current load on the puller drive 114 in combination with a motor speed sensor for measuring the rotational speed of the motor. The speed and amperage can be combined to determine the torque on the puller drive 114. As the size of the tail 102 increases, the torque on the primary roll 110 may increase due to greater weight of the tail 102, greater drag on the portion of the tail 102 in the pulp slurry 12, or both. The increase in torque results in greater current demand from the puller drive 114 to maintain rotation of the primary roll 110 at a given rotational speed. Thus, measuring the rotational speed and the current drawn by the puller drive 114 may be indicative of the torque on the puller drive 114, which can be correlated to a relative size of the tail 102. In embodiments, the puller drive 114 may also be a hydraulic drive and the torque measurement device 210 may be a device operable to measure one or more operation conditions, such as but not limited to hydraulic pressure, speed, etc., of the hydraulic drive to determine the torque.

Referring again to FIG. 7, the torque measurement device 210 may be communicatively coupled to the control system 202. The torque measurement device 210 may be operable to measure or determine the torque exerted on the primary roll 110, the puller drive 114, or both and to transmit a torque signal, which is an electronic signal indicative of the measured torque, to the control system 202. The control system 202 may receive the torque signal from the torque measurement device 210 and adjust a pulling rate of the ragger 100, a direction of rotation of the primary roll 110, a pressure of the pressure device 124, the torque or speed of the rider roll drive 120, or combinations of these based on the electronic signal indicative of the measured torque. As previously discussed, the control system 202 may increase the pulling rate of the ragger 100 in response to an increase in the measured torque on the primary roll 110, which may indicate a greater size and weight of the tail 102 and/or greater drag on the tail 102. Increasing the pulling rate of the ragger 100 when the tail 102 is greater in size may help to reduce or prevent occurrences of the tail 102 growing too large to fit through the ragger 100. Conversely, the control system 202 may reduce the pulling rate of the ragger 100 in response to a decrease in the torque exerted on the primary roll 110, which may indicate a lesser size and/or weight of the tail 102, less drag on the tail 102, or both. A lesser size tail 102 may be more susceptible to breaking. Therefore, the pulling rate of the ragger 100 may be reduced to allow the tail 102 to thicken and strengthen to reduce or prevent the probability of the tail 102 breaking.

In response to a reduced size of the tail 102, the control system 202 may cause the ragger 100 to reverse direction to push the tail 102 back into the pulp slurry 12, which may cause the tail 102 to grow in size and/or thickness. The control system 202 may also increase or decrease the pressure of the pressure device 124 in response to the torque signal received from the torque measurement device 210. The control system 202 can also be configured to adjust the torque on the rider roll 120, the speed of the rider roll 120, or both in response to changing attributes of the tail. When the control system 202 indicates thickening of the tail or predicts thickening of the tail from operating conditions of the pulping system 10, the control system 202 may adjust the rider roll drive 126 to adjust the torque on the rider roll 120. Increasing the torque on the rider roll 120 or the speed of the rider roll 120 can increase the pulling force of the ragger 100. Conversely, when the control system 202 identifies thinning of the tail 102 or predicts thinning of the tail 102 from the operating conditions of the pulping system 10, the control system 202 can reduce the torque on the rider roll 120 or the speed of the rider roll 120 to reduce the pulling force on the tail 102 to avoid breakage.

Changes in torque on the primary roll 110 or puller drive 114 may also result from changing processing conditions in the pulper vessel 20, such as changing consistency or fluid level of the pulp slurry 12 or greater turbulence in the pulper vessel 20. In embodiments, the control system 202 may combine the torque signal(s) from the torque measurement devices 210 with one or more operating conditions from the pulping system 10 (e.g., pulp consistency, feed rate of recycled furnish, load on the motor 24 coupled to the rotor 22, fluid level in the pulper vessel 20, production rate of the pulping system 10, etc.) to account for the influence of flow conditions in the pulper vessel 20 on the measured torque indicated by the torque signal.

The control system 202 may also be operable to receive the torque signal from the torque measurement device 210 and identify a slippage condition of the tail 102. As previously discussed, slippage of the tail 102 refers to a condition in which the primary roll 110 rotates but the tail does not move through the ragger 100. Instead, the tail 102 slips against primary roll 110 and is not pulled through the ragger 100 by the primary roll 110. Very low torque measured by the torque measurement device 210 may be indicative of slippage of the tail 102 in the ragger 100. When the electronic signal indicative of torque produced by the torque measurement device 210 indicates a very low torque suggestive of a potential slippage condition, the control system 202 may generate a slippage alarm signal and output the slippage alarm signal to one or more output devices, such as an operator display or visual or auditory alarm indicator. Additionally or alternatively, in response to an electronic signal from the torque measurement device 210 indicative of a very low torque, the control system 202 may generate and send a pressure control signal to the pressure device 124, which may cause the pressure device 124 to increase the pressure of the rider roll 120 against the tail 102 to reduce or eliminate the slippage condition. The control system 202 may also adjust the rotational speed of the puller drive 110, reverse the direction of the puller drive 110, adjust the torque or speed of the rider roll 120, or other corrective action to remediate the slippage condition. In embodiments, the control system 202 may be operable to reduce the torque of the rider roll 120 by adjusting the rider roll drive 126 in response to identification of a slippage condition. Reducing the torque or speed of the rider roll 120 may assist in reestablishing grip of the primary roll 110, rider roll 120, or both on the tail 102.

Very low torque measured by the torque measurement device 210 may also be indicative of breakage of the tail 102. The control system 202 may be operable to determine a broken tail condition of the ragger 100 from the electronic signal indicative of torque produced by the torque measurement device 210. The control system 202 may be further operable to generate a broken tail alarm signal, which may be output to one or more output devices, such as an operator display or visual or auditory alarm indicator. The control system 202 may take other actions in response to the broken tail alarm signal, such as but not limited to stopping the puller drive 114 and/or the rider roll drive 126, reducing the pressure of the pressure device 124, reducing the torque or speed of the rider roll 120, changing one or more operating conditions of the pulping system 10, or other action.

Referring again to FIG. 7, in embodiments, the ragger system 200 can also include a rider roll torque measurement device 212 on the rider roll drive 126. The rider roll torque measurement device 212 for the rider roll drive 126 may be any of the devices previously described for the torque measurement device 210 for the primary roll 110, such as but not limited to any combination of strain gauges, ammeters, motor speed sensors, or other torque measurement devices. The rider roll torque measurement device 212 for the rider roll 120 or rider roll drive 126 may be configured to measure the torque on the rider roll 120 or rider roll drive 126 and produce a rider roll torque signal indicative of the torque on the rider roll 120 or rider roll drive 126. The rider roll torque measurement device 210 for the rider roll 120 may be communicatively coupled to the control system 202 to pass the rider roll torque signal to the control system 202.

Measurement of the torque on the rider roll drive 126 may be utilized to determine a slippage condition of the tail 102. Very low torque on the rider roll drive 126, as measured by the rider roll torque measurement device 212, may be indicative of slippage of the tail 102 in the ragger 100. When the rider roll torque signal indicates a very low torque suggestive of a potential slippage condition, the control system 202 may generate a slippage alarm signal and output the slippage alarm signal to one or more output devices, such as an operator display or visual or auditory alarm indicator. Additionally or alternatively, in response to the rider roll torque signal from the rider roll torque measurement device 212 indicative of a very low torque, the control system 202 may generate and send a pressure control signal to the pressure device 124, which may cause the pressure device 124 to increase the pressure of the rider roll 120 against the tail 102 to reduce or eliminate the slippage condition.

Additionally or alternatively, in response to very low torque on the rider roll 120 indicative of a slippage condition, the control system 202 can be configured to adjust torque applied by the rider roll drive 126 on the rider roll 120, such as by changing the speed of the rider roll drive 126. In embodiments, when the rider roll torque measurement device 212 indicates a slippage condition, the control system 202 may control the rider roll drive 126 to reduce the torque on the rider roll 120, the speed of the rider roll 120, or both. Reducing the torque or speed of the rider roll 120 may facilitate regaining traction of the primary roll 110, rider roll 120, or both on the tail 102 to remediate the slippage condition. The control system 202 may also adjust the rotational speed of the puller drive 110, reverse the direction of the puller drive 110, increase the pressure of the pressure device 124, or other corrective action to remediate the slippage condition. Additionally, the measured torque on the rider roll 120 can be used to identify a broken tail condition, and the control system 202 can produce a broken tail alarm or adjust operation of the ragger 100 as previous discussed.

Vibration and Tail Sway

Figure 8:
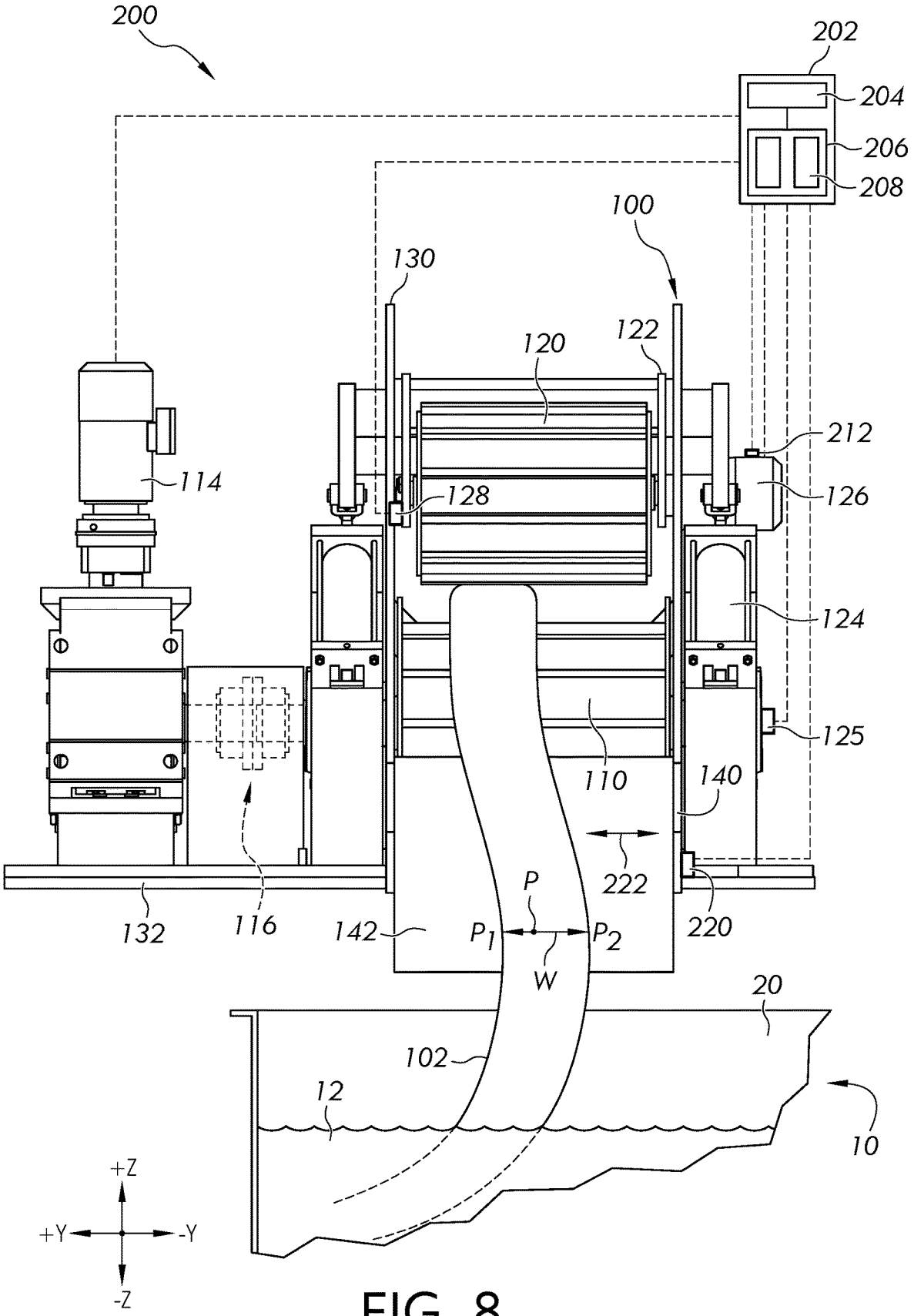
FIG. 8 schematically depicts a rear view of another embodiment of a ragger system, according to one or more embodiments shown and described herein.

Referring now to FIG. 8, during operation of the ragger 100 to pull the tail 102 of debris from the pulper vessel 20, the tail 102 may sway laterally (i.e., in the +/−Y direction of the coordinate axis in FIG. 8) back and forth in the pulper vessel 20 as it is pulled out by the ragger 100. In FIG. 8, the back and forth sway of the tail 102 is indicated by the double sided arrow 222. The swaying of the tail 102 laterally back and forth may be caused by the agitation forces in the pulper vessel 20 acting on the tail 102 as it is being pulled out. The back and forth sway of the tail 102 may be characterized by an oscillation frequency and magnitude, which may both depend on the size and/or weight of the tail 102, the production rate of the pulping process 10, the consistency of the pulp slurry 12, the fluid level of pulp slurry 12 in the pulper vessel 20, and the level of trash and debris in the pulper vessel 20. Regarding the size and/or weight of the tail 102, larger tails 102 have been found to sway at a lesser frequency compared to lighter tails 102. With respect to production rate of the pulping system 10, when the pulping system 10 is operating at a greater production rate, the pulp slurry 12 in the pulper vessel 20 may have a greater consistency (i.e., greater amount of solid fibers) and greater thickness (i.e., greater viscosity). The greater consistency and thickness of the pulp slurry 12 at the greater production rate will also cause the frequency of the back and forth sway of the tail 102 to be less. Likewise, at lesser production rates, the pulp slurry 12 has a lesser consistency and is thinner, which exerts less resistance against movement of the tail 102, resulting in a greater frequency of oscillation in the back and forth sway of the tail 102. Therefore, the frequency of the back and forth sway of the tail 102 can be used as an input variable to the control system 202 to control the pulling rate, direction of rotation of the primary roll 110, pressure of the pressure device 124, torque on the rider roll 120, speed of the rider roll 120, or combinations of these. The magnitude of the back and forth sway of the tail 102 may depend on the degree of turbulence in the pulper vessel 102, which can depend on the fluid level and consistency of the pulp slurry 12 in the pulper vessel 102. In particular, the energy level and turbulence in the pulper vessel 20 increase as the fluid level in the pulper vessel 20 decreases.

The frequency of oscillation of the tail 102 may be determined by measuring the vibrations experienced by the ragger system 200 and filtering out background vibrations attributable to the pulper vessel 20 and rotor 22, the puller drive 100, the rider roll drive 126, and other background noise. Referring to FIG. 8, in embodiments, the ragger system 220 may include one or more vibration sensors 220 coupled to the ragger 100. The vibration sensors 220 may include but are not limited to one or more of a piezoelectric accelerometer, strain gauge, capacitive displacement sensor, or other type of vibration sensor. The vibration sensors 220 may be coupled to the guide arm 140, the guide roll 142, the frame 130, the base plate 132, the primary roll 110, the drive train 116 for the primary roll 110, the rider roll 120, the rider roll arm 122, or combinations of these. In embodiments, the vibration sensors 220 may be attached to the guide arm 140 and/or the guide roll 142.

The vibration sensor(s) 220 may be operable to measure vibrations experienced by the ragger 100. The vibration sensor(s) 220 may be communicatively coupled to the control system 202 and may be operable to transmit a vibration signal to the control system 202, where the vibration signal is an electronic signal indicative of the vibrations experienced by the ragger 100. The control system 202 may receive the vibration signal from the vibration sensor(s), process the vibration signal from the vibration sensor(s) 220 to determine an oscillation frequency of the tail 102, and adjust the withdrawal rate of the tail 102, the direction of rotation of the primary roll 110, the pressure of the pressure device 124, the torque and/or speed of the rider roll 120, the rotational position of the ragger 100 relative to the pulper vessel 20, or combinations of these based on the determination of the oscillation frequency of the tail 102. The control system 202 may filter background vibrations out of the vibration signal received from the vibration sensor(s) 220. The control system 202 may increase the pulling rate, the pressure of the ragger 100, the torque and/or speed of the rider roll 120, or combinations of these in response to a decrease in the oscillation frequency of the tail. Conversely, the control system 202 may decrease the pulling rate, the pressure of the ragger 100, or the torque and/or speed of the rider roll 120, in response to an increase in the oscillation frequency of the tail 102. The direction of rotation of the primary roll 110 and rotational position of the ragger 100 relative to the pulper vessel 20 may also be modified in response the frequency and/or magnitude of oscillation of the tail 102 (e.g., tail sway). When adjusting the withdrawal rate of the ragger 100, the direction of rotation of the primary roll 110, the pressure of the pressure device 124, the torque and/or speed the rider roll 120, or combinations of these, the adjustments can be modified based on the operating conditions of the pulping system 10, such as the consistency of the pulp slurry 12, the temperature of the pulp slurry 12, the fluid level in the pulper vessel 20, the percentage of recycle furnish in the pulp slurry 12, other operating parameter of the pulping system 10, or combinations of these.

Oscillation frequency of the tail may also be determined from the electronic signals produced by other measurement devices, such as but not limited to the torque measurement devices 210 described in relation to FIG. 7, the load cells 230 which will be described subsequently in relation to FIG. 9, the optical measurement devices 240 described subsequently in relation to FIG. 10, or combinations of these. In embodiments, the ragger system 200 may include the torque measurement devices 210, such as strain gauges, coupled to the primary roll 110, puller drive 114, or drive train for the primary roll 110. The torque measurement devices 210 may also be operable to generate a vibration signal (i.e., an electronic signal indicative of the vibrations measured by the torque measurement device 210) and transmit the vibration signal to the control system. Additionally or alternatively, changes in the output from load cells 230 disposed between the base plate 132 and the operating floor or on the journal bearings of the primary roll 110 may also be able to be processed by the control system 202 to determine the oscillation frequency of the tail 102. The oscillation frequency of the tail 102 may also be measured using position sensors or optical sensors to measure the physical displacement of the tail 102 caused by the back and forth sway instead of measuring the vibrations that result from the physical swaying of the tail 102. Position sensors, optical sensors, or cameras may also be used to measure the magnitude of the tail sway, which may be used to adjust the operation of the ragger 100 or adjust the fluid level and/or consistency of the pulp slurry 12 in the pulper vessel 20.

Load Cell and Tail Size

Figure 9:
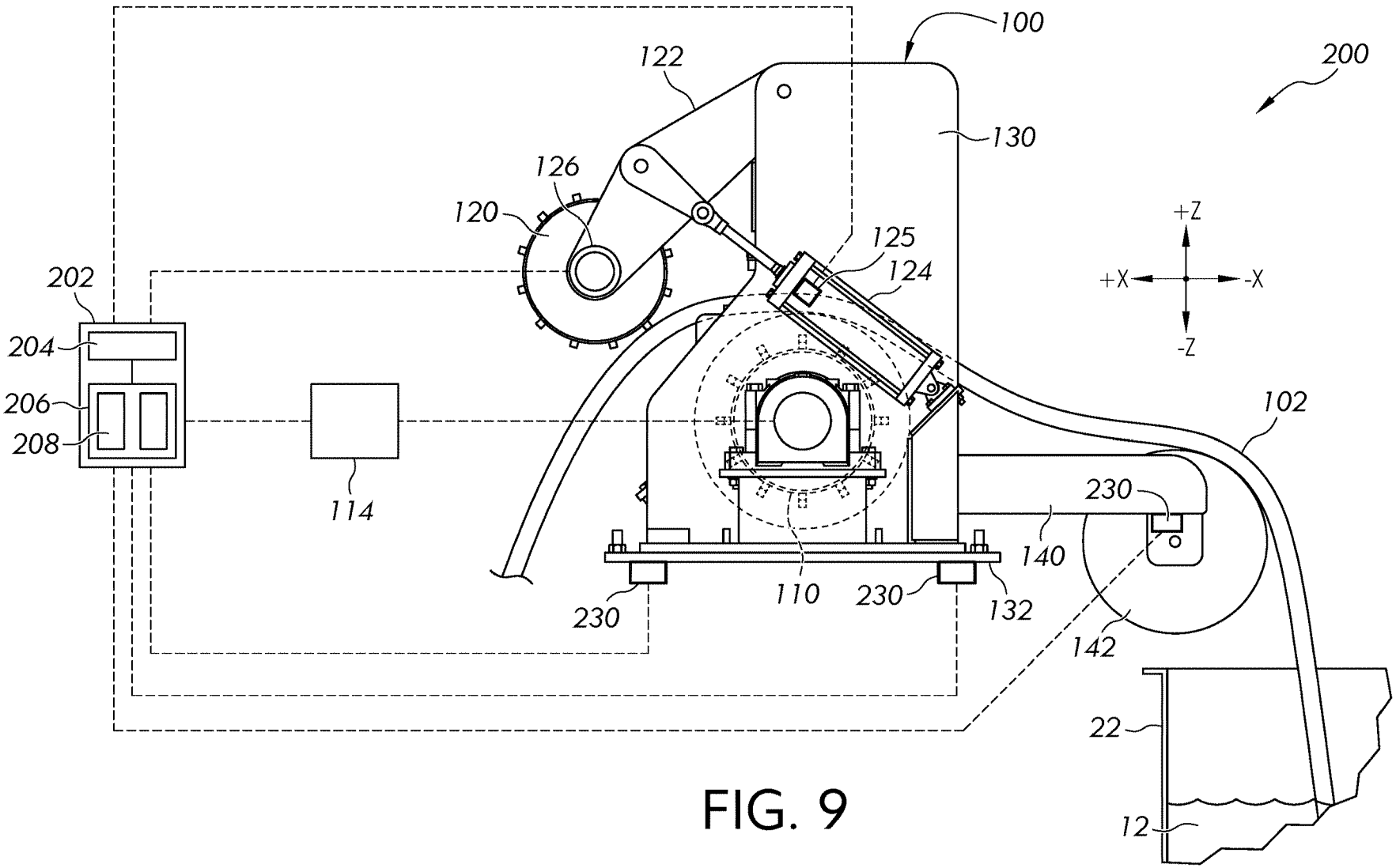
FIG. 9 schematically depicts a side view of yet another embodiment of a ragger system, according to one or more embodiments shown and described herein.

Referring now to FIG. 9, the ragger system 200 may include one or a plurality of load cells 230 positioned so that the output from the load cells is indicative of the forces exerted by the tail 102 on the ragger 100. The forces exerted by the tail 102 on the ragger 100 can be measured by the load cells 230 and may be indicative of a size of the tail 102, the amount of drag on the tail 102, or combinations of these. A relative weight and/or size of the tail 102 may be determined by the load cells 230 and can then be used in a feedback control method to control the pulling rate of the ragger 100, direction of rotation of the primary roll 110, pressure of the pressure device, the torque and/or speed of the rider roll 120, the rotational position of the ragger 100 relative to the pulper vessel 20, or combinations of these, to maintain the size and/or weight of the tail 102 within a desired range. Measuring the forces exerted by the tail 102 on the ragger 100 and adjusting the pulling rate, direction of rotation of the primary roll 110, pressure of the rider roll 120, torque and/or speed of the rider roll 120, rotational position of the ragger 100 relative to the pulper vessel 20, or combinations of these may reduce or prevent the tail 102 from getting too large (e.g., unable to pass through the ragger 100 or other downstream processes) or too small (e.g., not strong enough which can cause the tail 102 to break and fall back into the pulper vessel 20).

The load cells 230 may be positioned to measure a downward force exerted on the ragger 100, such as on the primary roll 110 of the ragger 100, by the tail 102. The downward force exerted by the tail 102 on the ragger 100 may be proportional to the weight of the tail 102 and the drag on the tail 102 by the pulp slurry 12. Therefore, the load cells 230 may provide an indication of the relative size and/or weight of the tail 102. The load cells 230 may be any type of commercially available load cells. The load cells 230 may be positioned on the feet of the ragger 100 (i.e., between the base plate 132 and the operating floor), on the support bearings for the primary roll 110, on the journals of the primary roll 110, or combinations of these. In embodiments, the load cells 230 may be positioned on the feet of the ragger 100 between the lower base plate 134 of the ragger 100 and the operating floor. In some embodiments, the load cells 230 may be positioned on all of the feet of the ragger 100.

In other embodiments, the load cells 230 may be positioned on the feet of the ragger 100 closest to the pulper vessel 20 and the other feet of the ragger 100 may be rigidly coupled to the operating floor. In this configuration, the forces exerted by the tail 102 may cause the ragger 100 to pivot vertically (i.e., in the +/−Z direction of the coordinate axis in FIG. 9) about the cantilever point (e.g., where the ragger 100 is rigidly attached to the operating floor) to engage with the load cells 230 on the feet closest to the pulper vessel 20. In embodiments, the feet of the ragger 100 closest to the pulper vessel 20 may be rigidly coupled to the operating floor while the load cells 230 are disposed under the feed furthest away from the pulper vessel 20, in which case the forces exerted by the tail 102 may cause the ragger 100 to pivot vertically (i.e., in the +/−Z direction of the coordinate axis in FIG. 9) about the cantilever point at the feet closest to the pulper vessel 20 to engage the load cells 230 on the feet furthest from the pulper vessel 20. In embodiments, the load cells 230 may be coupled to the guide arm 140, the guide roll 142, or both so that the load cells 230 measure the force exerted by the tail 102 on the guide arm 140, guide roll 142, or both. In embodiments, the load cells 230 may be disposed between the upper base plate 132 and the lower base plate 134. When disposed between the upper base plate 132 and the lower base plate 134, the load cells 230 may be placed according to any of the configurations discussed in relation to placing the load cells 230 under the feet of the ragger 100.

The load cells 230 may be communicatively coupled to the control system 202. The load cells 230 may be operable to measure the forces exerted by the tail 102 on the base plate 132, the primary roll 110, guide arm 140, or guide roll 142 of the ragger 100. The load cells 230 may be operable to transmit a load cell signal, which may be an electronic signal indicative of the forces exerted by the tail 102 on the ragger 100, to the control system 202. The control system 202 may be operable to receive the load cell signal indicative of the forces exerted by the tail 102 and adjust the pulling rate of the ragger 100, the direction of rotation of the primary roll 110, the pressure of the pressure device 124, the rotational position of the ragger 100, or combinations of these based on the forces exerted by the tail 102. The control system 202 may include one or more force targets stored in the one or more memory modules 204 and may be operable to compare the measured forces exerted by the tail 102 against the force targets and adjust the pulling rate, direction of rotation of the primary roll 110, pressure, rotational position of the ragger 100, or combinations of these based on the comparison. In embodiments, the control system 202 may be operable to receive one or more force targets input by an operator using an input device and to store the one or more force targets in the memory modules. When the load cell signal received increases to indicate an increase in the relative size and/or weight of the tail 102, the control system 202 may respond by increasing the pulling rate of the ragger 100 to prevent the tail 102 from getting any larger and clogging up the ragger 100 or reduce the weight of the tail 102. When the load cell signal received decreases to indicate a decrease in the relative size or weight of the tail 102, the control system 202 may respond by decreasing the pulling rate of the ragger 100 to thereby increase the size and weight of the tail 102 to reduce or prevent the tail 102 from breaking. The control system 202 may also adjust the pressure of the pressure device 124, the torque on the rider roll 120, the speed of the rider roll 120, or combinations thereof in response to the measured weight of the tail 102.

Rider Roll Position and Tail Size

The size of the tail 102 may also be determined from the position of the rider roll 120 relative to the primary roll 110, and the size determined therefrom may be used to control the pulling rate of the ragger 100 to keep the tail 102 from being too large or too small. The size of the tail 102 determined from the position of the rider roll 120 relative to the primary roll 110 may also be used to adjust the pressure of the pressure device 124, the torque on the rider roll 120, the speed of the rider roll 120, or combinations thereof. Referring again to FIG. 7, as previously discussed, the ragger 100 may include the position sensor 128 operable to determine a position of the rider roll 120 relative to the primary roll 110. The position sensor 128 may be communicatively coupled to the control system 202. In embodiments, the position sensor 128 may be operable to determine the rider roll arm angle θ (FIG. 4) relative to the frame 130, which is indicative of the position of the rider roll 120 relative to the primary roll 110. Additionally or alternatively, in embodiments, the ragger system 200 may include other types of sensors capable of determining a relative position of the rider roll arm 122, such as but not limited to a rotary encoder, a linear encoder, other sensor, or combinations of these. The rider roll arm angle θ may be indicative of a shortest distance between the outer surface of the rider roll 120 and the outer surface of the primary roll 110 (i.e., size of the nip between the rider roll 120 and the primary roll 110, which is determined by the thickness of the tail 102 disposed between the primary roll 110 and rider roll 120). The size and/or thickness of the tail 102 can be determined from the rider roll arm angle θ. The rider roll arm 122 must open to allow larger tails 102 to pass through the nip between the primary roll 110 and the rider roll 120. The rider roll arm 122 may also pivot the rider roll 120 closer to the primary roll 110 as the tail 102 becomes thinner. The rider roll arm angle θ may increase when the tail 102 grows in size and thickness and may decrease when the tail 102 diminishes in size. Thus, the rider roll arm angle θ can be used to determine the relative size and/or thickness of the tail 102.

The position sensor 128 may be operable to output a rider roll position signal, which may be an electronic signal indicative of a position of the rider roll 120 relative to the primary roll 110. In embodiments, the rider roll position signal may be an electronic signal indicative of the rider roll arm angle θ. The position of the rider roll 120 relative to the primary roll 110, such as but not limited to the rider roll arm angle, can be related to the thickness of the tail 102 disposed between the primary roll 110 and the rider roll 120 (i.e., size of the nip). The position sensor 128 may be physically coupled to the rider roll arm 122, the frame 130, or both. The position sensor 128 may be any commercially available position sensor. The position sensor 128 may be operable to transmit the rider roll position signal to the control system 202.

The control system 202 may be operable to receive the rider roll position signal and adjust the pulling rate of the ragger 100, the pressure of the pressure device 124, the torque on the rider roll 120, speed of the rider roll 120, or combinations of these in response to the rider roll position signal. In embodiments, the control system 202 may be operable to determine a thickness of the tail 102 from the rider roll position signal received from the position sensor 128. The control system 202 may be configured to adjust the rate of withdrawal of the tail 102, the direction of rotation of the puller drive, the pressure of the pressure device, the torque on the rider roll 120, speed of the rider roll 120, or combinations of these in response to the weight of the tail 102. When the rider roll position signal received increases to indicate an increase in the size or thickness of the tail 102, the control system 202 may respond by increasing the pulling rate of the ragger 100 to thereby reduce or prevent the tail 102 from getting any larger and clogging up the ragger 100. When the rider roll position signal received decreases to indicate a decrease in the size or thickness of the tail 102, the control system 202 may respond by decreasing the pulling rate of the ragger 100 or reverse the direction of rotation of the primary roll 110 to allow the tail 102 to grow larger, which may make the tail 102 stronger and reduce or prevent the tail 102 from breaking. The control system 100 may be operable to adjust the pulling rate of the ragger 100 to maintain a consistent rider roll arm angle (i.e., maintain a consistent size/thickness of the tail 102).

Tail Density

In embodiments, the ragger system 200 may determine a density of the tail 102 and adjust the withdrawal rate of the tail 102, the direction of rotation of the primary roll 110, the pressure of the pressure device 124, the torque on the rider roll 120, the speed of the rider roll 120, the rotational position of the ragger 100 relative to the pulper vessel 20, or combinations of these based on the density of the tail 102. At a fixed thickness of the tail 102, an increase in the density of the tail 102 may be indicative of a greater proportion of metal, such as metal banding, in the tail 102 relative to the amount of plastic or other non-metal debris. The strength of the tail 102 may depend on the proportion of metal in the tail 102 relative to the amount of plastic. When the amount of metal is greater, the tail 102 is stronger. When the density of the tail 102 is greater, the tail 102 may be stronger and less likely to break. Thus, a denser tail 102 can be narrower and can be pulled at a greater rate by the ragger 100 with less risk of breaking. Additionally, a denser tail 102 can be stronger, which may allow for increasing the pressure of the pressure device 124 and increasing the torque and/or speed of the rider roll 120 without breaking the tail 102. Conversely, a lesser density of the tail 102 may indicate a reduced proportion of metal in the tail 102, indicating that the tail 102 may be weaker and more susceptible to breaking. Additionally, a lesser density of the tail 102 may indicate that the tail 102 is too loose and can be more easily pulled apart by the pulling forces exerted by the ragger 100 on the tail 102. The relative density of the tail 102 can therefore be used to control the pulling rate of the ragger 100, the pressure of the pressure device 124, the torque on the rider roll 120, speed of the rider roll 120, or combinations of these. The density referred to herein can be a relative density such as a density index or change in density that conveys an indication of the density of the tail relative to an average density instead of an absolute density.

Referring again to FIG. 7, the density of the tail 102 can be determined or calculated from the position of the rider roll 120 to the primary roll 110, such as but not limited to the rider roll arm angle θ measured by the position sensor 128, and the pressure exerted by the pressure device 124. The measuring devices of the ragger system 200 can include the position sensor 128. In some embodiments, the measurement devices can include a pressure sensor 125 coupled to the pressure device 124. The position sensor 128 and the pressure sensor 125 may be communicatively coupled to the control system 202. The position sensor 128 may have any of the features previously discussed for the position sensor 128 and may be any type of device operable to measure a position of the rider roll arm 122 relative to the frame 130 or to the primary roll 110. In particular, the position sensor 128 may be operable to output the rider roll position signal or to transmit the rider roll position signal to the control system 202. When present, the pressure sensor 125 may have any of the features previously described herein for the pressure sensor 125. The pressure sensor 125 may be operable to transmit a pressure signal to the control system 202, where the pressure signal may be an electronic signal indicative of the pressure of the pressure device 124 operatively coupled to the rider roll arm 122. In embodiments, the pressure device 124 may be a pneumatic pressure device and may not include a pressure sensor 125. The control system 202 may be operable to send a pressure control signal to the pressure device 124, where the pressure control signal may be an electronic signal indicative of a pressure setting of the pressure device.

The control system 202 may be operable to determine the density of the tail 102 by modulating the pressure of the pressure device 124 and measuring the position of the rider roll 120 relative to the primary roll 110, such as measuring the rider roll arm angle θ, corresponding to each pressure of the pressure device 124. The control system 202 may transmit the pressure control signal to the pressure device 124, which may cause the pressure device 124 to change the pressure exerted by the rider roll 120 against the tail 102. The control system 202 may receive the rider roll position signal from the position sensor 128 at the new setting of the pressure device 124. The control system 202 may then determine a relative density of the tail 102 from a change in the rider roll arm angle signal in response to the change in the pressure of the pressure device 124. The relative density of the tail 102 may refer to a value indicative of a change in tail density compared to a standard density of the tail 102 based on the average tail size and tail composition.

Figure 11:
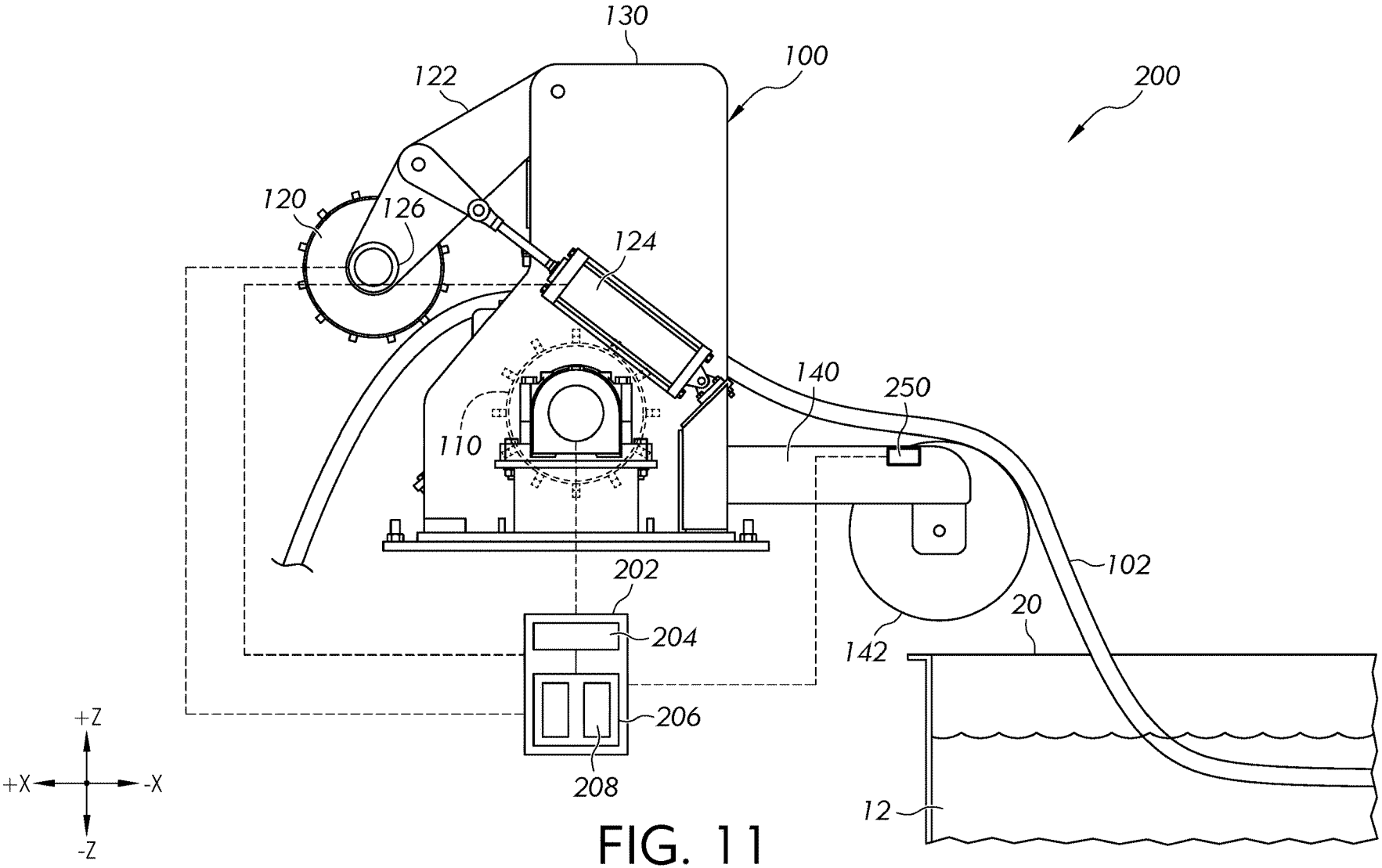
FIG. 11 schematically depicts a side view of still another embodiment of a ragger system, according to one or more embodiments shown and described herein.

Referring now to FIG. 11, the density of the tail 102, metal content of the tail 102, or both may also be determined from a hydraulic pressure profile as a function of blade position during operation of the cutter 160 to cut the tail 102 into pieces. The cutter 160 may include a cutter pressure sensor 290 and a blade position sensor 295 coupled to the cutter 160 and communicatively coupled to the control system 202. In embodiments, the pressure sensor 290 may be coupled to the hydraulic system providing the power to the cutter 160. The cutter pressure sensor 290 may be operable to measure the pressure of the hydraulic system during the cutting process. The cutter 160 may include a guillotine blade and the blade position sensor 295 may be positioned to measure the position of the blade during the cutting process. The greater the density and/or metal content of the tail 102, the greater force is required to cut the tail 102 and the less the tail 102 compresses prior to being cut. Thus, measuring the pressure and blade position of the cutter 160 can be used to determine a relative density and/or metal content of the tail 102. The relative density can further be determined through measuring the capacitance of the tail 102 through conductivity or ultrasonic methods, as described in further detail herein.

The control system 202 may be operable to increase or decrease the pulling rate of the ragger 100 (i.e., withdrawal rate of the tail 102), the direction of rotation of the primary roll 110, the pressure of the pressure device 124, the torque on the rider roll 120, the speed of the rider roll 120, the rotational position of the ragger 100 relative to the pulper vessel 20, or combinations of these based on the density determined for the tail 102. In embodiments, the control system 202 may be operable to increase a pulling rate of the ragger 100 in response to an increase in the determined relative density of the tail 102 and decrease a pulling rate of the ragger 100 in response to a decrease in the determined relative density of the tail 102. Increasing the pulling rate for a greater density tail 102 may reduce or prevent the tail 102 from getting too large, while decreasing the pulling rate for a lesser density tail 102 may reduce or prevent the tail 102 from breaking due to greater weakness of the tail.

Optical Sensors

Figure 10:
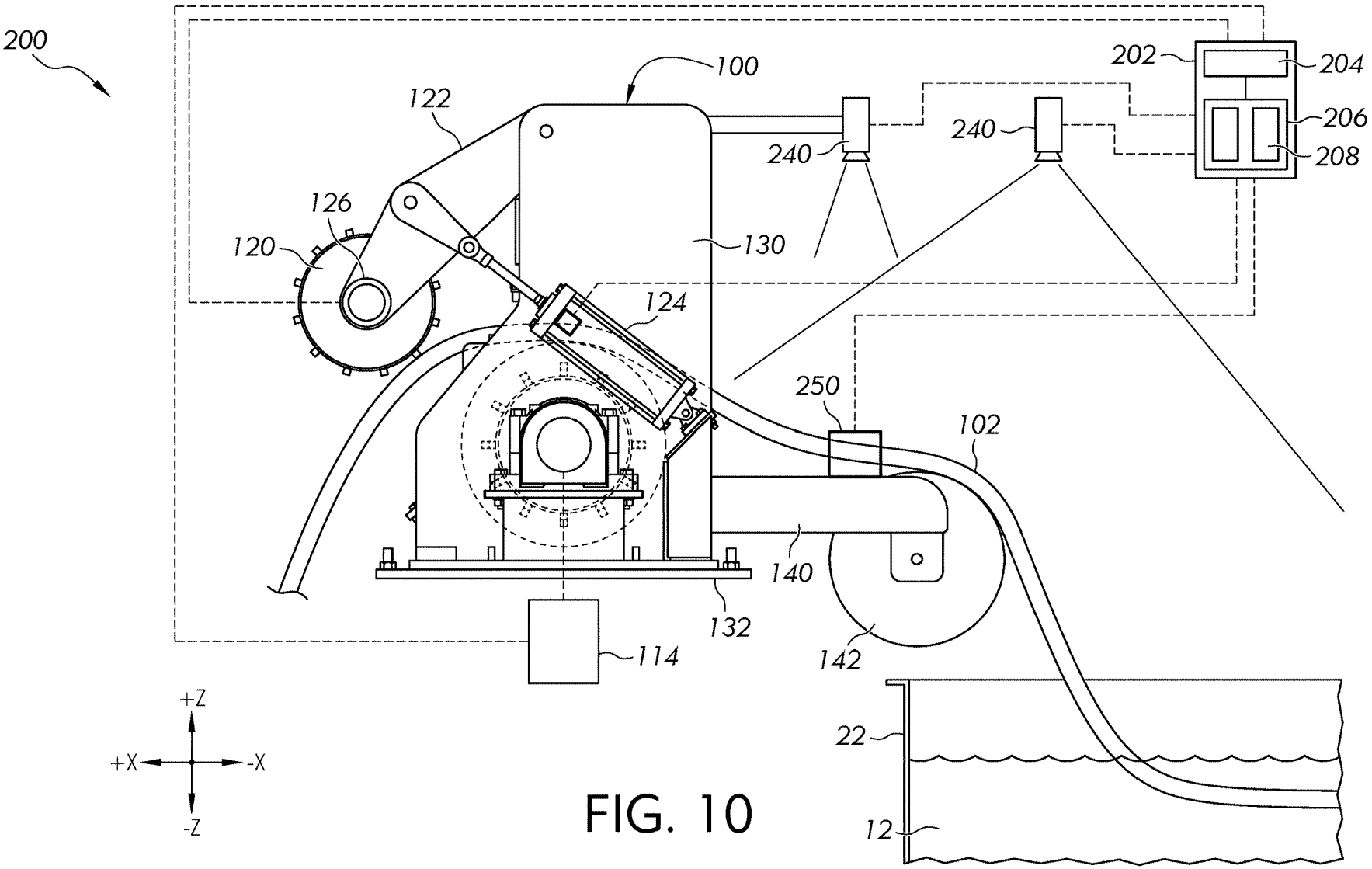
FIG. 10 schematically depicts a side view of another embodiment of a ragger system, according to one or more embodiments shown and described herein.

Referring now to FIG. 10, the size and/or thickness of the tail 102 may also be directly measured using one or more optical measurement devices 240, such as one or more optical sensors or cameras, positioned to directly measure the size and/or thickness of the tail 102. The optical measurement devices 240 may be coupled to the frame 130, the guide arm 140, a wall of the pulper vessel 20, or other structure that enables the optical measurement device 240 to directly measure one or more dimensions of the tail 102. In embodiments, the optical measurement device 240 may be suspended over the pulper vessel 20 in a position that enables the optical measurement device 240 to capture images of the tail 102 from above as it emerges from the pulp slurry 12 in the pulper vessel 20. In embodiments, the optical measurement device 240 may be positioned within the pulper vessel 20 so that the optical measurement device 240 can capture images of the tail 102 as it emerges from the pulp slurry in the pulper vessel 240. The ragger system 200 can include one or a plurality of optical measurement devices 240. The optical measurement device(s) 240, such as optical sensors and/or cameras, may be communicatively coupled to the control system 202 to transmit one or more dimension signals, image data, or both to the control system 202.

The optical measurement device 240 may be an optical profile sensor, laser displacement sensor, optical micrometer, interferometer, light detection and ranging device (LIDAR), camera, other optical sensor capable of measuring a thickness or dimension of the tail 102, or combinations of these. In embodiments, the optical measurement device 240 may include a camera positioned to capture an image of the tail 102. In embodiments, the ragger system 200 may include a plurality of cameras positioned at different positions and angles to capture images of various aspects of the tail 102. The cameras may be positioned above the pulper vessel 20, ragger 100, or both or may be positioned in the pulper vessel 20. When positioned above the pulper vessel 20, ragger 100, or both, the cameras may capture a top view of the tail 102 as the tail 102 emerges from the pulp slurry and is drawn through the ragger 100. The images from above can focus on any part of the tail 102 from the point where the tail 102 emerges from the pulp slurry to the primary roll 110. In embodiments, the camera may be positioned above the pulper vessel 20 and/or ragger 100 in a position where the camera can capture an image of the tail 102 as it enters the ragger 100, such as the portion of the tail 102 from the guide arm 140 to the primary roll 110 of the ragger 100.

In embodiments, the camera may be positioned in the pulper vessel 20 proximate to or just higher than the liquid level of the pulp slurry in the pulper vessel 20. When positioned at or just above the liquid level of the pulp slurry, the camera can capture horizontal images or side view images of the tail 102, in particular, side view images of the tail 102 as it emerges from the pulp slurry. Positioning the cameras in the pulper vessel 20 have the added advantage of using the inner surface of the pulper vessel 20 as a backdrop for taking the images of the tail 102. The inner surface of the pulper vessel 20 is generally smoother and more consistent than the top surface of the agitated pulp slurry in the pulper vessel or the background of the manufacturing facility above the pulper vessel 20. Having the inner surface of the pulper vessel 20 as a backdrop behind the tail 102 can improve the contrast in the images of the tail 102 captured by the cameras, which can improve the accuracy of various attributes of the tail 102, such as but limited to thickness, determined from the captured images. The ragger system 200 may additionally include a lighting system to provide sufficient light for capturing the images of the tail 102. In embodiments, the camera may include a translation device (not shown) operable to move the camera in concert with the oscillations of the tail 102. Moving the camera with the tail 102 may enable the camera system to maintain the tail 102 in a specific region of the field of capture of the camera, which may improve the accuracy of attributes of the tail 102 captured using the camera.

The optical measurement device 240 may be operable to generate and transmit a dimension signal, image data, or both to the control system 202, where the dimension signal may be an electronic signal indicative of a thickness, length, or other dimension of the tail 102. The optical measurement device 240 may be operable to determine the thickness or other attribute of the tail 102 at one or more points between the point where the tail 102 emerges from the pulp slurry 12 and the point where the tail 102 contacts the primary roll 110. In embodiments, the optical measurement device 240 may be positioned to capture an image of the tail 102 or measurement of the thickness of the tail 102 at the point where the tail 102 emerges from the pulp slurry 12. Image data may include images captured by a camera and transmitted to the control system 202 for processing. The control system 202 may be operable to receive the dimension signal, image data, or both from the optical measurement device 240 and adjust operation of the ragger 100 in response to the information received, such as by adjusting the pulling rate of the ragger 100, direction of rotation of the primary roll 110, pressure of the pressure device 124, the amount of torque on the rider roll 120, speed of the rider roll 120, the rotational position of the ragger 100 relative to the pulper vessel 20, or combinations of these.

The camera or the control system 202 may include image analysis software capable of processing images captured by the camera to produce a thickness profile of the tail 102 or a length of the tail 102. The thickness profile of the tail 102 may include a profile of the tail thickness along the exposed length of the tail 102. The exposed length of the tail 102 refers to the length of the tail expending from the point at which the tail 102 emerges from the pulp slurry 12 to the primary roll 110 or any subset of points along a length of the tail 102 between the pulp slurry 12 and the primary roll 110. The one or more cameras can be positioned to capture images that include at least 50%, at least 75%, at least 90%, or even at least 95% of the exposed length of the tail 102. The control system 202 can be operable to capture one or more images of the tail 102 with the camera, where each of the captured images show at least 50%, at least 75%, at least 90%, or even at least 95% of the exposed length of the tail 102. In embodiments, the ragger system 200 can include a plurality of cameras, and the control system 202 can operate the plurality of cameras in concert to produce a plurality of simultaneously captured images that show, in the aggregate, at least 50%, at least 75%, at least 90%, or even at least 95% of the exposed length of the tail 102.

The control system 202 can be configured to process the captured images to produce a thickness profile of the tail 102. The thickness profile of the tail 102 may comprise the thickness as a function of position along the length of the tail 102. The thickness profile of the tail 102 can include the thickness of the tail at each position along the exposed length of the tail 102. The control system 202 can also be configured to further analyze or process the thickness profile of the exposed length of the tail 102 to determine a rate of change in the thickness of the tail 102 at each of the positions along the exposed length of the tail 102. In embodiments, the control system 202 can be configured to generate a 3D model of the exposed length of the tail 102 from the captured images.

In embodiments, the control system 202 can be configured to determine a total length of the tail 102, where the total length of the tail 102 comprises the distance from the primary roll 110 to the end of the tail 102 distal from the ragger 100 and submerged within the pulp slurry 12. In embodiments, the total length of the tail 102 can be determined from the images of the tail 102 capturing the exposed length of the tail 102 from the primary roll 110 to the point where the tail 102 emerges from the pulp slurry. The length of the tail 102 can be determined from the exposed length of the tail 102 and the thickness profile of the tail 102. The total length of the tail 102 can also be determined by analyzing the rate of thickness change of the tail 102 as a function of position along the exposed length of the tail 102.

The rate of change in the thickness of the tail 102 can be used to determine regions of the tail 102 where the thickness is increasing or decreasing so that operation of the ragger 100 can be adjusted accordingly. In embodiments, the control system 202 can be configured to determine the rate of thickness change in the tail 102 at each position along the exposed length of the tail 102 from the thickness profile or directly from the captured images. The control system 202 can then be configured to identify one or more locations along the exposed length of the tail 102 where a magnitude of the rate of thickness change of the tail 102 exceeds a threshold rate of thickness change. The identifying can include comparing the magnitude of the measured rate of change in the thickness of the tail 102 to the threshold rate of thickness change. The control system 202 can be configured to identify one or more trends in the change in the thickness of the tail 102 with time, such as a trend in increasing or decreasing thickness of the tail, from the rate of thickness change of the tail 102 along the exposed length of the tail 102. The control system 202 may be configured to identify a thickening trend or a thinning trend of the tail 102, where a thickening or thinning trend is identified as a condition in which the thickness of the tail 102 changes by more than 10% along the exposed length of the tail 102. When the thickness change or thickness trend in the tail 102 is identified, the control system 202 can generate a control signal to adjust one or more of the withdrawal rate of the tail 102, the direction of the puller drive 114, the pressure of the pressure device 124, the torque on the rider roll 120, the speed of the rider roll 120, or combinations of these based on the rate of thickness change exceeding the threshold rate of thickness change. The direction of adjustment of the controlled variables can be determined from the direction of the rate of change, whether the direction is positive indicating thickening of the tail 102 or negative, which indicates thinning of the tail 102.

The control system 202 may be operable to identify one or more thin regions or thinning regions of the tail 102 as the tail 102 emerges from the pulp slurry 102, where the thin regions or thinning regions of the tail 102 may represent potential weak spots that can lead to tail breakage. Thin regions or weak spots of the tail 102 refers to regions of the tail 102 that have a thickness that is at least 10% less than an average thickness of the tail 102 along the exposed length of the tail 102. In embodiments, the thin regions or weak spots of the tail 102 have a thickness that is at least 15% less, at least 20% less, or even at least 25% less than the average thickness of the tail 102 along the exposed length of the tail 102. In embodiments, in response to a thin region or thinning region of the tail 102, the control system 202 may cause the ragger system 200 to reverse rotation of the primary roll 110 to submerge the thin region of the tail 102 back into the pulp slurry 12 so that the tail 102 can grow larger in the thin region. In embodiments, in response to a thin region of the tail 102 and depending on the location of the thin region relative to the primary roll 110, the control system 202 may cause the ragger system 200 to increase the withdrawal rate of the tail 102 (e.g., increase the rate of rotation of the primary roll 110) to pull the thin region through the nip before the thin region can cause the tail 102 to break. The control system 202 can also adjust the pressure of the pressure device 124 or change the torque and/or speed of the rider roll 120 in response to the identification of thin or thinning regions of the tail 102. For weak spots, the control system 202 may reduce the pressure of the pressure device 124 or reduce the torque and/or speed of the rider roll 120 to reduce the forces acting on the tail 102 in the ragger 100, to thereby reduce the chances of tail breakage. In embodiments, the control system 202 may identify a thick region or thickening region of the tail 102 emerging from the pulp slurry 12 and may increase the withdrawal rate of the tail 102 in response to prevent the thick region from growing too large to fit through the ragger 100. The control system 202 can also be configured to change the pressure of the pressure device 124 or the torque and/or speed of the rider roll 120 in response to identifying one or more thick regions or thickening regions of the tail 102.

As previously discussed, the control system 202 may be operable to identify thickening or thinning of the tail 102 overall from the dimension signal, image data, or both received from the optical measurement device 240. When the control system 202 identifies a thickening trend for the tail 102, the control system 202 may increase the pulling rate of the ragger 100, which may in turn cause the thickness of the tail 102 to decrease. When the control system 202 identifies a thinning trend for the tail 102, the control system 202 may decrease the pulling rate of the ragger to allow the tail 102 to grow in thickness and weight. In embodiments, the control system 202 may include feedback control operable to maintain a thickness of the tail 102 within a prescribed range based on the dimension signal, image data, or both received from the optical measurement device(s) 240.

In embodiments, the control system 202 may be operable to identify one or more sudden thickness expansion locations along the tail 102 and adjust operation of the ragger 100 to accommodate the sudden thickness expansion location. The sudden thickness expansion locations of the tail 102 are locations along the tail 102 where the tail 102 is thicker by at least 20% relative to other adjacent portions of the tail 102. The sudden change in thickness at the sudden thickness expansion location may occur over a length of the tail 102 of less than 4 feet, less than 3 feet, or even less than 2 feet, after which the thickness of the tail 102 may return to normal. A sudden thickness expansion location is essentially a bump in the tail 102, where the tail 102 is suddenly substantially thicker for a short distance. A sudden thickness expansion location can be caused by a knot forming in the tail 102 or by some other thickness anomaly. When a sudden thickness expansion location reaches the nip between the puller mechanism (e.g., primary roll 110) and the rider roll 120, the greater thickness of the tail 102 at the sudden thickness expansion location may not fit into the nip, which can lead to a slippage condition. The control system 202 may be configured to detect the sudden thickness expansion locations using the imaging devices, such as one or more cameras, and adjust operation of the ragger 100 to accommodate the sudden thickness expansion location. The control system 202 may reduce the pressure of the pressure device 124, reduce the withdrawal rate of the tail 102, adjust the torque and/or speed of the rider roll 120, or combinations thereof to allow the sudden thickness expansion location of the tail 102 to pass through the ragger 100. In embodiments, the control system 202 may be configured to capture one or more images of the tail; identify one or more sudden thickness expansion locations of the tail from the captured images and; and adjust the rate of withdrawal of the tail, the direction of the puller drive, the pressure of the pressure device, a torque on the rider roll, a speed of the rider roll, or combinations thereof based on identification of the sudden thickness expansion locations from the one or more images.

Figure 12:
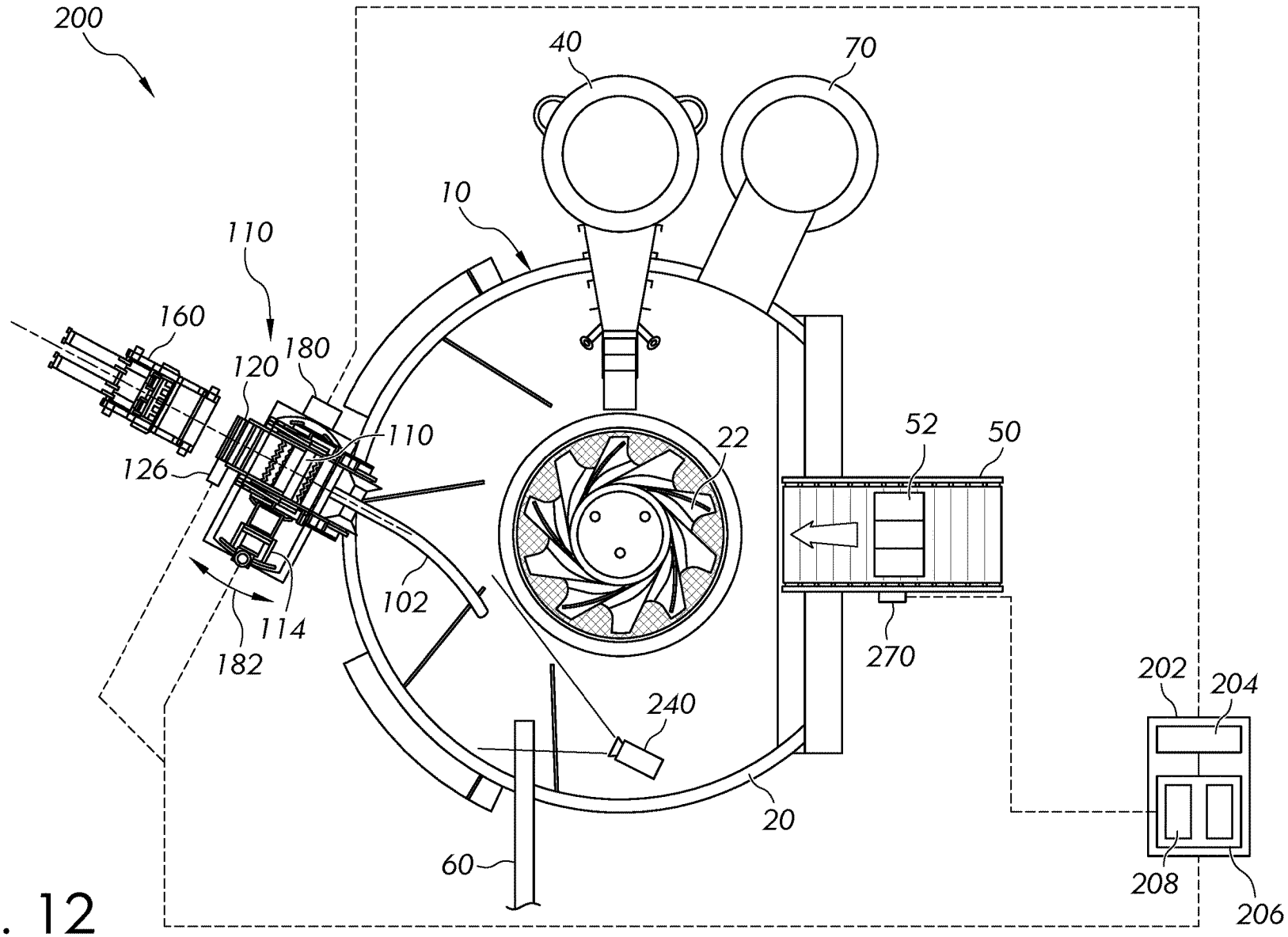
FIG. 12 schematically depicts a top view of another embodiment of a ragger system, according to one or more embodiments shown and described herein.

Referring to FIG. 10, the optical measuring devices 240 may be positioned to capture an image of the tail 102 in the pulper vessel 20 from which a position of the tail 102 relative to the ragger 100 can be determined. The control system 202 may process image data received from the optical measuring devices 240 to determine the position of the tail 102 in the pulper vessel 20 in relation to the ragger 100. Referring now to FIG. 12, in response to the position of the tail 102 relative to the ragger 100, the control system 202 may adjust a rotational position of the ragger 100 relative to the pulper vessel 20 to better align the ragger 100 with the position of the tail 102. Rotation of the ragger 100 relative to the pulper vessel 20 is indicated by the bi-directional arrow 182 in FIG. 12. The control system 202 may send a control signal to the base plate actuator 180 that causes the base plate actuator 180 to rotate the upper base plate 132 of the ragger 100 to reposition the ragger 100 in response to the position of the tail 102.

Additionally or alternatively, in embodiments, the ragger system 200 may include detection or imaging systems based on electromagnetic waves other than light waves in the visible or near visible spectrum. During operation, the pulping system 10 may produce mist or vapors above the pulper vessel 20, especially when the pulping system 10 is operated at greater temperatures. These mists or vapors may impede operation of optical measurement devices. To overcome these limitations, devices based on other types of electromagnetic waves, such as radio waves for example, can be used in addition to or in place of the optical measurement devices 240. In embodiments, the ragger system 200 may include a radar measurement system operable to determine the size, shape, and/or position of the tail 102. In embodiments, the optical measurement devices 240 may include one or more thermographic cameras operable to capture thermal images of the tail 102.

In embodiments, the cameras and image analysis software can be used to monitor the position of a reference point on the width of the tail 102 and correlate the oscillations in the position of the reference point on the width of the tail 102 to other input variables, such as attributes of the tail 102 or operating conditions of the ragger 100 or pulper vessel 20. Referring again to FIG. 10, the reference point P may be any quantifiable point on the width W of the tail 102. In FIG. 10, the width W of the tail 102 is measured as a distance across the tail in the +/−Y direction of the coordinate axis of FIG. 10. In embodiments, the reference point P may be a center point of the width W measurement of the tail 102. In embodiments, the reference point P may be either endpoint $P_1$ or $P_2$ of the width W measurement of the tail 102. The reference point P may be any other point on the width W between points $P_1$ and $P_2$. Referring again to FIG. 12, the control system 202 may capture a plurality of images of the tail 102 using the camera and determine the width of the tail 102 and the position of the reference point of the width measurement of the tail 102 for each of the plurality of images to produce a data set comprising the position of the reference point of the width measurement of the tail 102 as a function of time. This data set of the position of the reference point of the tail 102 as a function of time can be indicative of the back-and-forth oscillations of the tail 102 during operation of the ragger 100.

The control system 202 can be operable to collect and store the data set comprising the position of the reference point of the tail 102 as a function of time in the memory modules of the control system 202. The control system 202 may further be configured to process the data set or a portion of the data set comprising position of the reference point of the tail 102 as a function of time using Fast Fourier Transformation (FFT) algorithms to determine frequency and amplitude of the oscillations of the tail 102 during operation of the ragger 100. The frequency and amplitude of oscillations of the tail 102 obtained through FFT analysis of the position of the reference point of the tail 102 as a function of time can be correlated to other variables of the system, such as attributes of the tail 102 (e.g., width, length, metal content, density, weight, etc.), operating conditions of the ragger 100 (e.g., withdrawal rate of the tail 102, rotation direction of primary roll 110, pressure of the pressure device, torque on the puller drive 114, torque or speed of the rider roll 120, position of rider roll 120 relative to the primary roll 110, or other operating condition of the ragger 100) operating condition of the pulper vessel 10 (e.g., production rate, fluid level, pulp consistency, pulp temperature, feed conveyor speed, torque on rotor motor, etc.), or combinations of these. The control system 202 can save these correlations in the memory modules. The correlations between frequency and amplitude of oscillations in the position of the reference point of the tail 102 and the attributes of the tail 102 or operating conditions of the ragger 100 or pulper vessel 20 can be updated periodically based on further collection of data.

In embodiments, the control system 202 may be configured to run an FFT analysis on all or a portion of the data set comprising position of the reference point of the tail 102 as a function of time to ascertain the frequencies and amplitudes produced by oscillation of the tail 102. The control system 202 may then be configured to determine one or more attributes of the tail 102, one or more operating conditions of the ragger 100, one or more operating conditions of the pulper vessel 20, or combinations of these from the frequency and amplitude data produced from the FFT analysis. These determined input variables can then be used to adjust operation of the ragger 100, such as by adjusting the withdrawal rate of the tail 102, the direction of rotation of the primary roll 110, the pressure of the pressure device 124, the torque on the rider roll 120, speed of the rider roll 120, the rotational position of the ragger 100 relative to the pulper vessel 20, or combinations of these. The control system 202 may be configured to conduct an FFT analysis on the data set (or portion thereof) comprising the position of the reference point of the tail 102 as a function of time at time intervals of from about 1 second to about 1 minute.

Capacitance and Metal Content of Tail

Additionally, in embodiments, the relative metal content of the tail 102 may be measured and used to determine a relative strength of the tail 102. The metal content of the tail 102 may directly correlate to the strength of the tail 102. As previously discussed in relation to the density of the tail 102, the greater the amount of metal, such as metal wire or metal banding, in the tail 102 the greater the strength of the tail 102. Thus, a tail 102 with a greater metal content can be pulled by the ragger 100 at a greater pulling rate compared to a tail 102 with a lesser metal content without fear of breaking the tail 102. Additionally, a greater metal content of the tail 102 may allow the tail 102 to have a smaller overall size or thickness without breaking compared to a tail 102 with a lesser metal content. In embodiments, determining the metal content of the tail 102 may enable the ragger 100 to maintain the pulling rate, pressure, torque on the rider roll 120, and/or speed of the rider roll 120 even when a thin section of the tail 102 is identified, if the metal content of the tail 102 in the thin spot is great enough to maintain the pull rate without breaking the tail 102. The relative metal content of the tail 102 can, therefore, be measured, and the pulling rate of the ragger 100, pressure of the pressure device 124, torque and/or speed of the rider roll 120, or combinations thereof can be adjusted in response to increasing or decreasing metal content in the tail 102.

The relative metal content of the tail 102 may be measured by measuring a capacitance of the tail 102. Referring now to FIG. 10, the ragger system 200 may include a capacitance sensor 250 physically coupled to the ragger 100 and communicatively coupled to the control system 202. The capacitance sensor 250 can be an electrical sensor, an ultrasonic sensor, or other type of sensor capable of determining the capacitance of the tail 102. The capacitance sensor 250 may be any type of commercially available sensor capable of determining the capacitance of the tail 102. The capacitance sensor 250 may be coupled to the ragger 100 at any location convenient for measuring the capacitance of the tail 102. In embodiments, the capacitance sensor 250 may be coupled to the guide arm 140, guide roll 142, or both. In embodiments the capacitance sensor 250 may be coupled to the frame 130. In embodiments, the capacitance sensor 250 may be coupled to the primary roll 110, the rider roll 120, or both.

The capacitance sensor 250 may be operable to generate a capacitance signal and transmit the capacitance signal to the control system 202. The capacitance signal may be indicative of the capacitance of the tail 102, which can be related to the metal content of the tail 102. The control system 202 may be operable to receive the capacitance signal and adjust operation of the ragger 100 in response to the capacitance signal. When the capacitance signal indicates an increase in the metal content of the tail 102, the control system 202 may be operable to increase the pull rate of the ragger 100 due to the increased strength of the tail 102 provided by the increased metal content. Conversely, when the capacitance signal indicates a decrease in the metal content of the tail 102, the control system 202 may be operable to decrease the pulling rate of the ragger 100 to reduce or prevent the tail 102 from breaking due to being weaker on account of the reduced metal content.

Capacitance measurement may be combined with measurement of the dimensions of the tail 102 to fine tune control of the ragger 100. In embodiments, in response to a dimension measurement indicating a thinning of the tail 102 and a capacitance measurement indicating an increased metal content of the tail 102, the control system 202 may maintain or increase the pulling rate of the ragger 100. This is because, although the tail 102 is thinner, the increased metal content may make the tail 102 stronger and, therefore, able to withstand the forces of the current pulling rate or an increased pulling rate. Similarly, in embodiments, in response to a dimension measurement indicating a thickening of the tail 102 and a capacitance measurement indicating a decreased metal content of the tail 102, the control system 202 may maintain or decrease the pulling rate of the ragger 100 to reduce or prevent breakage of the tail 102.

Integration of Pulping System Operating Conditions

Referring now to FIGS. 11 and 12, the ragger system 200 may also incorporate input variables relating to the operating conditions of the pulping system 10, such as the production rate of the pulping system 10 as determined by the speed of the feed conveyor 50, the proportion or amount of recycled paper furnish introduced to the pulper vessel 20, the fluid level in the pulper vessel 20, the consistency of the pulp slurry 12 in the pulper vessel 20, the temperature of the pulp slurry 12 in the pulper vessel, or combinations of these. The fluid level, consistency, and temperature of the pulp slurry 12 in the pulper vessel 20 may all influence the turbulence and energy in the pulper vessel 20, which can have an impact on the formation, growth, and motion of the tail 102 in the pulper vessel 20. Additionally, the fluid level, consistency, and temperature of the pulp slurry 12 in the pulper vessel 20 may each influence the amount of drag exerted by the pulp slurry 12 on a submerged portion of the tail 102. As previously discussed, increasing drag on the tail 102 by the pulp slurry 12 may increase the risk of breaking the tail 102. Additionally, increased drag can also influence the measured operating parameters of the ragger 100, such as but not limited to torque on the puller drive 114, vibrations, etc. Operation of the ragger 100 may depend on the level of solid debris in the pulper vessel 20. The level of solid debris in the pulper vessel 20 may be a function of the proportion of recycled paper furnish introduced to the pulper vessel 20, the production rate of the pulping system 10, or both.

Most pulping systems 10 are operated at a constant fluid level in the pulper vessel 20. As a result, the solids concentration in the pulper vessel 20, such as concentration of solid fibers in the pulp slurry, generally increases for increasing production rates. Greater concentrations of solid fibers and solid debris and contaminants results in greater power required by the motor driving the rotor 22 of the pulping vessel 20. The concentration of solid fibers in the pulp slurry 12 is also measured by one or a plurality of consistency sensors disposed at or downstream of the outlet 30 of the pulping system 10. Additionally, in order to achieve greater production rates, the rate at which the furnish is added to the pulping vessel 20 must also increase. Therefore, the speed of the feed conveyor 50 that transports the bales of recycled paper furnish to the pulper vessel 20 is also indicative of the production rate of the pulping system 10. In other words, greater production rate means a greater speed of the feed conveyor 50. Therefore, combined conveyor speed, consistency of the pulp slurry, and power of the motor driving the rotor 22, each individually or in combination, can provide an indication of the production rate of the pulper system 10 and can be used to control operation of the ragger 100.

Generally, as the production rate of the pulping system 10 increases, the amount of solid debris in the pulping vessel increases, which may cause the tail 102 to increase in size, weight, thickness, density, metal content, or combinations of these. Therefore, for increased production rate, the pulling rate of the ragger 100 may be increased to reduce or prevent the tail 102 from growing so large that it clogs the ragger. The pressure of the pressure device 124, the torque on the rider roll 120, speed of the rider roll 120, or combinations thereof may also be adjusted to account for the greater probability of slippage of the tail 102 caused by the additional weight and pulling rate. Conversely, as the production rate of the pulping system 10 decreases, the amount of the solid debris in the pulping vessel decreases, which may cause the tail 102 to decrease in size, weight, metal content, thickness, density, or combinations of these. Thus, for decreased production rate, the pulling rate of the ragger 100 may be decreased or the direction of rotation of the primary roll 110 reversed to reduce or prevent the tail 102 from weakening to the point that the tail 102 breaks and falls back into the pulper vessel 20. Adjustments to the pulling rate, direction of rotation of the primary roll 110, pressure of the pressure device 124, torque and/or speed of the rider roll 120, or combinations of these may further account for increasing or decreasing drag on the tail 102, which may be caused by changing thickness or length of the tail 102, fluid level in the pulper vessel 20, consistency of the pulp slurry 12, temperature of the pulp slurry 12, or combinations of these.

Referring again to FIGS. 12 and 13, the control system 202 may be communicatively coupled to one or more consistency sensors 260 positioned at the outlet 30 of the pulping system 10. The consistency sensors 260 may be disposed upstream or downstream of the outlet 30 of the pulping system 10. The consistency sensors 260 may be any commercially available sensor capable of measuring the consistency (e.g., fiber concentration) of the pulp slurry 12. The consistency sensors 260 may be operable to measure a consistency of the pulp slurry 12 discharged from the pulping system 10 and generate and transmit a consistency signal to the control system 202. The consistency signal may be an electronic signal indicative of the consistency of the pulp slurry 12, which may be indicative of the production rate of the pulping system 10.

The control system 202 may be communicatively coupled to a feed conveyor speed sensor 270 positioned on the feed conveyor 50. In embodiments, the pulping system 10 may have a plurality of feed conveyors 50, each comprising a feed conveyor speed sensor 270, and the control system 202 may be communicatively coupled to each of the feed conveyor speed sensors 270. The feed conveyor speed sensor(s) 270 may be any commercially available sensor capable of measuring the speed of a conveyor. Each feed conveyor speed sensor 270 may be operable to measure a speed of the feed conveyor 50 to which it is coupled and generate and transmit a conveyor speed signal to the control system 202. The conveyor speed signal may be an electronic signal indicative of the speed of the feed conveyor, which may be indicative of the production rate of the pulping system 10. The feed conveyor speed may also be indicative of a ratio of recycled furnish to virgin furnish in the pulping system 10.

Referring now to FIG. 13, in embodiments, the control system 202 may be communicatively coupled to the rotor motor 24 that is operatively coupled to the rotor 22 of the pulper vessel 20. Additionally or alternatively, in embodiments, the control system 202 may be communicatively coupled to one or more motor sensors 280 coupled to the motor 24. The motor sensors 280 may include but are not limited to an ammeter, a motor speed sensor, a strain gauge, or combinations of these. The motor 24 or motor sensors 280 may be operable to generate and transmit a power signal to the control system 202. The power signal may be an electronic signal indicative of the power drawn by the motor 24 driving the rotor 22, which may be indicative of the production rate of the pulping system 10. The motor sensors 280 may also measure torque, current, and motor speed, which may all be used individually or in any combination to determine an operating state of the motor 24.

Referring again to FIG. 13, the control system 202 may also be communicatively coupled to the level controller 42 of the pulper vessel 20. The level controller 42 may be operable to determine a fluid level in the pulper vessel 20 and transmit a level signal to the control system 202. The control system 202 may be operable to receive the level signal from the level controller 42 and adjust operation of the ragger 100 based at least in part on the level signal received from the level controller 42. In embodiments, the pulper vessel 20 may also include one or a plurality of temperature sensors 80. The temperature sensors 80 may be positioned in the pulper vessel 20 or at an outlet of the pulper vessel 20 to measure the temperature of the pulp slurry 12. The temperature sensors 80 may be communicatively coupled to the control system 202 to transmit a temperature signal to the control system 202.

The control system 202 may receive the consistency signal, conveyor speed signal, power signal, level signal, temperature signal, or combinations of these and adjust the operation of the ragger 100 in response, such as by adjusting one or more of the pulling rate of the ragger 100, direction of rotation of the primary roll 110, pressure of the pressure device 124, the torque of the rider roll 120, the rotational position of the ragger 100 relative to the pulper vessel 20, or combinations of these. When the consistency signal, speed signal, power signal, level signal, temperature signal, or combinations of these indicate operating conditions of the pulping system 10 likely to result in a greater size, weight, density, or metal content of the tail 102, the control system 202 may operate to increase a pulling rate of the ragger 100, which may reduce or prevent the tail 102 from growing too large and clogging the ragger 100. When the consistency signal, speed signal, power signal, level signal, temperature signal, or combinations of these indicates a decrease in the production rate of the pulping system 10, the control system 202 may operate to decrease a pulling rate of the ragger 100 or reverse the direction of rotation of the primary roll 110, both of which may allow the tail 102 to grow larger to reduce or prevent the tail 102 from breaking. In embodiments, the control system 202 may use the fluid level in the pulper vessel 20, the pulp consistency, the temperature of the pulp slurry 12, the feed conveyor speed, the torque on the rotor 22, production rate, ratio of recycled furnish in the pulp slurry, or other operating condition of the pulping system 100 to adjust measured operating parameters of the ragger 100, such as torque on the puller drive 114, vibrations, or other operating parameters.

Although described separately, any of the operating conditions of the pulping system 10 and the weight, thickness, size, metal content, or density of the tail 102 may be used in combination to control the operation of the ragger 100. Various combinations of these input variables are contemplated to develop a control scheme for the ragger system 200.

Controlled Variables

The control system 202 may adjust the pulling rate of the ragger 100, the direction of rotation of the primary roll 110, the pressure of the pressure device 124, the torque of the rider roll 120, the rotational positioning of the ragger 100 relative to the pulper vessel 20, or combinations of these in response to one or more of the input variable measured by the one or more measurement devices described herein and transmitted to the control system 202. As previously discussed, the control system 202 may be communicatively coupled to the puller drive 114, the pressure device 124, the rider roll drive 126, the base plate actuator 180, or combinations of these. To adjust the pulling rate of the ragger 100, the control system 202 may transmit a control signal to one or more of the puller drive 114, the pressure device 124, the rider roll drive 126, or combinations of these. In embodiments, the control system 202 may transmit a primary roll speed control signal to the puller drive 114, where the primary roll speed control signal is indicative of the speed of the primary roll 110. The puller drive 114 may change the rotation rate of the primary roll 110 based on the primary roll speed control signal received from the control system 202. In embodiments, the control system 202 may transmit a rider roll torque control signal to the rider roll drive 126, where the rider roll torque control signal indicates a torque setting for rider roll rive 126. The rider roll drive 126 may change the torque on the rider roll 110, the speed of the rider roll 110, or both based on the rider roll torque control signal received from the control system 202. In embodiments, the control system 202 may transmit a rider roll speed control signal to the rider roll drive 126, where the rider roll speed control signal is indicative of the speed of the rider roll 120. The rider roll drive 126 may change the rotation rate of the rider roll 110 based on the rider roll speed control signal received from the control system 202. In embodiments, the control system 202 may transmit a pressure control signal to the pressure device 124, where the pressure control signal is indicative of pressure of the rider roll 120 against the tail 102. The pressure device 124 may change the pressure of the rider roll 120 against the tail 102 based on the pressure control signal received from the control system 202. In embodiments, the control system 202 may transmit a position signal to the base plate actuator 180, where the position signal is indicative of the desired rotational position of the ragger 100 relative to the pulper vessel 20. The base plate actuator 180 may rotate the upper base plate 132 of the ragger 100 to rotationally position the ragger 100 relative to the pulper vessel 20 based on the position signal received from the control system 202. The input variables and controlled variables may be utilized in various control schemes, such as feedback control, cascade feedback control, feedforward control, or other types of control algorithms to adjust one or more of the controlled variables based on one or more of the input variable.

Embodiments of the disclosure may be embodied in hardware and/or in software (including firmware, resident software, micro-code, etc.). The control system 202 of the ragger system 200 may include the at least one processor 204 and the computer-readable storage medium (i.e., memory module 206) as previously described in this specification. The control system 202 may be communicatively coupled to one or more system components (e.g., puller drive 114, rider roll drive 126, pressure device 125, pressure sensor 125, position sensor 128, rotation sensor 129, torque measurement devices 210, rider roll torque measurement device 212, vibration sensors 220, load cells 230, optical measurement devices 240, capacitance sensors 250, pulper consistency sensors, rotor torque measurement device, feed conveyor speed sensor, temperature sensor, level sensors, or other component) via any wired or wireless communication pathway. A computer-usable or the computer-readable storage medium or one or more memory modules 206 may be any medium that can contain, store, communicate, propagate, or transport the program for use by or in connection with the instruction execution system, apparatus, or device.

The computer-usable or computer-readable storage medium or memory module(s) 206 may be, for example but not limited to, an electronic, magnetic, optical, electromagnetic, infrared, or semiconductor system, apparatus, device, or propagation medium. More specific examples (a non-exhaustive list) of the computer-readable storage medium or memory module(s) 206 would include but are not limited to the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable storage medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

The computer-readable storage medium or memory module(s) 206 may include the machine readable and executable instructions 208 for carrying out operations of the present disclosure. The machine readable and executable instructions 208 may include computer program code that may be written in a high-level programming language, such as but not limited to C or C++, for development convenience. In addition, computer program code for carrying out operations of the present disclosure may also be written in other programming languages, such as, but not limited to, interpreted languages. It is not intended to limit the scope of the disclosure to any particular programming language. Some modules or routines may be written in assembly language or even micro-code to enhance performance and/or memory usage. However, software embodiments of the present disclosure do not depend on implementation with a particular programming language. It will be further appreciated that the functionality of any or all of the program modules may also be implemented using discrete hardware components, one or more application specific integrated circuits (ASICs), or a programmed digital signal processor or microcontroller.

The ragger systems 200 of the present disclosure may reduce manual intervention with the ragger 100 and downtime of the pulping system 10. The ragger systems 200 disclosed herein may increase the overall throughput of the pulper system 10 and reduce operator manpower requirements and reduce variability in ragger operation due to different methods used by operators to control the ragger 100. Additionally, the ragger systems 200 may be retrofitted to existing raggers 100 to improve operation of existing ragger machines. Other features and advantages of the ragger systems 200 of the present disclosure may become apparent from practicing the present subject matter.

A first aspect of the present disclosure is directed to a ragger system for removing solid debris from a pulper vessel of a pulping system. The ragger system comprises a ragger operable to pull a tail of solid debris from the pulper vessel. The ragger includes puller mechanism comprising a puller drive operatively coupled to the puller mechanism, the puller mechanism operable to engage the tail and pull the tail from the pulper vessel. The ragger further comprises a rider roll spaced apart from the puller mechanism and a pressure device configured to adjust a pressure of the rider roll on the tail disposed between the puller mechanism and the rider roll. The ragger system further comprises at least one measurement device operable to measure one or more input variables indicative of one or more attributes of the tail, one or more operating conditions of the pulping system, or combinations of these. The ragger system may further comprise a control system comprising a processor, a memory module communicatively coupled to the processor, and machine readable and executable instructions stored on the memory module. The control system is communicatively coupled to the at least one measurement device. The control system is communicatively coupled to the puller drive, the pressure device, or combinations thereof. The machine readable and executable instructions, when executed by the processor, can cause the ragger system to automatically measure the one or more input variables with the at least one measurement device, wherein the one or more input variables is indicative of one or more attributes of the tail, one or more operating conditions of the ragger, one or more operating conditions of the pulping system, or combinations thereof; and adjust a rate of withdrawal of the tail, a direction of the puller drive, a pressure of the pressure device, or combinations of these based on the measured one or more input variables.

A second aspect of the present disclosure is directed to a ragger system for removing solid debris from a pulper vessel of a pulping system. The ragger system comprises a ragger operable to pull a tail of solid debris from the pulper vessel. The ragger comprises a puller mechanism comprising a puller drive operatively coupled to the puller mechanism. The ragger comprises a rider roll comprising a rider roll drive operatively coupled to the rider roll, wherein the rider roll is spaced apart from the puller mechanism. The ragger comprises a pressure device configured to adjust a pressure of the rider roll on the tail disposed between the puller mechanism and the rider roll. The ragger system further includes at least one measurement device operable to measure one or more input variables indicative of one or more attributes of the tail, one or more operating conditions of the pulping system, or combinations of these; and a control system comprising a processor, a memory module communicatively coupled to the processor, and machine readable and executable instructions stored on the memory module. The control system is communicatively coupled to the at least one measurement device. The control system is communicatively coupled to the puller drive, the secondary roll drive, the pressure device, or combinations thereof. The machine readable and executable instructions, when executed by the processor, cause the ragger system to automatically measure one or more operating parameters of the rider roll, the rider roll drive, or both with the at least one measurement device; and adjust a rate of withdrawal of the tail, a direction of the puller drive, a pressure of the pressure device, a torque on the rider roll, a speed of the rider roll, or combinations of these based on the measured operating parameters.

A third aspect of the present disclosure may include either one of the first or second aspects, wherein the one or more measurement device may comprise a rider roll torque measurement device operable to measure torque on the rider roll or rider roll drive, a rider roll ammeter operable to measure a current draw on the rider roll drive, a rotation sensor operable to measure a rotational speed of the rider roll, a position sensor operable to measure a position of the rider roll relative to the primary roll, or combinations thereof.

A fourth aspect of the present disclosure may include any one of the first through third aspects, wherein the puller drive may be a variable speed drive, the puller drive may drive the puller mechanism continuously to advance the tail through the ragger during operation of the ragger and does not operate to turn the puller mechanism off and on at regular intervals to advance the tail, and the rate of withdrawal of the tail from the pulper vessel may be controlled by changing the speed of the puller drive.

A fifth aspect of the present disclosure may include any one of the first through fourth aspects, wherein the at least one measurement device may comprise a torque measurement device coupled to the puller mechanism, the puller drive, or a drive train coupled the puller drive to the puller mechanism, and the machine readable and executable instructions, when executed by the processor, may cause the ragger system to automatically: measure a torque on the puller mechanism with the torque measurement device and adjust the rate of withdrawal of the tail, a direction of the puller drive, the pressure of the pressure device, a torque on the rider roll, a speed of the rider roll, or combinations thereof on the measured torque on the puller mechanism.

A sixth aspect of the present disclosure may include any one of the first through fifth aspects, wherein the puller mechanism may comprise a primary roll and the at least one measurement device may comprise a torque measurement device coupled directly to the primary roll, the puller drive, or on a drive train coupling the primary roll to the puller drive. The machine readable and executable instructions, when executed, may cause the ragger system to automatically measure a torque on the primary roll with the torque measurement device and adjust the rate of withdrawal of the tail, a direction of the puller drive, the pressure of the pressure device, a torque on the rider roll, a speed of the rider roll, or combinations thereof on the measured torque on the primary roll.

A seventh aspect of the present disclosure may include the sixth aspect, wherein the torque measurement device may comprise a strain gauge coupled to the primary roll or to the drive train of the primary roll or an ammeter and a motor speed sensor coupled to the puller drive.

An eighth aspect of the present disclosure may include any one of the first through seventh aspects, further comprising a rider roll drive operatively coupled to the rider roll, wherein computer readable and executable instructions, when executed by the processor, may cause the ragger system to automatically adjust the torque on the rider roll, the speed of the rider roll, or both based on the measured one or more input variables.

A ninth aspect of the present disclosure may include any one of the sixth through eighth aspects, wherein the at least one measurement device may comprise a torque measurement device coupled to the puller mechanism, a rider roll torque measurement device coupled to the rider roll, or both. The machine readable and executable instructions, when executed, may cause the ragger system to automatically measure a torque on the puller mechanism, a torque on the rider roll, or both with the at least one measurement device; identify a slippage condition of the ragger based on the measured torque on the puller mechanism, the measured torque on the rider roll, or both; and in response to identifying the slippage condition of the ragger, generate a slippage alarm signal indicative of the slippage condition of the ragger, adjust the withdrawal rate of the tail, adjust the direction of the puller drive, adjust the pressure of the pressure device, adjust the torque on the rider roll, adjust the speed of the rider roll, or combinations thereof.

A tenth aspect of the present disclosure may include any one of the sixth through ninth aspects, wherein the at least one measurement device may comprise a torque measurement device coupled to the puller mechanism, a rider roll torque measurement device coupled to the rider roll, or both. The machine readable and executable instructions, when executed, may cause the ragger system to automatically measure a torque on the puller mechanism, a torque on the rider roll, or both with the at least one measurement device; identify a broken tail condition of the ragger based on the measured torque on the puller mechanism, the measured torque on the rider roll, or both; and in response to identifying the broken tail condition of the ragger, generate a tail breakage alarm signal indicative of the broken tail condition of the ragger, adjust the withdrawal rate of the tail, adjust the direction of the puller drive, adjust the pressure of the pressure device, adjust the torque on the rider roll, adjust the speed of the rider roll, or combinations thereof.

An eleventh aspect of the present disclosure may include any one of the first through tenth aspects, wherein the one or more measurement devices may comprise a position sensor operable to determine a position of the rider roll relative to the puller mechanism.

A twelfth aspect of the present disclosure may include the eleventh aspect, wherein the machine readable and executable instructions, when executed by the processor, may cause the ragger system to automatically measure a position of the rider roll relative to the puller mechanism with the position sensor and adjust the rate of withdrawal of the tail, the direction of the puller drive, the pressure of the pressure device, a torque on the rider roll, speed of the rider roll, or combinations thereof based on the position of the rider roll relative to the puller mechanism.

A thirteenth aspect of the present disclosure may include the twelfth aspect, wherein the machine readable and executable instructions, when executed, may cause the ragger system to automatically determine a thickness of the tail from the position of the rider roll relative to the puller mechanism as measured by the position sensor and adjust the rate of withdrawal of the tail, the direction of the puller drive, the pressure of the pressure device, a torque on the rider roll, speed of the rider roll, or combinations thereof based on the determination of the thickness of the tail.

A fourteenth aspect of the present disclosure may include the thirteenth aspect, wherein the machine readable and executable instructions, when executed, may cause the ragger system to automatically modulate the pressure of the pressure device measure the position of the rider roll relative to the puller mechanism with the position sensor at each pressure of the pressure device, determine a relative density of the tail from the pressure of the pressure device and the position of the rider roll relative to the puller mechanism, and adjust the rate of withdrawal of the tail, the direction of the puller drive, the pressure of the pressure device, a torque on the rider roll, speed of the rider roll, or combinations thereof based on the determination of the relative density of the tail.

A fifteenth aspect of the present disclosure may include the fourteenth aspect, wherein the machine readable and executable instructions, when executed, may cause the ragger system to automatically send a control signal to the pressure device, wherein the control signal is indicative of the pressure exerted by the rider roll against the tail, and vary the control signal periodically, wherein varying the control signal causes modulation of the pressure device to modulate the pressure exerted by the rider roll against the tail.

A sixteenth aspect of the present disclosure may include any one of the first through fifteenth aspects, wherein the one or more measurement devices comprise one or more cameras positioned within the pulper vessel or positioned above the pulper vessel, the ragger, or both.

A seventeenth aspect of the present disclosure may include the sixteenth aspect, wherein the machine readable and executable instructions, when executed, may cause the ragger system to automatically capture one or more images of the tail with the one or more cameras, determine one or more input variables from the captured images, and adjust the rate of withdrawal of the tail, the direction of the puller drive, the pressure of the pressure device, a torque on the rider roll, a speed of the rider roll, or combinations thereof based on the one or more attributes of the tail determined from the captured images.

An eighteenth aspect of the present disclosure may include either one of the sixteenth or seventeenth aspects, wherein the one or more cameras may be positioned to capture images that include at least 50%, at least 75%, at least 90%, or even at least 95% of the exposed length of the tail, wherein the exposed length of the tail is the length of the tail from the puller mechanism to a point where the tail enters the pulp slurry in the pulping vessel. The machine readable and executable instructions, when executed, may cause the ragger system to automatically capture one or more images of the tail with the one or more cameras, wherein the captured images show at least 50%, at least 75%, at least 90%, or even at least 95% of the exposed length of the tail; and process the captured images to produce a thickness profile as a function of position along the length of the tail, where the thickness profile may comprises the thickness of the tail at each position along the length of the tail.

A nineteenth aspect of the present disclosure may include any one of the sixteenth through eighteenth aspects, wherein the machine readable and executable instructions, when executed, may cause the ragger system to automatically determine a rate of thickness change in the tail at each position along the exposed length of the tail from the thickness profile; identify one or more locations along the exposed length of the tail where a magnitude of the rate of thickness change of the tail exceeds a threshold rate of thickness change; and adjust the rate of withdrawal of the tail, the direction of the puller drive, the pressure of the pressure device, a torque on the rider roll, speed of the rider roll, or combinations thereof based on identification of the locations where the magnitude of the rate of change of the tail exceeds the threshold rate of thickness change.

A twentieth aspect of the present disclosure may include any one of the sixteenth through nineteenth aspects, wherein the machine readable and executable instructions, when executed, may cause the ragger system to automatically capture one or more images of the tail; identify weak spots in the tail from the captured images and locations of the weak spots in the tail, where weak spots in the tail comprise locations along the tail where the tail is thinner by at least 10%, at least 15%, at least 20%, or even at least 25% relative to other adjacent portions of the tail; and adjust the rate of withdrawal of the tail, the direction of the puller drive, the pressure of the pressure device, a torque on the rider roll, speed of the rider roll, or combinations thereof based on identification of the weak spots from the one or more images.

A twenty-first aspect of the present disclosure may include the twentieth aspect, wherein the machine readable and executable instructions, when executed, may cause the ragger system to automatically process the one or more images of the tail to produce a thickness profile of the tail and identify thinner areas of the tail, where the thinner areas of the tail are indicative of weak spots in the tail.

A twenty-second aspect of the present disclosure may include any one of the sixteenth through twenty-first aspects, wherein the machine readable and executable instructions, when executed, may cause the ragger system to automatically capture a plurality of images of the tail as a function of time with the one or more cameras; process the plurality of images to determine a frequency, an amplitude, or both of oscillations of the tail relative to the ragger; and adjust the rate of withdrawal of the tail, the direction of the puller drive, the pressure of the pressure device, a torque on the rider roll, speed of the rider roll, or combinations thereof based on the frequency, the amplitude, or both of oscillations of the tail.

A twenty-third aspect of the present disclosure may include the twenty-second aspect, wherein the machine readable and executable instructions, when executed, may cause the ragger system to automatically determine a position of a reference point on a width of the tail for each of the plurality of images of the tail captured by the camera; produce a data set comprising the position of the reference point on the width of the tail as a function of time for the plurality of images of the tail; and process the data set using a Fast Fourier Transformation (FFT) algorithm to produce frequencies and amplitudes that characterize oscillation of the tail relative to the ragger.

A twenty-fourth aspect of the present disclosure may include the twenty-third aspect, wherein the machine readable and executable instructions, when executed, may cause the ragger system to automatically develop one or more correlations relating the frequencies and amplitudes characteristic of oscillation of the tail relative to the ragger to the one or more attributes of the tail, the one or more operating conditions of the ragger, the one or more operating conditions of the pulper vessel, or combinations of these; determine the one or more attributes of the tail, the one or more operating conditions of the ragger, the one or more operating conditions of the pulper vessel, or combinations of these from the one or more correlations; and adjust the rate of withdrawal of the tail, the direction of the puller drive, the pressure of the pressure device, a torque on the rider roll, speed of the rider roll, or combinations thereof based on the one or more attributes of the tail, the one or more operating conditions of the ragger, the one or more operating conditions of the pulper vessel, or combinations of these determined from the one or more correlations.

A twenty-fifth aspect of the present disclosure may include any one of the first through twenty-fourth aspects, wherein the one or more measuring devices may further comprise a consistency sensor operatively coupled to the pulper vessel, a level sensor operatively coupled to the pulper vessel, a pulper torque sensor coupled to a rotor of the pulper vessel, a temperature sensor operatively coupled to the pulper vessel, a feed conveyor speed sensor coupled to a feed conveyor of the pulping system, or combinations thereof. The machine readable and executable instructions, when executed, may cause the ragger system to automatically: measure a consistency of the pulp slurry with the consistency sensor, a fluid level of the pulp slurry with the level sensor, a rotor torque on the rotor of the pulper vessel with the pulper torque sensor, a temperature of the pulp slurry with the temperature sensor, a speed of the feed conveyor with the feed conveyor speed sensor, or combinations thereof; and adjust the rate of withdrawal of the tail, the direction of the puller drive, the pressure of the pressure device, a torque on the rider roll, speed of the rider roll, or combinations thereof based on the consistency of the pulp slurry, the fluid level of the pulp slurry, the temperature of the pulp slurry, the torque on the rotor of the pulper vessel, the speed of the feed conveyor, or combinations thereof.

A twenty-sixth aspect of the present disclosure may include any one of the first through twenty-fifth aspects, wherein the one or more measuring devices further comprise a consistency sensor disposed in the pulper vessel of the pulping system, the consistency sensor operable to measure a consistency of a pulp slurry in the pulper vessel. The machine readable and executable instructions, when executed, cause the ragger system to automatically measure the consistency of the pulp slurry in the pulper vessel with the consistency sensor and adjust the rate of withdrawal of the tail, the direction of the puller drive, the pressure of the pressure device, a torque on the rider roll, speed of the rider roll, or combinations thereof based on the consistency of the pulp slurry in the pulper vessel.

A twenty-seventh aspect of the present disclosure may include any one of the first through twenty-sixth aspects, wherein the one or more measuring devices may further comprise a level sensor disposed in the pulper vessel of the pulping system, the level sensor operable to measure a fluid level of a pulp slurry in the pulper vessel. The machine readable and executable instructions, when executed, may cause the ragger system to automatically measure the fluid level of the pulp slurry in the pulper vessel with the level sensor and adjust the rate of withdrawal of the tail, the direction of the puller drive, the pressure of the pressure device, a torque on the rider roll, speed of the rider roll, or combinations thereof based on the fluid level of the pulp slurry in the pulper vessel.

A twenty-eighth aspect of the present disclosure may include any one of the first through twenty-seventh aspects, wherein the one or more measuring devices further comprise a pulper torque sensor coupled to a rotor of the pulper vessel, the pulper torque sensor operable to measure torque on the rotor disposed in the pulper vessel. The machine readable and executable instructions, when executed, may cause the ragger system to automatically measure the torque on the rotor in the pulper vessel with the pulper torque sensor, where the torque on the rotor is indicative of a magnitude of forces acting on tail by the pulp slurry in the pulper vessel; and adjust the rate of withdrawal of the tail, the direction of the puller drive, the pressure of the pressure device, a torque on the rider roll, speed of the rider roll, or combinations thereof based on the measured torque on the rotor in the pulper vessel.

A twenty-ninth aspect of the present disclosure may include any one of the first through twenty-eighth aspects, wherein the one or more measuring devices further comprise a feed conveyor speed sensor coupled to a feed conveyor of the pulping system, the feed conveyor speed sensor operable to measure speed of the feed conveyor. The machine readable and executable instructions, when executed by the processor, may cause the ragger system to automatically measure the speed of the feed conveyor with the feed conveyor speed sensor; determine a production rate of the pulping system, a ratio of recycled furnish to virgin furnish in the pulper vessel, or both; and adjust the rate of withdrawal of the tail, the direction of the puller drive, the pressure of the pressure device, a torque on the rider roll, speed of the rider roll, or combinations thereof based on the production rate of the pulping system, the ratio of recycled furnish to virgin furnish in the pulper vessel, or both.

A thirtieth aspect of the present disclosure may include any one of the first through twenty-ninth aspects, wherein the one or more measurement devices may comprise a capacitance sensor coupled to the ragger, where the capacitance sensor is configured to measure a capacitance of the tail. In embodiments, the capacitance sensor may coupled to the puller mechanism, the rider roll, a frame of the ragger, or combinations thereof. In embodiments, the ragger comprises a guide arm having a guide roll, and the capacitance sensor may be coupled to the guide arm or the guide roll.

A thirty-first aspect of the present disclosure may include the thirtieth aspect, wherein the machine readable and executable instructions, when executed, may cause the ragger system to automatically measure a capacitance of the tail with the capacitance sensor; determine a relative metal content of the tail from the measured capacitance, where the relative metal content of the tail is indicative of a strength of the tail; and adjust the rate of withdrawal of the tail, the direction of the puller drive, the pressure of the pressure device, a torque on the rider roll, speed of the rider roll, or combinations thereof based on the relative metal content of the tail.

A thirty-second aspect of the present disclosure may include any one of the first through thirty-first aspects, wherein the puller mechanism may comprises a primary roll and the one or more measurement devices comprise a plurality of load cells disposed on feet of the ragger, on support bearings for the primary roll, on journals of the primary roll, or combinations of these, where the feet of the ragger are disposed between a base plate of the ragger and an operating floor on which the ragger is supported.

A thirty-third aspect of the present disclosure may include the thirty-second aspect, wherein the plurality of load cells may be disposed on the feet of the ragger closest to the pulping system or may be disposed on all of the feet of the ragger.

A thirty-fourth aspect of the present disclosure may include either one of the thirty-second or thirty-third aspects, wherein each of the plurality of load cells may be operable to measure a relative weight of the tail and generate a weight signal indicative of the relative weight of the tail. The machine readable and executable instructions, when executed, may cause the ragger system to automatically: receive the weight signals from the plurality of load cells; determine a relative weight of the tail based on weight signals; and adjust the rate of withdrawal of the tail, the direction of the puller drive, the pressure of the pressure device, a torque on the rider roll, speed of the rider roll, or combinations thereof based on the relative weight of the tail.

A thirty-fifth aspect of the present disclosure may include any one of the first through thirty-fourth aspects, wherein the one or more measuring devices may comprise an ammeter and a speed sensor operatively coupled to the puller drive and communicatively coupled to the control system. The machine readable and executable instructions, when executed, may cause the ragger system to automatically: receive from the ammeter an amperage signal indicative of the current drawn by the puller drive; receive from the speed sensor a speed signal indicative of a rotational speed of the puller drive; determine a size or a weight of the tail from the amperage signal and the speed signal; and adjust the rate of withdrawal of the tail, the direction of the puller drive, the pressure of the pressure device, a torque on the rider roll, speed of the rider roll, or combinations thereof based on the size or weight of the tail.

A thirty-sixth aspect of the present disclosure is directed to a method for operating a ragger for removing solid debris from a pulping system. The method comprises removing a tail of solid debris from a pulper vessel of the pulping system with a ragger comprising a puller mechanism, a puller drive, a rider roll spaced apart from the puller mechanism, and a pressure device configured to adjust a pressure of the rider roll on the tail disposed between the puller mechanism and the rider roll. The method may further include determining one or more attributes of the tail, one or more operating conditions of the ragger, one or more operating conditions of the pulping system, or combinations of these from measurement of one or more input variables. The method may further include adjusting a rate of withdrawal of the tail, a direction of the puller drive, a pressure of the pressure device, a torque on the rider roll, speed of the rider roll, a rotational positon of the ragger relative to the pulper vessel, or combinations thereof based on the measured input variables.

A thirty-seventh aspect of the present disclosure may include the thirty-sixth aspect, comprising determining the one or more attributes of the tail from the one or more input variables, wherein the one or more attributes of the tail may comprise one or more of a thickness of the tail, a length of the tail, a weight of the tail, a density of the tail, a metal content of the tail, a position of the tail in the pulper vessel, a location of one or more weak spots in the tail, a rate of thickness change of the tail, a thickness profile of the tail, or combinations of these.

A thirty-eighth aspect of the present disclosure may include either one of the thirty-sixth or thirty-seventh aspects, comprising determining the one or more operating conditions of the ragger from the one or more input variables, wherein the one or more operating conditions of the ragger may comprise one or more of a pulling rate of the ragger, a direction of pull of the ragger, a slippage condition of the ragger, a broken tail condition, a pressure of the pressure device, a torque on the rider roll, a speed of the rider roll, a proximity of the rider roll to the puller mechanism, or combinations of these.

A thirty-ninth aspect of the present disclosure may include any one of the thirty-sixth through thirty-eighth aspects, comprising determining the one or more operating conditions of the pulping system from the one or more input variables, wherein the one or more operating conditions of the pulping system may comprise one or more of a production rate of the pulping system, a consistency of pulp in the pulping vessel, a level of the pulp in the pulping vessel, a ratio of recycled furnish to virgin furnish in the pulping system, a temperature of the pulps slurry, a feed conveyor speed, or combinations of these.

A fortieth aspect of the present disclosure may include any one of the thirty-sixth through thirty-ninth aspects, comprising adjusting the withdrawal rate of the tail from the pulper vessel, wherein the puller drive may be a variable speed drive and adjusting the withdrawal rate of the tail comprises adjusting a rotational speed of the puller drive or the puller drive may be a fixed speed drive and adjusting the withdrawal rate of the tail may comprise adjusting an on-off timing of the primary roll drive.

A forty-first aspect of the present disclosure may include any one of the thirty-sixth through fortieth aspects, comprising measuring a torque on the puller drive, a torque on the puller mechanism, a rider roll torque on the rider roll or rider roll drive, or a combination of these; and identifying a slippage condition of the ragger based on the measurements of the torque on the puller drive, the torque on the puller mechanism, the rider roll torque on the rider roll or rider roll drive, or both, where the slippage condition refers to a condition in which the tail slips on the puller mechanism, the rider roll, or both and further operation of the puller mechanism does not withdraw the tail from the pulper vessel.

A forty-second aspect of the present disclosure may include the forty-first aspect, further comprising, in response to identifying the slippage condition of the ragger, producing a slippage alarm indicative of the slippage condition of the ragger, adjusting the withdrawal rate of the tail, adjusting the direction of the puller drive, adjusting the pressure of the pressure device, adjusting the torque on the rider roll, adjusting the speed of the rider roll, or combinations thereof to remediate the slippage condition of the ragger.

A forty-third aspect of the present disclosure may include any one of the thirty-sixth through forty-second aspect, comprising measuring a torque on the puller drive, a torque on the puller mechanism, a rider roll torque on the rider roll or rider roll drive, or a combination of these; and identifying a broken tail condition of the ragger based on the measurements of the torque on the puller drive, the torque on the puller mechanism, the rider roll torque on the rider roll or rider roll drive, or both, where the broken tail condition refers to a condition in which the tail breaks and falls back into the pulper vessel; and in response to identifying the broken tail condition of the ragger, producing a broken tail alarm indicative of the broken tail condition, adjusting the withdrawal rate of the tail, adjusting the direction of the puller drive, adjusting the pressure of the pressure device, adjusting the torque on the rider roll, adjusting the speed of the rider roll, or combinations thereof to remediate the broken tail condition of the ragger A forty-fourth aspect of the present disclosure may include any one of the thirty-sixth through forty-third aspects, wherein the one or more input variables may comprise an amount of current drawn by the puller drive and a rotational speed of the puller drive and the method may comprise: measuring the amount of current drawn by the primary roll drive and the rotational speed of the primary roll drive; determining a relative size or a relative weight of the tail from the current drawn by the primary roll drive and the rotational speed of the primary roll drive; and adjusting the rate of withdrawal of the tail, the direction of the puller drive, the pressure of the pressure device, the torque on the rider roll, speed of the rider roll, or combinations thereof based on the relative size or the relative weight of the tail.

A forty-fifth aspect of the present disclosure may include any one of the thirty-sixth through forty-fourth aspects, wherein the one or more input variables may comprise a frequency, a magnitude, or both of vibrations caused by oscillations of the tail relative to the ragger, and the method may comprise measuring the frequency, the magnitude, or both of the oscillations of the tail with a vibration sensor; determining a relative size or a relative weight of the tail from the frequency, the magnitude, or both of the vibrations caused by oscillation of the tail; and adjusting the rate of withdrawal of the tail, the direction of the puller drive, the pressure of the pressure device, the torque on the rider roll, speed of the rider roll, or combinations thereof based on the determined size of the tail.

A forty-sixth aspect of the present disclosure may include any one of the thirty-sixth through forty-fifth aspects, wherein the one or more input variables may comprise a position of the rider roll relative to the puller mechanism and the method may comprise measuring the position of the rider roll relative to the puller mechanism, wherein the position of the rider roll relative to the puller mechanism is indicative of the thickness of the tail; and adjusting the rate of withdrawal of the tail, the direction of the puller drive, the pressure of the pressure device, the torque on the rider roll, speed of the rider roll, or combinations thereof based on the position of the rider roll relative to the puller mechanism.

A forty-seventh aspect of the present disclosure may include the forty-sixth aspect, wherein the one or more input variables may further comprise a pressure of the pressure device and the method may further comprise modulating the pressure of the pressure device; measuring the position of the rider roll relative to the puller mechanism for each pressure during modulation of the pressure of the pressure device; determining a relative density of the tail from the pressure and position of the rider roll relative to the puller mechanism; and adjusting the rate of withdrawal of the tail, the direction of the puller drive, the pressure of the pressure device, the torque of the rider roll, speed of the rider roll, or combinations thereof based on the determination of the relative density of the tail.

A forty-eighth aspect of the present disclosure may include any one of the thirty-sixth through forty-seventh aspects, wherein the one or more input variables may comprise one or more images of the tail, and the method may comprise capturing the one or more images of the tail; processing the one or more images to determine one or more attributes of the tail; and adjusting the rate of withdrawal of the tail, the direction of the puller drive, the pressure of the pressure device, the torque on the rider roll, speed of the rider roll, the rotational position of the ragger relative to the pulper vessel, or combinations thereof based on the one or more attributes of the tail determined from the one or more images.

A forty-ninth aspect of the present disclosure may include any one of the thirty-sixth through forty-eighth aspects, wherein the one or more input variables may comprise one or more images of the tail, and the method may comprise identifying one or more weak spots in the tail from the one or more images; and adjusting the rate of withdrawal of the tail, the direction of the puller drive, the pressure of the pressure device, the torque on the rider roll, speed of the rider roll, or combinations thereof based on identification of the weak spots from the one or more images.

A fiftieth aspect of the present disclosure may include the forty-ninth aspect, wherein the identifying the one or more weak spots in the tail may comprises processing the one or more images of the tail to produce a thickness profile of the tail; and identifying thinner areas of the tail, where the thinner areas of the tail are indicative of weak spots in the tail.

A fifty-first aspect of the present disclosure may include any one of the forty-eighth through fiftieth aspects, wherein the one or more attributes of the tail may comprise a frequency, an amplitude, or both of the vibrations caused by oscillation of the tail relative to the ragger, and the method may comprise capturing a plurality of images of the tail as a function of time with one or more cameras; processing the plurality of images to determine a frequency, an amplitude, or both of oscillations of the tail relative to the ragger; and adjusting the rate of withdrawal of the tail, the direction of the puller drive, the pressure of the pressure device, the torque on the rider roll, speed of the rider roll, or combinations thereof based on the frequency, the amplitude, or both of the vibrations caused by oscillations of the tail.

A fifty-second aspect of the present disclosure may include any one of the thirty-sixth through fifty-first aspects, wherein the one or more input variables may further comprise a consistency of the pulp slurry in the pulper vessel, a fluid level of the pulp slurry, a temperature of the pulp slurry, a production rate of the pulping system, a conveyor speed of a feed conveyor to the pulper vessel, a torque on a rotor motor of the pulper vessel, or combinations of these. The method may further comprise measuring one or more of the consistency of the pulp slurry in the pulper vessel, the fluid level of the pulp slurry, the temperature of the pulp slurry, the production rate of the pulping system, the conveyor speed of a feed conveyor to the pulper vessel, the torque on rotor motor of the pulper vessel, or combinations of these and adjusting the rate of withdrawal of the tail, the direction of the puller drive, the pressure of the pressure device, the torque on the rider roll, speed of the rider roll, or combinations thereof based on the consistency of the pulp slurry in the pulper vessel, the fluid level of the pulp slurry, the temperature of the pulp slurry, the production rate of the pulping system, the conveyor speed of a feed conveyor to the pulper vessel, the torque on an rotor motor of the pulper vessel, or combinations thereof.

A fifty-third aspect of the present disclosure may include any one of the thirty-sixth through fifty-second aspects, comprising capturing one or more images of the tail; identifying one or more sudden thickness expansion locations of the tail from the captured images and, where the one or more sudden thickness expansion locations of the tail comprise locations along the tail where the tail is thicker by at least 20% relative to other adjacent portions of the tail; and adjusting the rate of withdrawal of the tail, the direction of the puller drive, the pressure of the pressure device, a torque on the rider roll, a speed of the rider roll, or combinations thereof based on identifying the sudden thickness expansion locations from the one or more images.

A fifty-fourth aspect of the present disclosure may include any one of the first through thirty-fifth aspects, wherein the machine readable and executable instructions, when executed by the processor, may cause the ragger system to automatically capture one or more images of the tail; identify one or more sudden thickness expansion locations of the tail from the captured images and, where the one or more sudden thickness expansion locations of the tail comprise locations along the tail where the tail is thicker by at least 20% relative to other adjacent portions of the tail; and adjust the rate of withdrawal of the tail, the direction of the puller drive, the pressure of the pressure device, a torque on the rider roll, a speed of the rider roll, or combinations thereof based on identification of the sudden thickness expansion locations from the one or more images.

While various embodiments of the ragger systems have been described herein, it should be understood that it is contemplated that each of these embodiments and techniques may be used separately or in conjunction with one or more embodiments and techniques. It will be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A ragger system for removing solid debris from a pulper vessel of a pulping system, the ragger system comprising:

a ragger operable to pull a tail of solid debris from the pulper vessel, the ragger comprising:

a puller mechanism comprising a puller drive operatively coupled to the puller mechanism, the puller mechanism operable to engage the tail and pull the tail from the pulper vessel;

a rider roll spaced apart from the puller mechanism; and a pressure device configured to adjust a pressure of the rider roll on the tail disposed between the puller mechanism and the rider roll;

at least one measurement device operable to measure one or more input variables indicative of one or more attributes of the tail, one or more operating conditions of the ragger, one or more operating conditions of the pulping system, or combinations thereof, wherein the at least one measurement device comprises a position sensor operable to determine a position of the rider roll relative to the puller mechanism; and a control system comprising a processor, a memory module communicatively coupled to the processor, and machine readable and executable instructions stored on the memory module, wherein:

the control system is communicatively coupled to the at least one measurement device and to the puller drive, the pressure device, or combinations thereof; and the machine readable and executable instructions, when executed by the processor, cause the ragger system to automatically:

measure a positon of the rider roll relative to the puller mechanism with the position sensor;

determine a thickness of the tail from the position of the rider roll relative to the puller mechanism as measured by the position sensor; and adjust the rate of withdrawal of the tail, the direction of the puller drive, the pressure of the pressure device, the torque on the rider roll, the speed of the rider roll, or combinations thereof based on the determination of the thickness of the tail.

2. The system of claim 1, wherein:

the puller drive is a variable speed drive;

the puller drive drives the puller mechanism continuously to advance the tail through the ragger during operation of the ragger and does not operate to turn the puller mechanism off and on at regular intervals to advance the tail; and the rate of withdrawal of the tail from the pulper vessel is controlled by changing the speed of the puller drive.

3. The system of claim 1, wherein the at least one measurement device further comprises a torque measurement device coupled to the puller mechanism, the puller drive, or a drive train coupling the puller drive to the puller mechanism, and the machine readable and executable instructions, when executed by the processor, further causes the ragger system to automatically:

measure a torque on the puller mechanism with the torque measurement device; and adjust the rate of withdrawal of the tail, a direction of the puller drive, the pressure of the pressure device, a torque on the rider roll, or combinations thereof based on the measured torque on the puller mechanism.

4. The system of claim 1, wherein:

the at least one measurement device further comprises a torque measurement device coupled to the puller mechanism, a rider roll torque measurement device coupled to the rider roll, or both; and the machine readable and executable instructions, when executed by the processor, further causes the ragger system to automatically:

measure a torque on the puller mechanism, a torque on the rider roll, or both with the at least one measurement device;

identify a broken tail condition of the ragger based on the measured torque on the puller mechanism, the measured torque on the rider roll, or both; and in response to identifying a broken tail condition of the ragger, generate a broken tail alarm signal indicative of the broken tail condition of the ragger, adjust the withdrawal rate of the tail, adjust the direction of the puller drive, adjust the pressure of the pressure device, adjust a torque on the rider roll, adjust a speed of the rider roll or combinations thereof.

5. The system of claim 1, wherein the machine readable and executable instructions, when executed by the processor, further causes the ragger system to automatically:

modulate the pressure of the pressure device;

measure the position of the rider roll relative to the puller mechanism with the position sensor at each pressure of the pressure device;

determine a relative density of the tail from the pressure of the pressure device and the position of the rider roll relative to the puller mechanism; and adjust the rate of withdrawal of the tail, the direction of the puller drive, the pressure of the pressure device, the torque on the rider roll, the speed of the rider roll, or combinations thereof based on the determination of the relative density of the tail.

6. The system of claim 5, wherein the machine readable and executable instructions, when executed by the processor, further causes the ragger system to automatically:

send a control signal to the pressure device, wherein the control signal is indicative of the pressure exerted by the rider roll against the tail; and vary the control signal periodically, wherein varying the control signal causes modulation of the pressure device to modulate the pressure exerted by the rider roll against the tail.

7. The system of claim 1, wherein the one or more measurement devices further comprises one or more cameras positioned within the pulper vessel or positioned above the pulper vessel, the ragger, or both.

8. The system of claim 7, wherein the machine readable and executable instructions, when executed by the processor, further causes the ragger system to automatically:

capture one or more images of the tail with the one or more cameras;

determine one or more input variables from the captured images; and adjust the rate of withdrawal of the tail, the direction of the puller drive, the pressure of the pressure device, a torque on the rider roll, a speed of the rider roll, or combinations thereof based on the one or more attributes of the tail determined from the captured images.

9. The system of claim 1, wherein:

the one or more measuring devices further comprises a consistency sensor operatively coupled to the pulper vessel, a level sensor operatively coupled to the pulper vessel, a pulper torque sensor coupled to a rotor of the pulper vessel, a temperature sensor operatively coupled to the pulper vessel, a feed conveyor speed sensor coupled to a feed conveyor of the pulping system, or combinations thereof; and the machine readable and executable instructions, when executed by the processor, further causes the ragger system to automatically:

measure a consistency of the pulp slurry with the consistency sensor, a fluid level of the pulp slurry with the level sensor, a rotor torque on the rotor of the pulper vessel with the pulper torque sensor, a temperature of the pulp slurry with the temperature sensor, a speed of the feed conveyor with the feed conveyor speed sensor, or combinations thereof; and adjust the rate of withdrawal of the tail, the direction of the puller drive, the pressure of the pressure device, a torque on the rider roll, a speed of the rider roll, or combinations thereof based on the consistency of the pulp slurry, the fluid level of the pulp slurry, the temperature of the pulp slurry, the torque on the rotor of the pulper vessel, the speed of the feed conveyor, or combinations thereof.

10. The system of claim 1, wherein the at least one measurement device further comprises a plurality of measurement devices operable to measure a plurality of input variables, wherein the machine readable and executable instructions, when executed by the processor, further causes the ragger system to automatically:

measure the plurality of input variables with the plurality of measurement devices; and adjust the rate of withdrawal of the tail, the direction of the puller drive, the pressure of the pressure device, or combinations thereof based on the measured plurality of input variables.

11. A ragger system for removing solid debris from a pulper vessel of a pulping system, the ragger system comprising:

a ragger operable to pull a tail of solid debris from the pulper vessel, the ragger comprising:

a puller mechanism comprising a puller drive operatively coupled to the puller mechanism, the puller mechanism operable to engage the tail and pull the tail from the pulper vessel;

a rider roll spaced apart from the puller mechanism; and a pressure device configured to adjust a pressure of the rider roll on the tail disposed between the puller mechanism and the rider roll;

at least one measurement device operable to measure one or more input variables indicative of one or more attributes of the tail, one or more operating conditions of the ragger, one or more operating conditions of the pulping system, or combinations thereof, wherein:

the at least one measurement device comprises one or more cameras positioned within the pulper vessel or positioned above the pulper vessel, the ragger, or both; and the one or more cameras are positioned to capture images that include at least 50% of the exposed length of the tail, wherein the exposed length of the tail is the length of the tail from the puller mechanism to a point where the tail enters the pulp slurry in the pulping vessel; and a control system comprising a processor, a memory module communicatively coupled to the processor, and machine readable and executable instructions stored on the memory module, wherein:

the control system is communicatively coupled to the at least one measurement device and to the puller drive, the pressure device, or combinations thereof; and the machine readable and executable instructions, when executed by the processor, cause the ragger system to automatically:

measure the one or more input variables with the at least one measurement device, wherein the one or more input variables is indicative of one or more attributes of the tail, one or more operating conditions of the ragger, one or more operating conditions of the pulping system, or combinations thereof;

adjust a rate of withdrawal of the tail, a direction of the puller drive, a pressure of the pressure device, or combinations thereof based on the measured one or more input variables;

capture one or more images of the tail with the one or more cameras, wherein the captured images show at least 50% of the exposed length of the tail; and process the captured images to produce a thickness profile as a function of position along the length of the tail, where the thickness profile comprises the thickness of the tail at each position along the length of the tail.

12. The system of claim 11, wherein the machine readable and executable instructions, when executed by the processor, further causes the ragger system to automatically:

determine a rate of thickness change in the tail at each position along the exposed length of the tail from the thickness profile;

identify one or more locations along the exposed length of the tail where a magnitude of the rate of thickness change of the tail exceeds a threshold rate of thickness change; and adjust the rate of withdrawal of the tail, the direction of the puller drive, the pressure of the pressure device, a torque on the rider roll, a speed of the rider roll, or combinations thereof based on identification of the locations where the magnitude of the rate of change of the tail exceeds the threshold rate of thickness change.

13. The system of claim 11, wherein the machine readable and executable instructions, when executed by the processor, further causes the ragger system to automatically:

capture one or more images of the tail;

identify weak spots in the tail from the captured images and locations of the weak spots in the tail, where weak spots in the tail comprise locations along the tail where the tail is thinner by at least 10% relative to other adjacent portions of the tail; and adjust the rate of withdrawal of the tail, the direction of the puller drive, the pressure of the pressure device, a torque on the rider roll, a speed of the rider roll, or combinations thereof based on identification of the weak spots from the one or more images.

14. The system of claim 13, wherein the machine readable and executable instructions, when executed by the processor, further causes the ragger system to automatically:

process the one or more images of the tail to produce a thickness profile of the tail; and identify thinner areas of the tail, where the thinner areas of the tail are indicative of weak spots in the tail.

15. The system of claim 11, wherein the machine readable and executable instructions, when executed by the processor, further causes the ragger system to automatically:

capture one or more images of the tail;

identify one or more sudden thickness expansion locations of the tail from the captured images and, where the one or more sudden thickness expansion locations of the tail comprise locations along the tail where the tail is thicker by at least 20% relative to other adjacent portions of the tail; and adjust the rate of withdrawal of the tail, the direction of the puller drive, the pressure of the pressure device, a torque on the rider roll, a speed of the rider roll, or combinations thereof based on identification of the sudden thickness expansion locations from the one or more images.

16. The system of claim 11, wherein the machine readable and executable instructions, when executed by the processor, further causes the ragger system to automatically:

capture a plurality of images of the tail as a function of time with the one or more cameras;

process the plurality of images to determine a frequency, an amplitude, or both of oscillations of the tail relative to the ragger; and adjust the rate of withdrawal of the tail, the direction of the puller drive, the pressure of the pressure device, a torque on the rider roll, a speed on the rider roll, or combinations thereof based on the frequency, the amplitude, or both of oscillations of the tail.

17. The system of claim 16, wherein the machine readable and executable instructions, when executed by the processor, further causes the ragger system to automatically:

determine a position of a reference point on a width of the tail for each of the plurality of images of the tail captured by the camera;

produce a data set comprising the position of the reference point on the width of the tail as a function of time for the plurality of images of the tail; and process the data set using a Fast Fourier Transformation (FFT) algorithm to produce frequencies and amplitudes that characterize oscillation of the tail relative to the ragger.

18. The system of claim 17, wherein the machine readable and executable instructions, when executed by the processor, further causes the ragger system to automatically:

develop one or more correlations relating the frequencies and amplitudes characteristic of oscillation of the tail relative to the ragger to the one or more attributes of the tail, the one or more operating conditions of the ragger, the one or more operating conditions of the pulper vessel, or combinations thereof;

determine the one or more attributes of the tail, the one or more operating conditions of the ragger, the one or more operating conditions of the pulper vessel, or combinations thereof from the one or more correlations; and adjust the rate of withdrawal of the tail, the direction of the puller drive, the pressure of the pressure device, the torque on the rider roll, the speed of the rider roll, or combinations thereof based on the one or more attributes of the tail, the one or more operating conditions of the ragger, the one or more operating conditions of the pulper vessel, or combinations thereof determined from the one or more correlations.

19. The system of claim 11, wherein:

the puller drive is a variable speed drive;

the puller drive drives the puller mechanism continuously to advance the tail through the ragger during operation of the ragger and does not operate to turn the puller mechanism off and on at regular intervals to advance the tail; and the rate of withdrawal of the tail from the pulper vessel is controlled by changing the speed of the puller drive.

20. A ragger system for removing solid debris from a pulper vessel of a pulping system, the ragger system comprising:

a ragger operable to pull a tail of solid debris from the pulper vessel, the ragger comprising:

a puller mechanism comprising a puller drive operatively coupled to the puller mechanism, the puller mechanism operable to engage the tail and pull the tail from the pulper vessel;

a rider roll comprising a rider roll drive operatively coupled to the rider roll, wherein the rider roll is spaced apart from the puller mechanism; and a pressure device configured to adjust a pressure of the rider roll on the tail disposed between the puller mechanism and the rider roll;

at least one measurement device operable to measure one or more input variables indicative of one or more attributes of the tail, one or more operating conditions of the ragger, one or more operating conditions of the pulping system, or combinations thereof, wherein the at least one measurement device comprises a torque measurement device coupled to the puller mechanism, a rider roll torque measurement device coupled to the rider roll, or both; and a control system comprising a processor, a memory module communicatively coupled to the processor, and machine readable and executable instructions stored on the memory module, wherein:

the control system is communicatively coupled to the at least one measurement device and to the puller drive, the rider roll drive, the pressure device, or combinations thereof;

the machine readable and executable instructions, when executed by the processor, cause the ragger system to automatically:

measure a torque on the puller mechanism, a torque on the rider roll, or both with the at least one measurement device;

identify a slippage condition of the ragger based on the measured torque on the puller mechanism, the measured torque on the rider roll, or both; and in response to identifying the slippage condition of the ragger, generate a slippage alarm signal indicative of the slippage condition of the ragger, adjust the withdrawal rate of the tail, adjust the direction of the puller drive, adjust the pressure of the pressure device, adjust the torque of the rider roll, adjust the speed of the rider roll, or combinations thereof.

21. The system of claim 20, wherein:

the puller drive is a variable speed drive;

the puller drive drives the puller mechanism continuously to advance the tail through the ragger during operation of the ragger and does not operate to turn the puller mechanism off and on at regular intervals to advance the tail; and the rate of withdrawal of the tail from the pulper vessel is controlled by changing the speed of the puller drive.

22. The system of claim 20, wherein the machine readable and executable instructions, when executed by the processor, further causes the ragger system to automatically:

identify a broken tail condition of the ragger based on the measured torque on the puller mechanism, the measured torque on the rider roll, or both; and in response to identifying a broken tail condition of the ragger, generate a broken tail alarm signal indicative of the broken tail condition of the ragger, adjust the withdrawal rate of the tail, adjust the direction of the puller drive, adjust the pressure of the pressure device, adjust a torque on the rider roll, adjust a speed of the rider roll or combinations thereof.

* * * * *